US012326053B2

(12) United States Patent
Milne et al.

(10) Patent No.: US 12,326,053 B2
(45) Date of Patent: Jun. 10, 2025

(54) SEALING ASSEMBLY EMPLOYING A CYLINDRICAL PROTECTIVE SLEEVE

(71) Applicant: Halliburton Energy Services, Inc., Houston, TX (US)

(72) Inventors: Adam J. Milne, Carrollton, TX (US); Jalpan Piyush Dave, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/494,555

(22) Filed: Oct. 25, 2023

(65) Prior Publication Data

US 2025/0043645 A1 Feb. 6, 2025

Related U.S. Application Data

(60) Provisional application No. 63/516,951, filed on Aug. 1, 2023, provisional application No. 63/516,934, filed on Aug. 1, 2023, provisional application No. 63/516,912, filed on Aug. 1, 2023.

(51) Int. Cl.
*E21B 33/128* (2006.01)
*E21B 23/06* (2006.01)

(52) U.S. Cl.
CPC ..... *E21B 23/06* (2013.01)

(58) Field of Classification Search
CPC ..... E21B 33/1208; E21B 33/1216; E21B 33/12; E21B 33/1204; E21B 33/124; E21B 33/1243; E21B 33/127; E21B 33/1277; E21B 33/128; E21B 33/1285; E21B 33/129
See application file for complete search history.

(56) References Cited

U.S. PATENT DOCUMENTS

| | | | |
|---|---|---|---|
| 4,424,861 | A | 1/1984 | Carter, Jr. et al. |
| 4,765,404 | A | 8/1988 | Bailey et al. |
| 4,862,967 | A | 9/1989 | Harris |
| 4,979,570 | A | 12/1990 | Mody |
| 5,101,908 | A | 4/1992 | Mody |
| 5,701,959 | A | 12/1997 | Hushbeck et al. |

(Continued)

FOREIGN PATENT DOCUMENTS

| | | | |
|---|---|---|---|
| CA | 2750931 | C | 12/2013 |
| CN | 207093022 | U | 3/2018 |

(Continued)

OTHER PUBLICATIONS

Liu, Y., et al. "Design and Experimental Research on Sealing Structure for a Retrievable Packer," Shock and Vibration, vol. 2020, Article ID 7695276, Hindawi, May 19, 2020, 15 pages.

(Continued)

*Primary Examiner* — Kipp C Wallace
(74) *Attorney, Agent, or Firm* — Scott Richardson; Parker Justiss, P.C.

(57) ABSTRACT

Provided is a sealing assembly, a well system, and a method. The sealing assembly, in one aspect, includes a mandrel, and a sealing element positioned about the mandrel. The sealing element, in this aspect, includes a cylindrical protective sleeve positioned about the sealing element, the cylindrical protective sleeve configured to break to deploy from an undeployed state to a deployed state based upon axial or radial stress imparted thereon.

40 Claims, 53 Drawing Sheets

(56) References Cited

U.S. PATENT DOCUMENTS

| | | | | |
|---|---|---|---|---|
| 6,009,951 | A | 1/2000 | Coronado et al. | |
| 6,598,672 | B2 | 7/2003 | Bell et al. | |
| 6,695,050 | B2 | 2/2004 | Winslow et al. | |
| 6,827,150 | B2 | 12/2004 | Luke | |
| 6,843,315 | B2 | 1/2005 | Coronado et al. | |
| 7,204,305 | B2 | 4/2007 | Ricalton et al. | |
| 7,373,973 | B2 | 5/2008 | Smith et al. | |
| 7,712,541 | B2 | 5/2010 | Loretz et al. | |
| 8,205,671 | B1 | 6/2012 | Branton | |
| 8,479,809 | B2 | 7/2013 | Farquhar | |
| 9,228,411 | B2 | 1/2016 | Themig | |
| 9,260,936 | B1 | 2/2016 | Branton | |
| 9,695,666 | B2 | 7/2017 | Ruffo et al. | |
| 10,174,581 | B2 | 1/2019 | Prieto et al. | |
| 10,358,890 | B2 | 7/2019 | Zhong et al. | |
| 10,634,255 | B2 | 4/2020 | Urban et al. | |
| 10,718,178 | B2 * | 7/2020 | Kellner | E21B 33/128 |
| 11,066,896 | B2 | 7/2021 | Heiman et al. | |
| 11,313,200 | B2 | 4/2022 | Zakharia | |
| 11,492,861 | B2 * | 11/2022 | Eldho | E21B 23/06 |
| 11,492,871 | B2 | 11/2022 | White | |
| 2004/0036225 | A1 | 2/2004 | Ritter et al. | |
| 2004/0055760 | A1 * | 3/2004 | Nguyen | E21B 43/103 166/57 |
| 2004/0056432 | A1 | 3/2004 | Walker et al. | |
| 2004/0118572 | A1 * | 6/2004 | Whanger | E21B 33/1208 166/207 |
| 2006/0278391 | A1 | 12/2006 | Li et al. | |
| 2007/0125532 | A1 * | 6/2007 | Murray | E21B 33/1216 166/179 |
| 2007/0163777 | A1 | 7/2007 | Murray et al. | |
| 2008/0190600 | A1 | 8/2008 | Shkurti et al. | |
| 2009/0255690 | A1 | 10/2009 | Conner et al. | |
| 2012/0006530 | A1 | 1/2012 | Crabb et al. | |
| 2013/0118805 | A1 * | 5/2013 | Moody-Stuart | E21B 43/116 175/2 |
| 2015/0240591 | A1 | 8/2015 | Saltel et al. | |
| 2016/0053570 | A1 | 2/2016 | Andersen | |
| 2018/0087346 | A1 | 3/2018 | Rochen | |
| 2018/0209241 | A1 | 7/2018 | Farquhar et al. | |
| 2018/0245420 | A1 * | 8/2018 | Ringgenberg | E21B 33/12 |
| 2018/0313184 | A1 | 11/2018 | Merron et al. | |
| 2018/0334879 | A1 | 11/2018 | Yue et al. | |
| 2019/0120011 | A1 | 4/2019 | Kellner | |
| 2019/0195058 | A1 | 6/2019 | Robb et al. | |
| 2019/0226298 | A1 * | 7/2019 | Coon | E21B 23/06 |
| 2020/0157908 | A1 | 5/2020 | Nault et al. | |
| 2021/0079756 | A1 | 3/2021 | Ornelaz et al. | |
| 2023/0349258 | A1 * | 11/2023 | Al-Mousa | E21B 17/1085 |
| 2024/0003216 | A1 * | 1/2024 | Duggan | E21B 33/128 |

FOREIGN PATENT DOCUMENTS

| | | | |
|---|---|---|---|
| CN | 113863889 | A | 12/2021 |
| EP | 2425093 | B1 | 9/2018 |
| EP | 3455450 | B1 | 2/2019 |
| EP | 2132405 | B1 | 6/2019 |
| WO | 2017177227 | A1 | 10/2017 |
| WO | 2018063926 | A1 | 4/2018 |

OTHER PUBLICATIONS

Zhong, A., "Challenges for High-Pressure High-Temperature Applications of Rubber Materials in the Oil and Gas Industry," Research Gate, Jan. 2016, 19 pages.

* cited by examiner

200

200g

300

300

500

SEALING ASSEMBLY EMPLOYING A CYLINDRICAL PROTECTIVE SLEEVE

CROSS-REFERENCE TO RELATED APPLICATION

This application claims the benefit of U.S. Provisional Application Ser. No. 63/516,912, filed on Aug. 1, 2023, entitled "SEALING ASSEMBLY EMPLOYING A DEPLOYABLE SPACER," U.S. Provisional Application Ser. No. 63/516,934, filed on Aug. 1, 2023, entitled "SEALING ASSEMBLY EMPLOYING A DEPLOYABLE CONTROL BAND," and U.S. Provisional Application No. 63/516,951, filed on Aug. 1, 2023, entitled "SEALING ASSEMBLY EMPLOYING A CYLINDRICAL EXTRUSION LIMITER," all of which are commonly assigned with this application and incorporated herein by reference in their entirety.

BACKGROUND

A typical sealing tool (e.g., packer, bridge plug, frac plug, etc.) generally has one or more sealing elements or "rubbers" that are employed to provide a fluid-tight seal radially between a mandrel of the sealing tool, and the casing or wellbore into which the sealing tool is disposed. Such a sealing tool is commonly conveyed into a subterranean wellbore suspended from tubing extending to the earth's surface.

To prevent damage to the elements of the sealing tool while the sealing tool is being conveyed into the wellbore, the sealing elements may be carried on the mandrel in a retracted or uncompressed state, in which they are radially inwardly spaced apart from the casing. When the sealing tool is set, the sealing elements radially expand, thereby sealing against the mandrel and the casing and/or wellbore. In certain embodiments, the sealing elements are axially compressed between element retainers that straddle them, which in turn radially expand the sealing elements.

BRIEF DESCRIPTION

Reference is now made to the following descriptions taken in conjunction with the accompanying drawings, in which.

Figure 1:
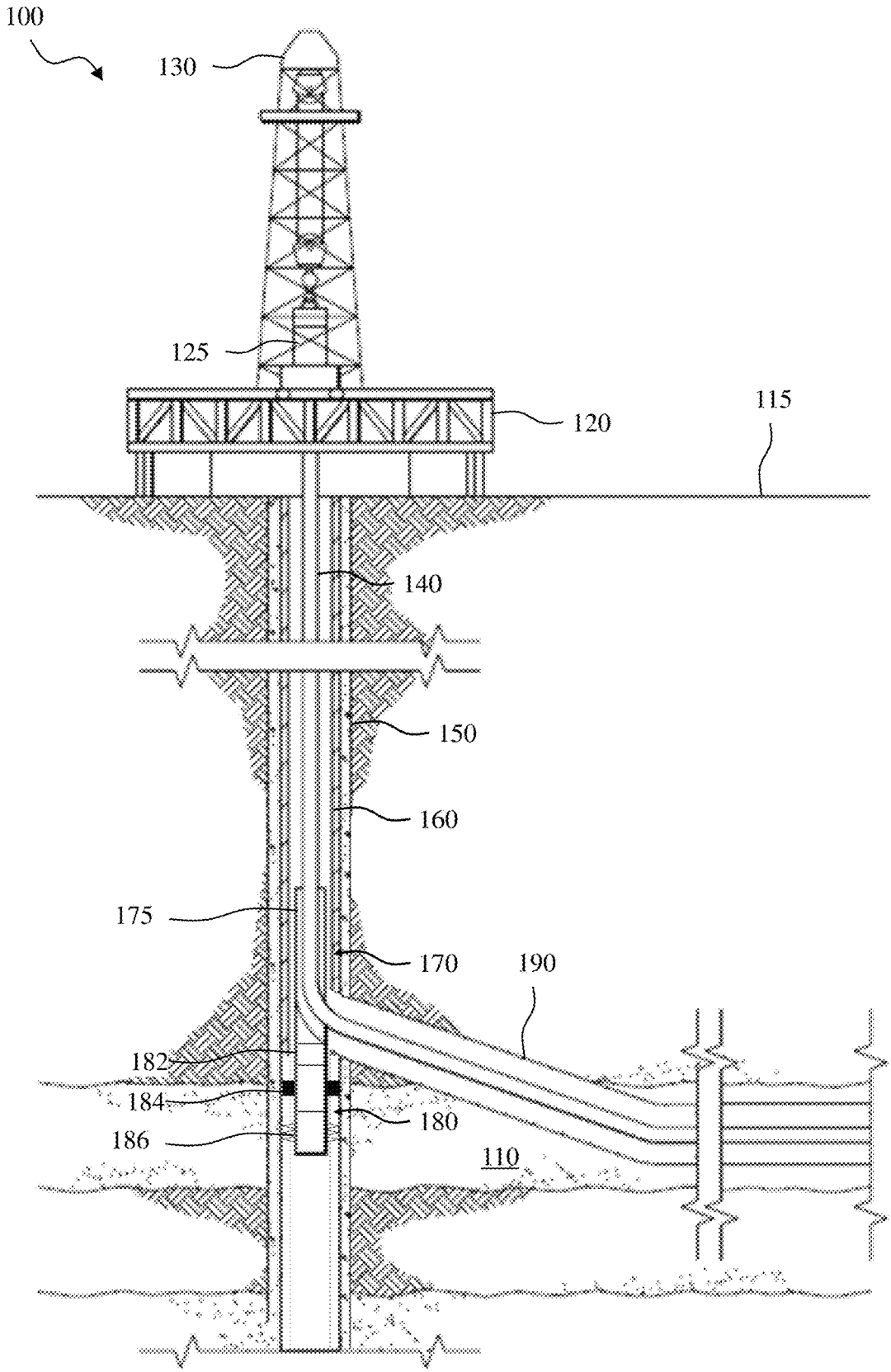
FIG. 1 illustrates a schematic view of a well system designed, manufactured and operated according to one or more embodiments disclosed herein.

FIGS. 8A through 8F illustrate different cross-sectional views of various deployment states of a sealing assembly designed, manufactured and/or operated according to one or more alternative embodiments of the disclosure; and FIGS. 9A through 9D illustrate different cross-sectional views of various deployment states of a sealing assembly designed, manufactured and/or operated according to one or more alternative embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Sealing elements are traditionally a critical part of a sealing assembly. The present disclosure, however, has recognized that sealing elements tend to have difficulties when the expansion ratio (e.g., the distance the sealing elements must move from their radially retracted state to their radially expanded state to engage with a bore, such as a wellbore, tubular, casing, etc.) is large. Specifically, the present disclosure has recognized that such sealing elements often experience challenges in open-hole conditions with significant expansion gaps. For example, due to the large extrusion gap in open-hole conditions, when the sealing element buckles, it will often lose much of its axial stiffness and escape the desired load path. As a result, the sealing element will not effectively transfer the load to the backup shoes, and often tends to extrude over the backup shoe, which in turn can result in an insufficient deployment. In the case of multi-piece sealing element designs, the sealing elements may also tend to climb up over each other in an uncontrolled and chaotic manner, resulting in insufficient deployment of the backup shoe, and thus a poor seal from the sealing elements.

The present disclosure further recognizes that the above problem is less of a challenge when the sealing assembly is employed within a fixed ID casing with small to moderate expansion gaps, for example because when the sealing element buckles the casing imposes an effective lateral confinement to the sealing elements. Accordingly, effective lateral confinement prevents total loss of the sealing element's axial stiffness, such that the backup shoe may continue to deploy following the buckling of the sealing element.

Given the foregoing recognitions, the present disclosure proposes inserting a novel deployable spacer between ones of the sealing elements. The deployable spacer, in one example, improves the axial stiffness of the sealing elements and load transfer mechanism by controlling the deployment of the sealing elements. Accordingly, the use of the deployable spacer may ensure full deployment of the backup shoe with little to no risk of sealing element extrusion.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as a sealing/anchoring assembly 180 coupled to a downhole end thereof. The sealing/anchoring assembly 180, in one or more embodiments, includes an orienting receptacle tool assembly 182, a sealing assembly 184, and an anchoring assembly 186. In at least one embodiment, the anchoring assembly 186 axially, and optionally rotationally, fixes the whipstock assembly 170 within the casing string 160. The sealing assembly 184, in at least one embodiment, seals (e.g., provides a pressure tight seal) an annulus between the whipstock assembly 170 and the casing string 160. The orienting receptacle tool assembly 182, in one or more embodiments, along with a collet and one or more orienting keys, may be used to land and positioned a guided milling assembly and/or the whipstock element section 175 within the casing string 160.

The elements of the whipstock assembly 170 may be positioned within the main wellbore 150 in one or more separate steps. For example, in at least one embodiment, the sealing/anchoring assembly 180, including the orienting receptacle tool assembly 182, sealing assembly 184 and the anchoring assembly 186 are run in hole first, and then set within the casing string 160. In the illustrated embodiment, the sealing assembly 184 is located within an open-hole section of the wellbore 150. In other embodiments, however, the sealing assembly 184 could be located within the casing 160. Thereafter, the sealing assembly 184 may be pressure tested. Thereafter, the whipstock element section 175 may be run in hole and coupled to the sealing assembly 180, for example using the orienting receptacle tool assembly 182. What may result is the whipstock assembly 170 illustrated in FIG. 1.

Turning now to FIGS. 2A through 2F, illustrated are different cross-sectional views of various deployment states of a sealing assembly 200 designed, manufactured and/or operated according to one or more embodiments of the disclosure. The scaling assembly 200, in the illustrated embodiment of FIGS. 2A through 2F, includes a mandrel 210. The mandrel 210, in the illustrated embodiment, may be centered about a centerline (CL). The sealing assembly 200, in at least the embodiment of FIGS. 2A through 2F, additionally includes a bore 290 positioned around the mandrel 210. The bore 290, in at least one embodiment, is a wellbore, such as an open-hole wellbore. The bore 290, in at least one other embodiment, is a tubular positioned within a wellbore, such as a casing, production tubing, etc. In accordance with one aspect of the disclosure, the mandrel 210 and the bore 290 form an annulus 280.

In accordance with one embodiment of the disclosure, the sealing assembly 200 includes a scaling element 220 (e.g., an elastomeric sealing element). The sealing element 220, in accordance with at least one embodiment, includes a first sealing element portion 220*a* and a second sealing element portion 220*b*. In one or more other embodiments, the sealing element 220 additionally includes a third scaling element portion 220*c*, as well as potentially one or more other additional scaling element portions. The sealing element 220, including the first sealing element portion 220*a*, the second sealing element portion 220*b*, and the third sealing element portion 220*c*, is operable to move between a radially retracted state, such as that shown in FIGS. 2A and 2B, and a radially expanded state, such as that shown in FIGS. 2C through 2D (e.g., partially radially expanded state) and FIGS. 2E through 2F (e.g., fully radially expanded state). While a single scaling element 220 is illustrated in FIGS. 2A through 2F, other embodiments exist wherein multiple sealing elements 220 are employed, whether together or spaced apart in series along the mandrel 210. In the embodiment of FIGS. 2A through 2F, the sealing element 220 comprises a non-swellable elastomer, among other types and materials. Further to the embodiment of FIGS. 2A through 2F, the sealing element 220 may alternatively include only a single sealing element portion 220*a*, only two scaling element portions 220*a*, 220*b*, or in other embodiments more than the three sealing element portions 220*a*, 220*b*, 220*c*, shown.

In the illustrated embodiment of FIGS. 2A through 2F, first and second backup shoes 240*a*, 240*b*, straddle first and second ends 225*a*, 225*b*, respectively, of the sealing element 220. Further to the embodiment of FIGS. 2A through 2F, first and second collar sleeves 250*a*, 250*b* straddle the first and second backup shoes 240*a*, 240*b*, respectively. In the embodiment of FIGS. 2A through 2F, a setting sleeve 260 (e.g., an axially fixed setting sleeve) is coupled with the first end 225*a* of the sealing element 220 (e.g., through the first backup shoe 240*a* and first collar sleeve 250*a*). In one or more other embodiments, the first collar sleeve 250*a* and the setting sleeve 260 are a single combined feature, as opposed to the two separate features shown in FIGS. 2A through 2F.

Those skilled in the art understand and appreciate the desire and/or need for the first and second backup shoes 240*a*, 240*b*, including preventing extrusion of the sealing element 220 about the first and second collar sleeves 250*a*, 250*b*. Similarly, those skilled in the art appreciate the desire and/or need for the first and second collar sleeves 250*a*, 250*b*. For example, in the illustrated embodiment of FIGS. 2A through 2F, the first and second collar sleeves 250*a*, 250*b* are configured to axially slide relative to one another to move the sealing element 220 between the radially retracted state, such as that shown in FIGS. 2A and 2B, and a radially expanded state, such as that shown in FIGS. 2C through 2D (e.g., partially radially expanded state) and FIGS. 2E through 2F (e.g., fully radially expanded state).

Figure 2A:
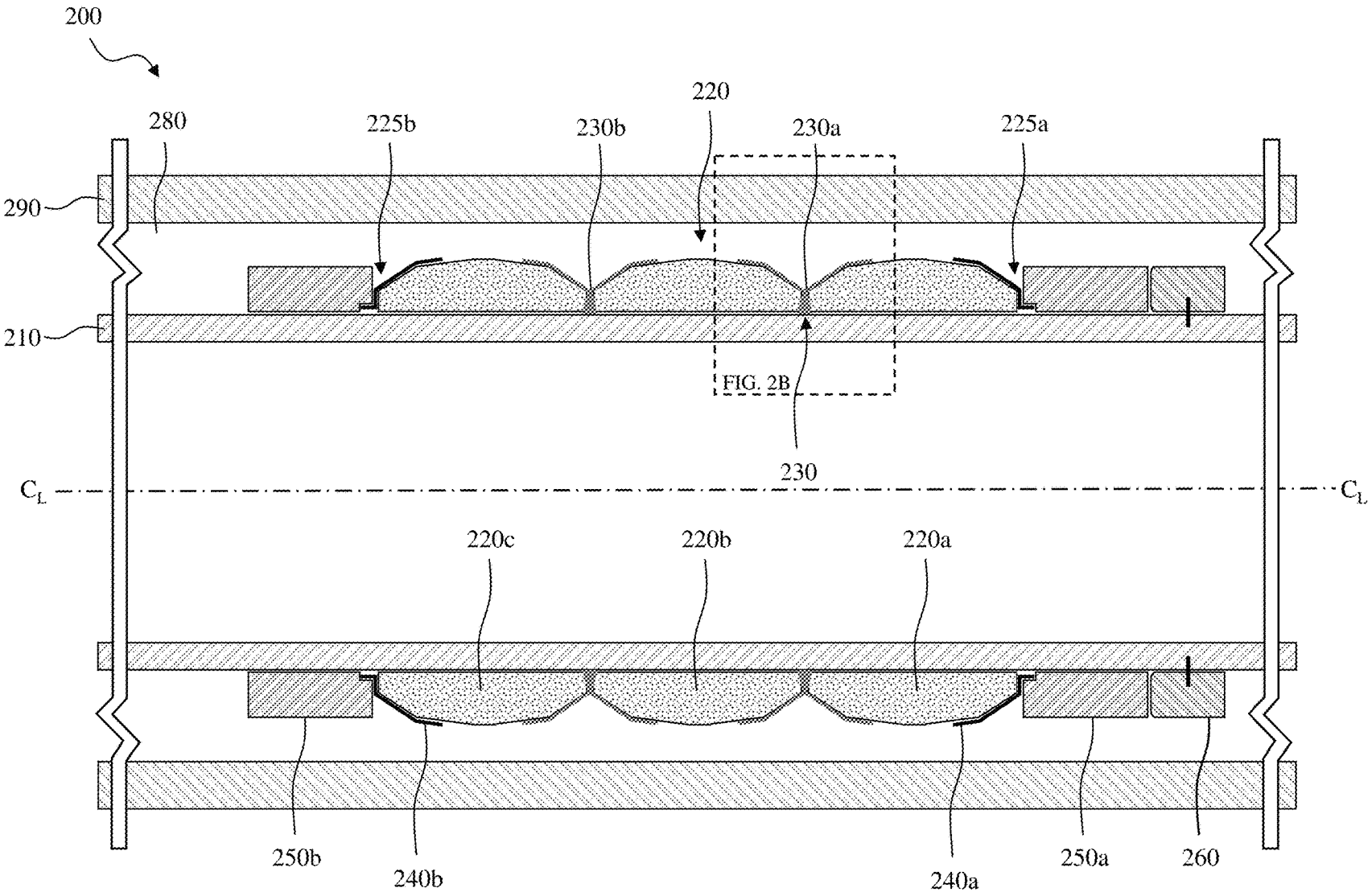
FIGS. 2A through 2F illustrate different cross-sectional views of various deployment states of a sealing assembly designed, manufactured and/or operated according to one or more embodiments of the disclosure.
Figure 2B:
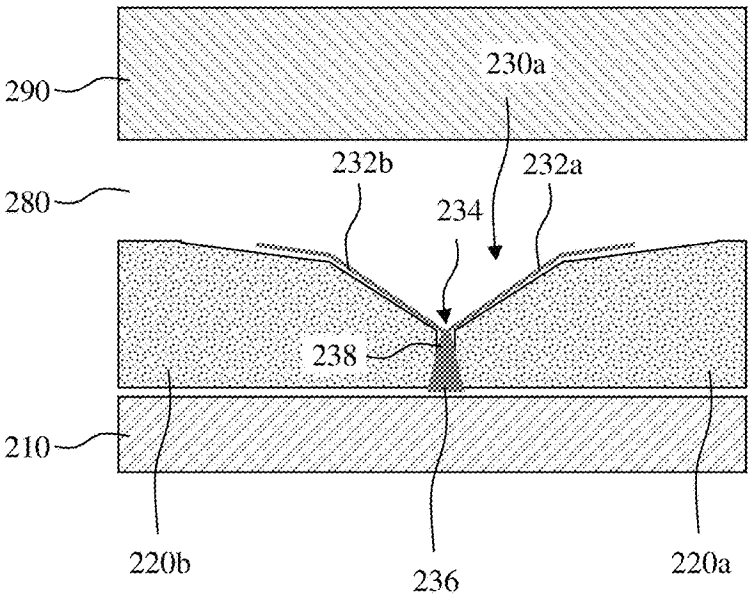

In the embodiment of FIGS. 2A through 2F, the sealing element 200 additionally includes a deployable spacer 230. In the illustrated embodiment, the sealing element 200 includes a first deployable spacer 230*a* positioned between the first sealing element portion 220*a* and the second sealing element portion 220*b*, as well as a second deployable spacer 230*b* positioned between the second sealing element portion 220*b* and the third sealing element portion 220*c*. In at least one embodiment, each adjacent pair of sealing element portions includes their own deployable spacer. Thus, as shown here, three sealing element portions would include two deployable spacers. Accordingly, if the sealing element 200 were to include five sealing element portions, it would likely also include four deployable spacers positioned therebetween. In at least one embodiment, the deployable spacers 230*a*, 230*b* are configured to deploy from an undeployed state (e.g., as shown in FIGS. 2A and 2B) to a deployed state (e.g., as shown in FIGS. 2C through 2F).

In at least one embodiment, each of the deployable spacers 230*a*, 230*b* includes two flanges. In at least one embodiment, a first of the two flanges 232*a* is configured to a control deployment of one adjacent scaling element portion and a second of the two flanges 232*b* is configured to control a deployment of another adjacent sealing element portion. For example, a first of the two flanges 232*a* of the first deployable spacer 230*a* would control a deployment of the first adjacent sealing element portion 220*a* and a second of the two flanges 232*b* of the first deployable spacer 230*a* would also control a deployment of the second adjacent sealing element portion 220*b*. Similarly, a first of the two flanges 232*a* of the second deployable spacer 230*b* would control a deployment of the second adjacent sealing element portion 220*b* and a second of the two flanges 232*b* of the second deployable spacer 230*b* would also control a deployment of the third adjacent sealing element portion 220*c*. In at least one embodiment, the flanges 232 could have structural features (e.g., weakened spots, removed sections (e.g., holes, slots, etc.), etc.) that would allow them to deploy easier.

Further to one or more embodiments disclosed herein, in at least one embodiment, the first of the two flanges 232*a* and the second of the two flanges 232*b* (e.g., for a given deployable spacer 230) are configured to separately deploy, for example sequentially deploy. In at least one embodiment, an axial interior of the two flanges (e.g., the first flange 232*a* of the second deployable spacer 230*b* and the second flange 232*b* of the first deployable spacer 230*a*) are configured to deploy prior to an axial exterior of the two flanges. This may occur naturally as the sealing element 220 is being compressed, or may be intentionally created using different sizes, shapes, and/or materials amongst the two flanges. For example, in at least one embodiment the sequential deployment is achieved by making the sealing elements 220*a*, 220*b*, 220*c* of different materials of varying stiffness, modulus of elasticity, etc., or in another embodiment by having different sizes of grooves in the ID that makes the sealing elements 220*a*, 220*b*, 220*c* (and therefore the flanges 232) sequentially deploy.

In one or more embodiments, such as is shown, each of the deployable spacers 230*a*, 230*b* includes a base member 234 having the two flanges connected thereto, the base member positioned proximate the mandrel 210. Further to this embodiment, the base member 234 may have a wide portion 236 proximate the mandrel 210 and a narrow portion 238 distal the mandrel 210. In at least this one embodiment, the wide portion 236 is configured to resist lifting or overturning of the deployable spacers 230*a*, 230*b* as the sealing element portions 220*a*, 220*b*, 220*c* move between their radially retracted state and their radially expanded state. In at least one other embodiment, the base member 234 includes a first base member portion coupled to one of the flanges 232 and a separate second base member portion coupled to the other of the flanges 232.

In at least one embodiment, the deployable spacers 230*a*, 230*b* are multi-piece designs, the multiple pieces of the deployment spacers connected using one or more fastening techniques, including screws, welds, etc. For example, in at least one embodiment the base member(s) 234 could be physically attached to the mandrel 210, and the flanges 232 mechanically connected to the base member(s) 234 at a later time (e.g., when the sealing assembly 200 is at the rig). Such an embodiment, for example employing later attached segmented flanges 232, would allow different types of flanges 232 to be employed based upon wellbore conditions (e.g., bore size, temperatures, etc.).

The deployable spacers 230*a*, 230*b* may comprise many different materials and remain within the scope of the disclosure. In at least one embodiment, however, the deployable spacers 230*a*, 230*b* comprise a deployable ductile metal, such as AISI 1018 steel or SAE 316L grade stainless steel. In yet another embodiment, the deployable spacers 230*a*, 230*b* comprise a deployable plastic or polymer. For example, in at least one embodiment, at least a portion of the deployable spacers 230*a*, 230*b* comprise a material having a yield strength of 40 ksi or less, if not 30 ksi or less.

FIGS. 2A and 2B illustrate the sealing assembly 200 in a run-in-hole state, and thus its sealing element 220 is in a radially retracted state. For example, each of the first, second and thirds scaling element portions 220*a*, 220*b*, 220*c* are in their radially retracted state. Furthermore, each of the deployable spacers 230*a*, 230*b*, and their associated flanges 232*a*, 232*b*, are in the undeployed state. Similarly, the first and second backup shoes 240*a*, 240*b* are in their undeployed state. In at least one embodiment, the sealing assembly 200, including the deployable spacers 230*a*, 230*b*, and their associated flanges 232*a*, 232*b*, would potentially have better swab-off resistance than conventional sealing assemblies without the deployable spacers 230*a*, 230*b*, thus allowing the sealing assembly 200 to be run-in-hole at a faster rate.

Figure 2C:
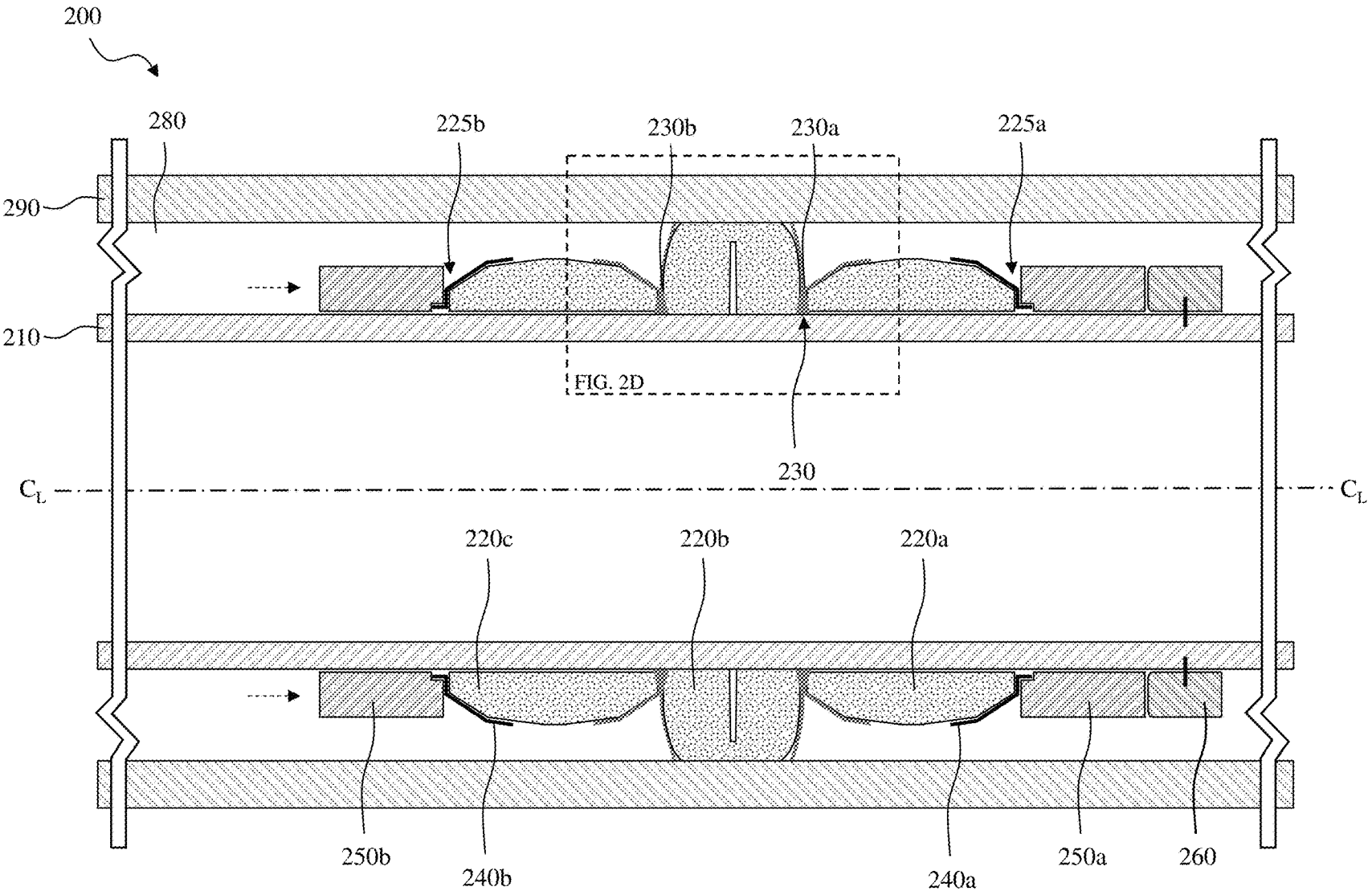
Figure 2D:
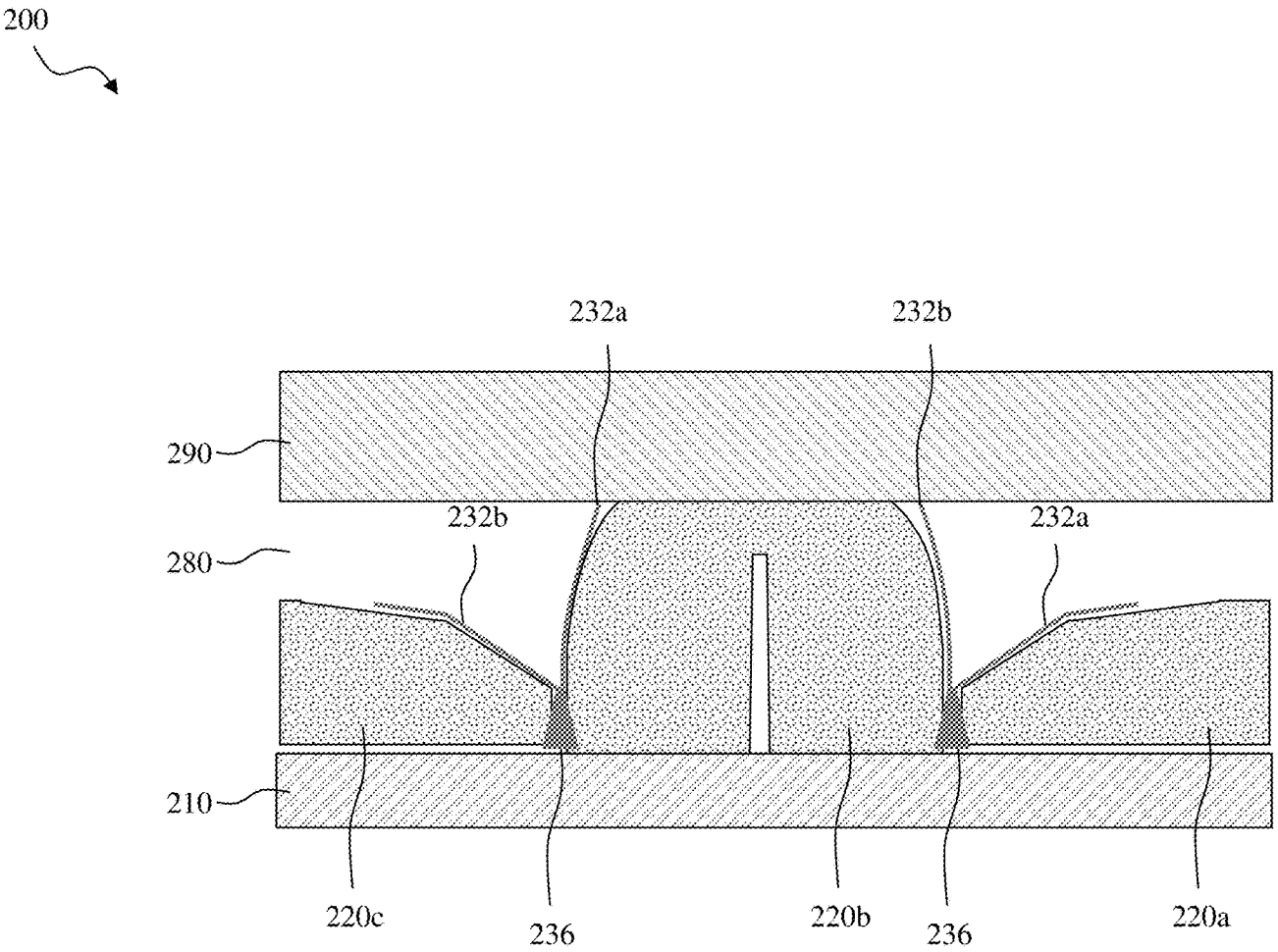

FIGS. 2C and 2D illustrate the sealing assembly 200 as the first and second collar sleeves 250*a*, 250*b* start to axially translate relative to one another. As shown in this embodiment, the axial translation causes the second sealing element portion 220*b* (e.g., the center most sealing element portion) to compress and radially expand. In one or more embodiments, the second sealing element portion 220*b* buckles to radially expand. In at least this one embodiment, the axial interior flanges of the first deployable spacer 230*a* and the second deployable spacer 230*b* gradually deploy to control a deployment of the second sealing element portion 220*b*. For example, the axial interior flanges of the first deployable spacer 230*a* and the second deployable spacer 230*b* substantially prevent the second sealing element portion 220*b* from tipping over, and thus considerably enhances the post deployment (e.g., post buckling) stiffness of the second sealing element portion 220*b*.

Figure 2E:
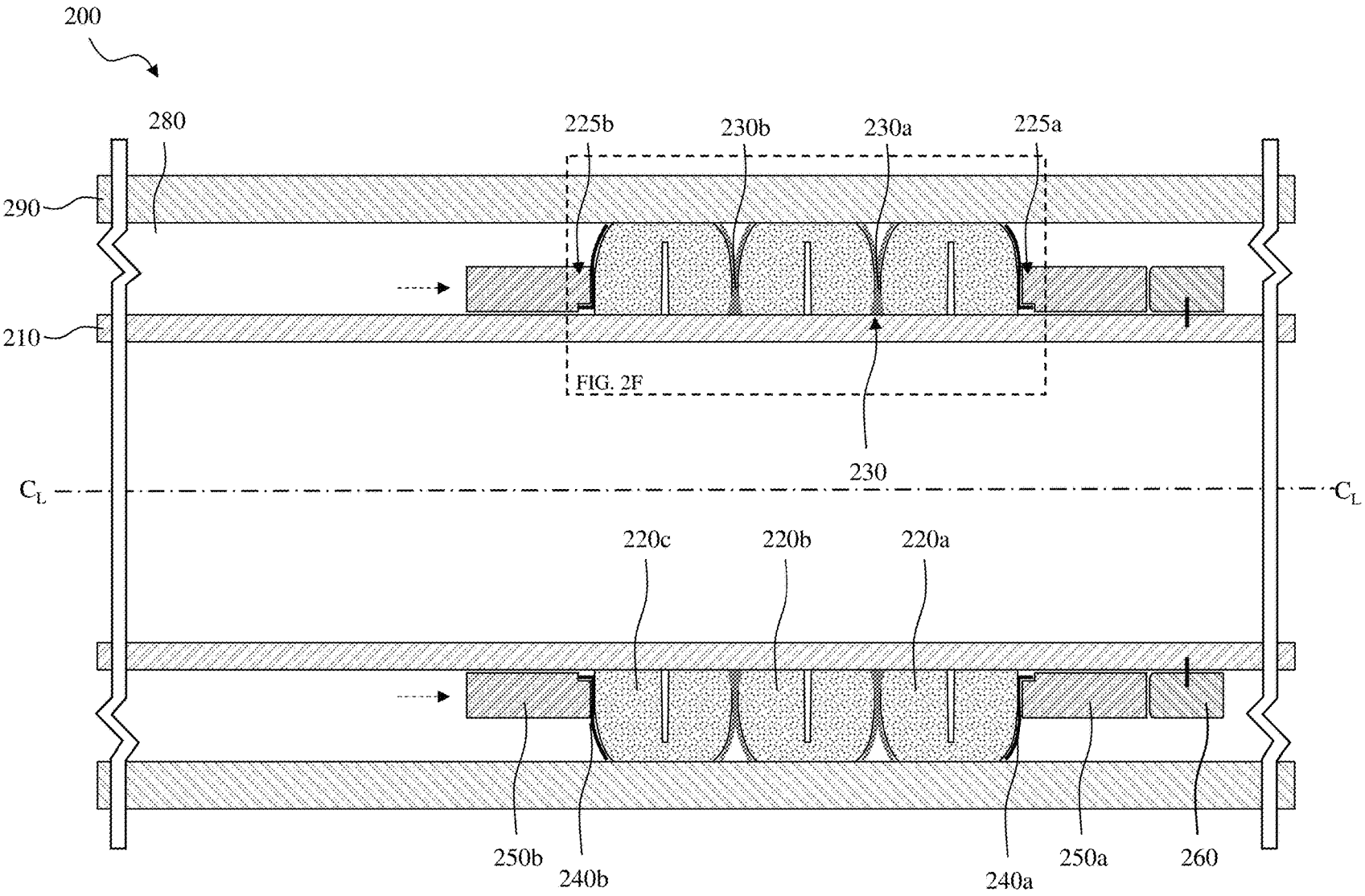
Figure 2F:
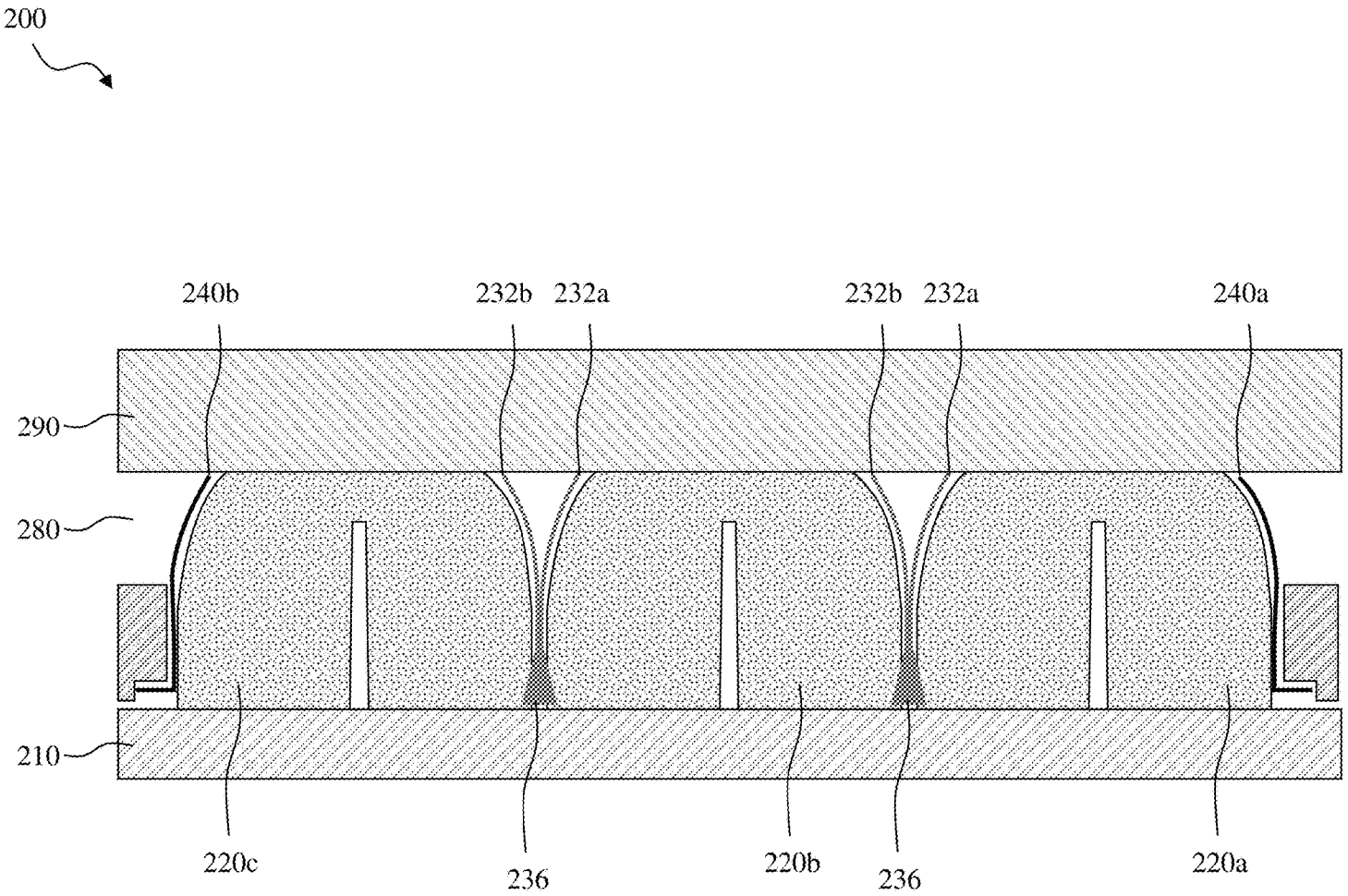

FIGS. 2E and 2F illustrate the sealing assembly 200 as the first and second collar sleeves 250*a*, 250*b* finish axially translating relative to one another. As shown in this embodiment, the final axial translation causes the first and third sealing element portions 220*a*, 220*c* (e.g., the outer most sealing element portions) to compress and radially expand. In one or more embodiments, the first and third sealing element portions 220*a*, 220*c* buckle to radially expand. In at least this one embodiment, the axial exterior flanges of the first deployable spacer 230*a* and the second deployable spacer 230*b* gradually deploy to control a deployment of the first and third sealing element portions 220*a*, 220*c*. For example, the axial exterior flanges of the first deployable spacer 230*a* and the second deployable spacer 230*b* substantially prevent the first and third sealing element portions 220*a*, 220*c* from tipping over, and thus considerably enhance the post deployment (e.g., post buckling) stiffness of the first and third sealing element portions 220*a*, 220*c*. In at least one embodiment, the flanges of the first and second deployable spacers 230*a*, 230*b* may eventually be folded in a fully deployed position (e.g., as shown with the flanges being vertically oriented), which allows the sealing assembly 200 to fully set.

The first and second backup shoes 240*a*, 240*b*, in the illustrated embodiment, also gradually deploy to control a deployment of the first and third sealing element portions 220*a*, 220*c*. For example, the first and second backup shoes 240*a*, 240*b* also help in preventing the first and third sealing element portions 220*a*, 220*c* from tipping over, and thus considerably enhances the post deployment (e.g., post buckling) stiffness of the first and third sealing element portions 220*a*, 220*c*.

Thus, in accordance with this one embodiment, the first deployable spacer 230*a* and the second deployable spacer 230*b* gradually deploy to orderly (e.g., as opposed to random) control the sealing element deployment, which considerably enhances the post-buckling stiffness of the sealing elements, and effectively transfers the load to backup shoes with minimum risk of rubber extrusion. Accordingly, the performance of the backup shoes 240*a*, 240*b* is greatly improved, and if there is a proper balance between strength and flexibility of the backup shoes 240*a*, 240*b*, the successful deployment of the backup shoes 240*a*, 240*b* is ensured as well.

Figure 2G:
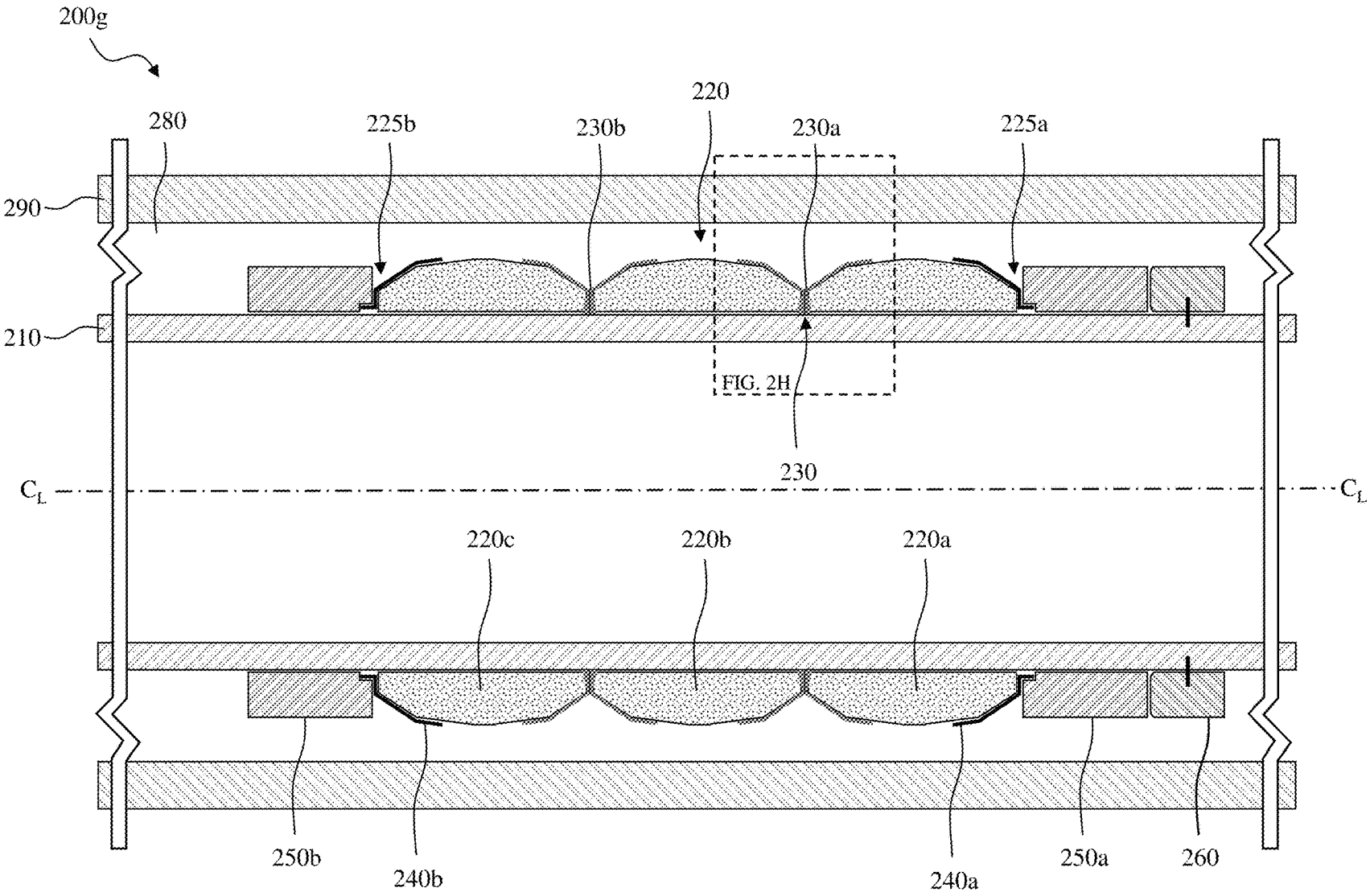
FIGS. 2G through 2H illustrate different cross-sectional views of various deployment states of a sealing assembly designed, manufactured and/or operated according to one or more embodiments of the disclosure.
Figure 2H:
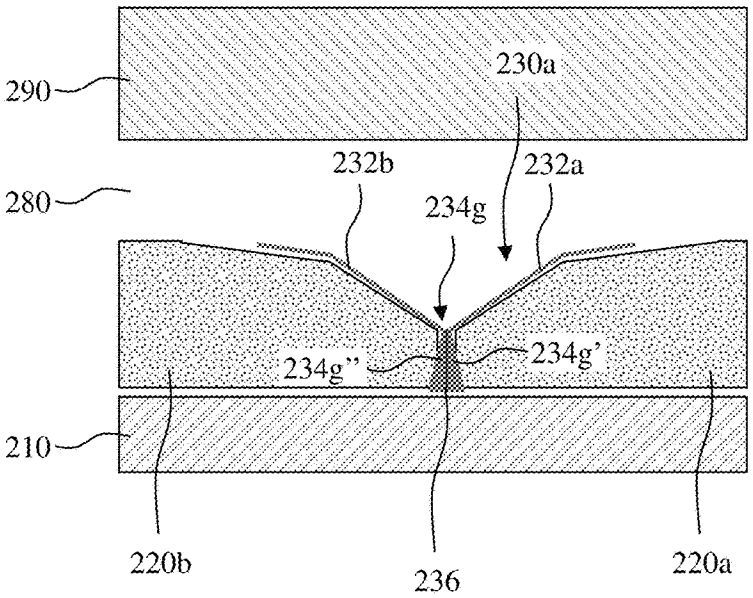

Turning now to FIGS. 2G through 2H, illustrated are different cross-sectional views of various deployment states of a sealing assembly 200*g* designed, manufactured and/or operated according to one or more alternative embodiments of the disclosure. The sealing assembly 200*g* of FIGS. 2G through 2H is similar in many respects to the sealing assembly 200 of FIGS. 2A through 2B. Accordingly, like reference numbers have been used to indicate similar, if not identical, features. The sealing assembly 200*g* differs, for the most part, from the sealing assembly 200 in that the sealing assembly 200*g* employs a base member 234*g* that includes a first base member portion 234*g*' coupled to one of the flanges 232 (e.g., the first flange 232*a*) and a separate second base member portion 234*g*" coupled to the other of the flanges 232 (e.g., the second flange 232*b*).

Turning now to FIGS. 3A through 3F, illustrated are different cross-sectional views of various deployment states of a sealing assembly 300 designed, manufactured and/or operated according to one or more alternative embodiments of the disclosure. The sealing assembly 300 of FIGS. 3A through 3F is similar in many respects to the sealing assembly 200 of FIGS. 2A through 2F. Accordingly, like reference numbers have been used to indicate similar, if not identical, features. The sealing assembly 300 differs, for the most part, from the sealing assembly 200 in that the sealing assembly 300 employs one or more two-part backup shoes 340. For example, in one or more embodiments, a first two-part backup shoe 340*a* is located proximate the first end 225*a* of the sealing element 220 and a second two-part backup shoe 340*b* is located proximate the second end 225*b* of the sealing element 220.

In at least one embodiment, each of the first two-part backup shoe 340*a* and the second two-part backup shoe 340*b* includes a first backup shoe portion 342 and a separate second backup shoe portion 344. In at least one embodiment, the first backup shoe portion 342 is located proximate the collar sleeve 250*a*, 250*b*, and the second backup shoe portion 344 is located between the first backup shoe portion 342 and the sealing element 220. In at least one other embodiment, the first backup shoe portion 342 includes a substantially vertical section 342*a* and a slanted section 342*b*. In one or more embodiments, the slanted section 342*b* is located proximate the mandrel 210, whereas the substantially vertical section 342*a* is located distal the mandrel 210. Furthermore, in one embodiment of the disclosure, the slanted section 342*b* slants toward the sealing element 220.

In at least one embodiment, the first backup shoe portion 342 and the separate second backup shoe portion 344 (e.g., that may include a substantially vertical section 344*b* (within 15 degrees of vertical)), are configured to move independent of each other. Further to this embodiment, the first backup shoe portion 342 and the separate second backup shoe portion 344 may comprise a similar material. In at least one other embodiment, the first backup shoe portion 342, the separate second backup shoe portion 344 and the deployable spacers 230*a*, 230*b* comprise a similar material. For example, in at least one embodiment, the first backup shoe portion 342, the second backup shoe portion 344 and the deployable spacers 230*a*, 230*b* each have a yield strength of 40 ksi or less.

Figure 3A:
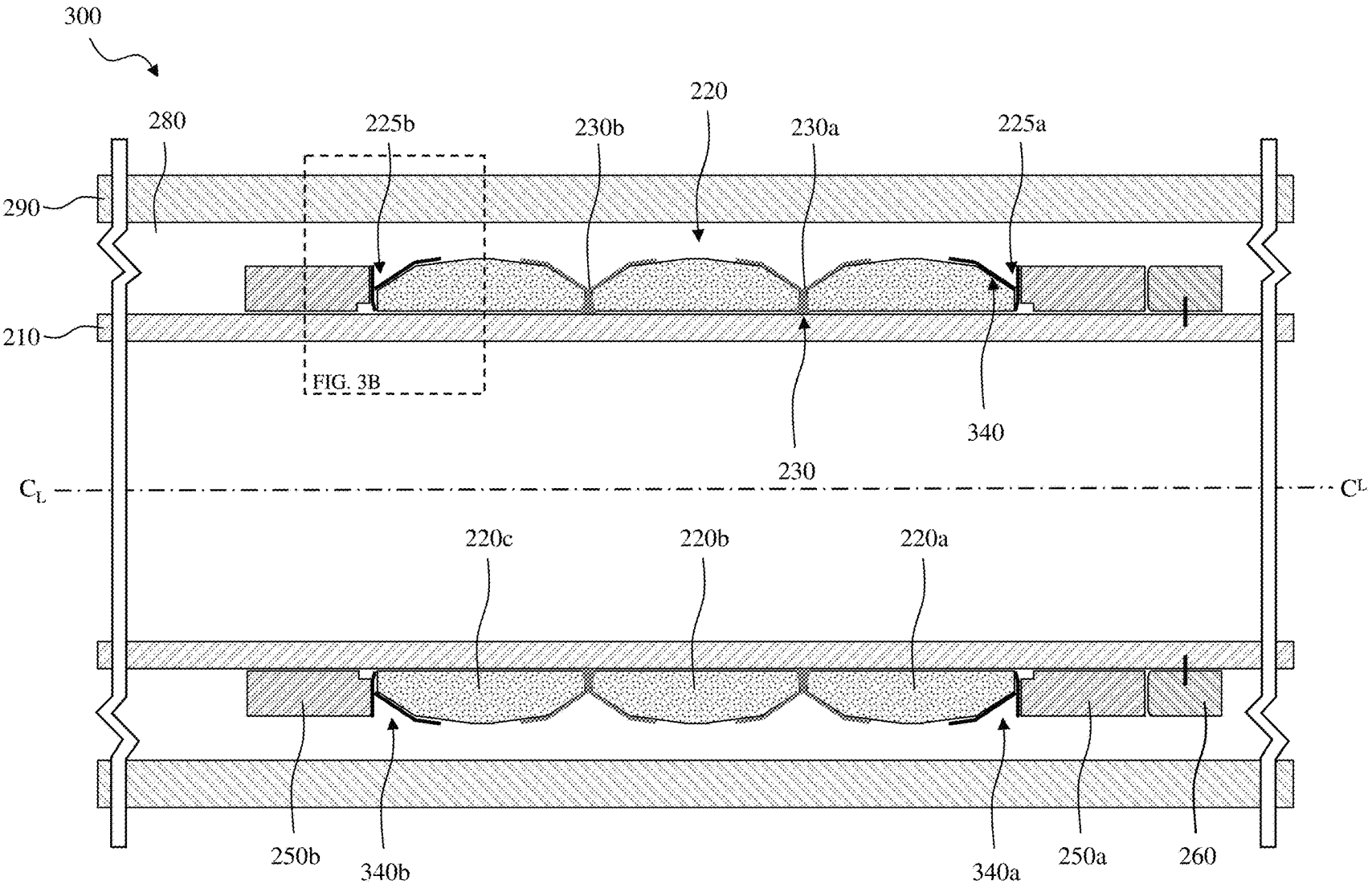
FIGS. 3A through 3F illustrate different cross-sectional views of various deployment states of a sealing assembly designed, manufactured and/or operated according to one or more alternative embodiments of the disclosure.
Figure 3B:
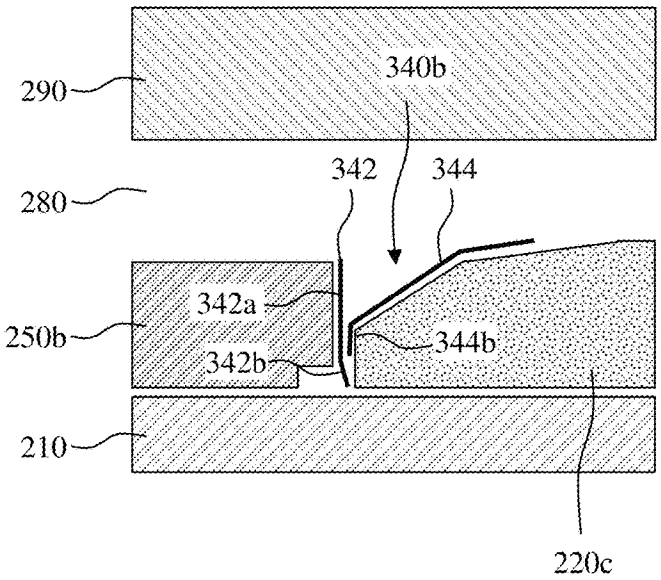

FIGS. 3A and 3B illustrates the sealing assembly 300 in a run-in-hole state, and thus its scaling element 220 is in a radially retracted state. For example, each of the first, second and thirds sealing element portions 220*a*, 220*b*, 220*c* are in their radially retracted state. Furthermore, each of the deployable spacers 230*a*, 230*b*, and their associated flanges 232*a*, 232*b*, are in the undeployed state. Similarly, the first and second two-part backup shoes 340*a*, 340*b* are in the undeployed state.

Figure 3C:
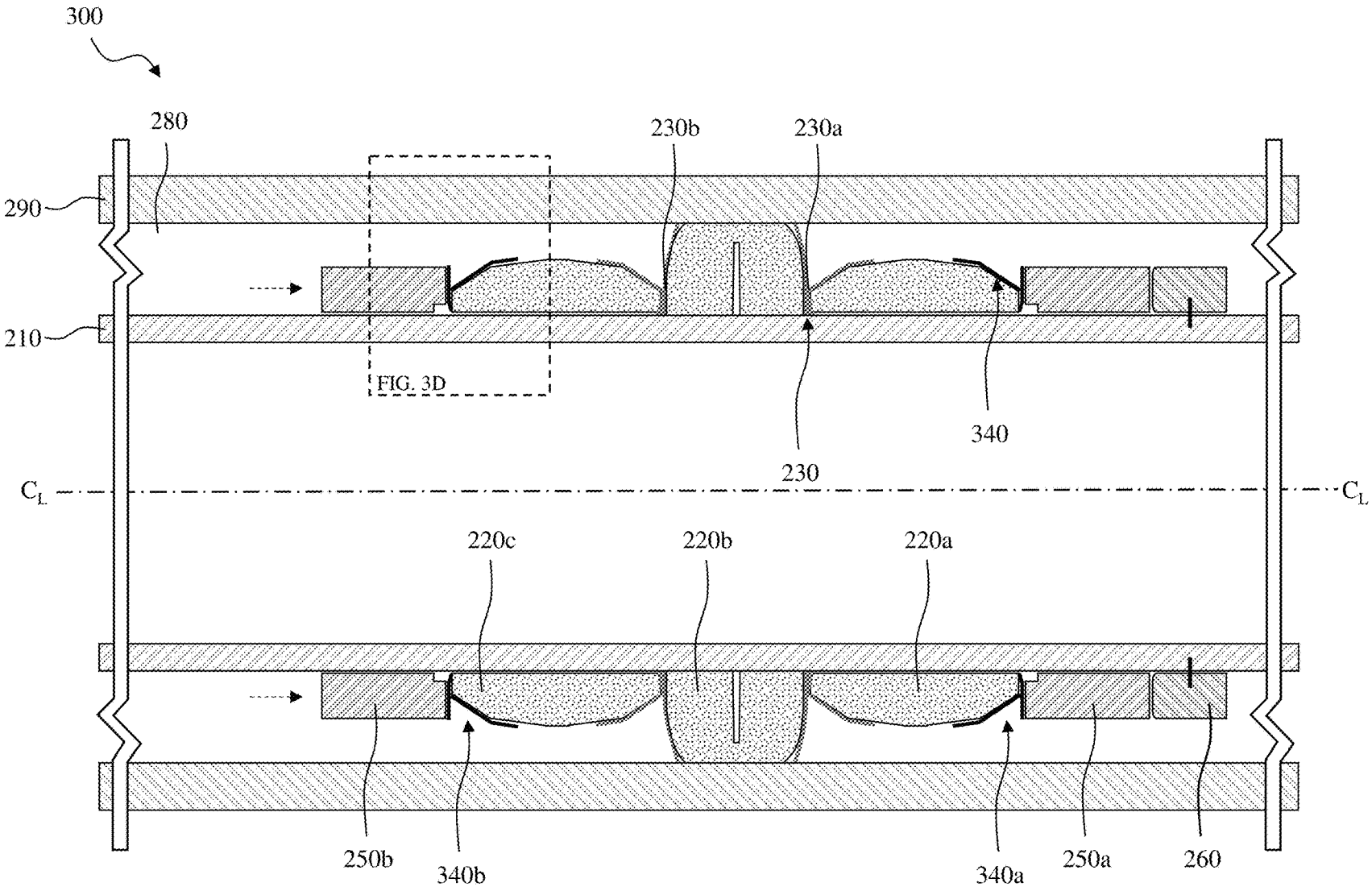
Figure 3D:
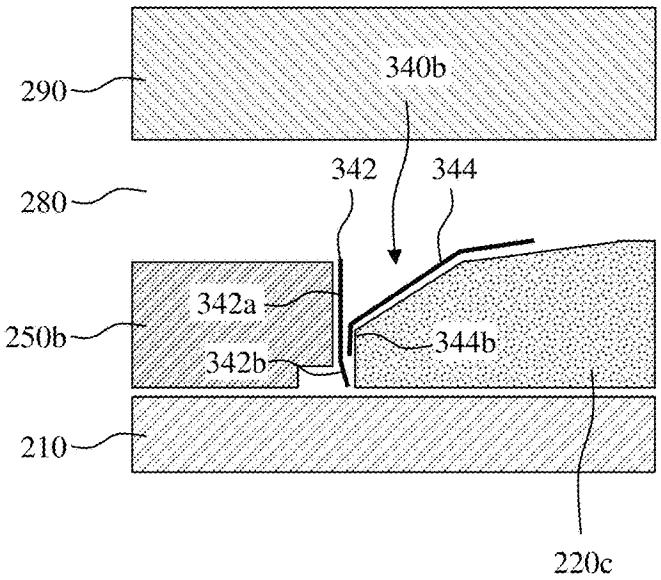

FIGS. 3C and 3D illustrate the sealing assembly 300 as the first and second collar sleeves 250*a*, 250*b* start to axially translate relative to one another. The first and second two-part backup shoes 340*a*, 340*b* are still in the undeployed state.

Figure 3E:
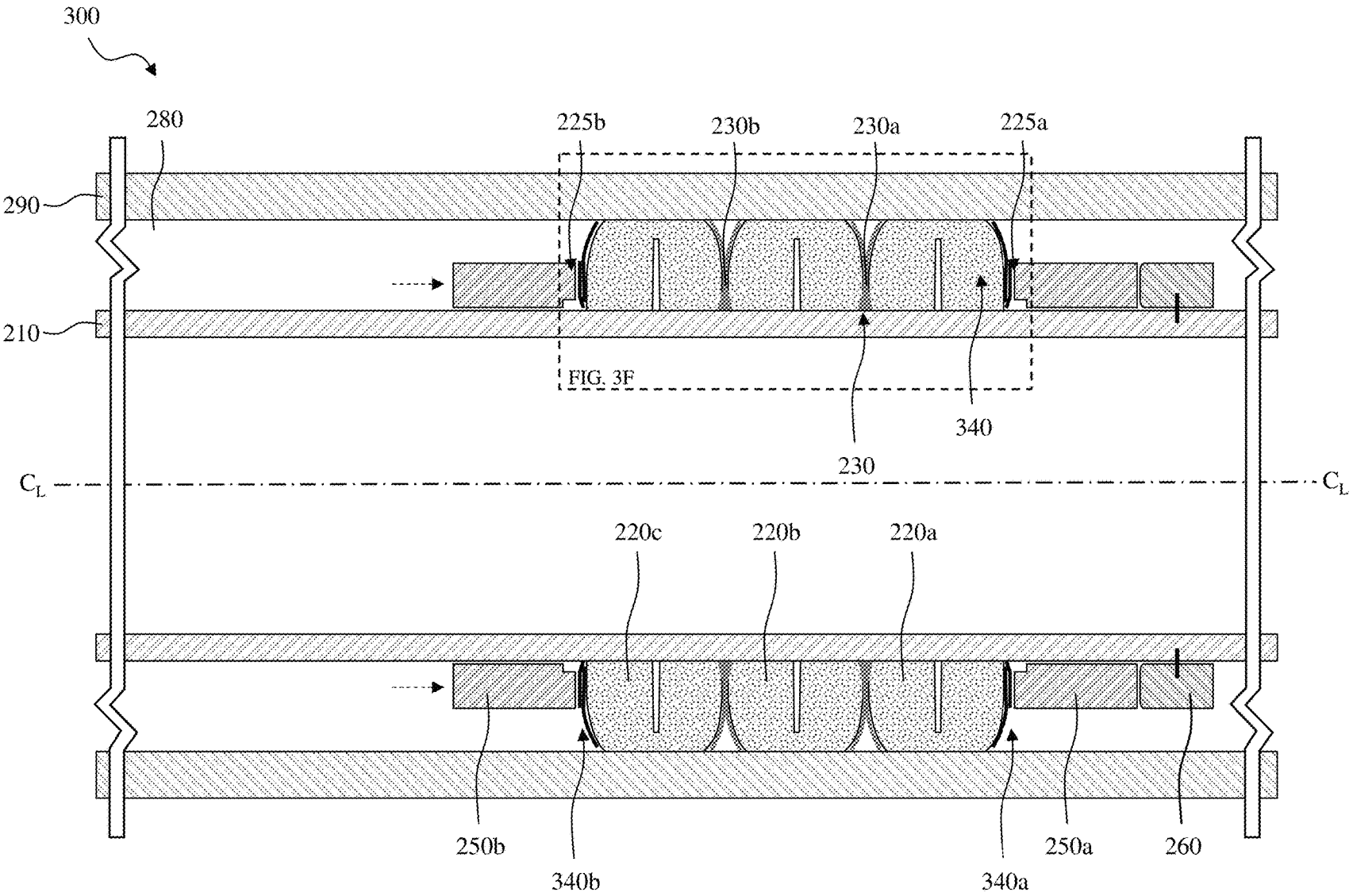
Figure 3F:
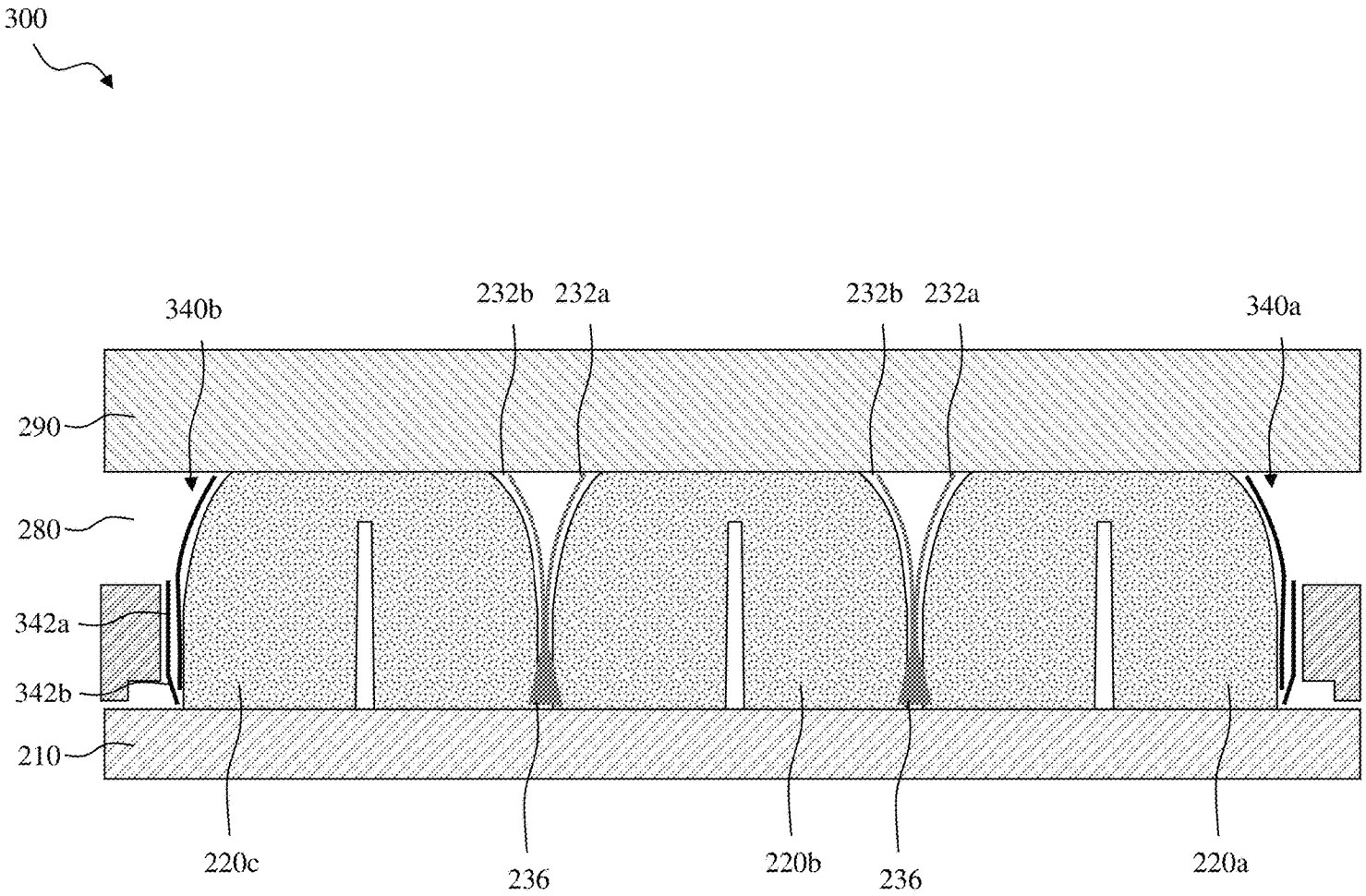

FIGS. 3E and 3F illustrate the sealing assembly as the first and second collar sleeves 250*a*. 250*b* finish axially translating relative to one another. As shown in this embodiment, the final axial translation causes the first and third sealing element portions 220*a*, 220*c* (e.g., the outer most scaling element portions) to compress and radially expand. In at least this one embodiment, the axial exterior flanges of the first deployable spacer 230*a* and the second deployable spacer 230*b* gradually deploy to control a deployment of the first and third sealing element portions 220*a*, 220*b*. For example, the axial exterior flanges of the first deployable spacer 230*a* and the second deployable spacer 230*b* substantially prevent the first and third sealing element portions 220*a*, 220*c* from tipping over, and thus considerably enhances the post deployment (e.g., post buckling) stiffness of the first and third scaling element portions 220*a*, 220*c*. In at least one embodiment, the flanges of the first and second deployable spacers 230*a*, 230*b* may eventually be folded in a fully deployed position (e.g., as shown with the flanges being vertically oriented) that allows the scaling assembly 200 to fully set. The first and second two-part backup shoes 340*a*, 340*b* also gradually deploy to control a deployment of the first and third sealing element portions 220*a*, 220*b*. Accordingly, the second backup shoe portions 344 deploy radially outward in relation to the first backup shoe portions 342. For example, the second backup shoe portions 344 may control a radial outer edge of the first and third sealing element portions 220*a*, 220*c*, whereas the first backup shoe portions 342 may control the radial inner edge of the first and third sealing element portions 220*a*, 220*c*.

Turning now to FIGS. 4A through 4F, illustrated are different cross-sectional views of various deployment states of a sealing assembly 400 designed, manufactured and/or operated according to one or more alternative embodiments of the disclosure. The sealing assembly 400 of FIGS. 4A through 4F is similar in many respects to the scaling assembly 200 of FIGS. 2A through 2F. Accordingly, like reference numbers have been used to indicate similar, if not identical, features. The sealing assembly 400 differs, for the most part, from the sealing assembly 200 in that the scaling assembly 400 does not employ a deployable spacer 230, but instead employs a deployable control band 430 positioned radially outside a radial inner surface of its sealing element 420. In the illustrated embodiment, the deployable control band is positioned radially outside of a radial outer surface of the sealing element 420. The deployable control band 430, in one or more embodiments, is configured to deploy from an undeployed state to a deployed state as the scaling element 420 moves from the radially retracted state to the radially expanded state. The embodiment of FIGS. 4A through 4F illustrates that the sealing element 420 includes only a single scaling element portion. Nevertheless, other embodiments may exist wherein the sealing element 420 includes multiple sealing element portions, such as discussed above.

In the illustrated embodiment, the sealing assembly 400 includes first and second deployable control bands 430*a*, 430*b*. The first and second deployable control bands 430*a*, 430*b* are both positioned about the radial outer surface of the sealing element 420, but are also spaced apart from one another. In at least one embodiment, the first and second deployable control bands 430*a*, 430*b* are substantially equally spaced apart between the first end 225*a* and the second end 225*b* of the sealing element 420. The term "substantially equally spaced," as used herein, is intended to mean that the first and second deployable control bands 430*a*, 430*b* are within 20 percent of being exactly equally spaced. Accordingly, in the illustrated embodiment the first and second deployable control bands 430*a*, 430*b* would separate the sealing element 420 into three spaced apart sections 420*a*, 420*b*, 420*c* (e.g., three substantially equal (e.g., within 20 percent of exactly equal) spaced apart sections). While two deployable control bands 430*a*, 430*b* are employed in the illustrated embodiment, more than two deployable control bands may be used and remain within the purview of the disclosure.

In at least one embodiment, the first and second deployable control bands 430*a*, 430*b* include a control band stiffness that is greater than a stiffness of the sealing element 420. The term "stiffness," as used herein, relates to the amount of force required to cause a given amount of deformation of a component under consideration. The greater amount of force needed to cause the given amount of deformation, the stiffer the component is. In at least one embodiment, the stiffness and strength of the deployable control bands are designed such that they break up once the sealing elements have been deployed in an acceptable controlled manner. In at least one other embodiment, the deployable control bands will not buckle, as they are not in compression, but in contrast are in tension and will eventually breakup as designed.

The stiffness of each of the first and second deployable control bands 430*a*, 430*b* is designed with the goal that each spaced apart section 420*a*, 420*b*, 420*c* between the first and second deployable control bands 430*a*, 430*b* and the first and second backup shoes 240*a*, 240*b* will buckle at about the same time, allowing good load transfer of load from one side to another. This will also allow portions of the buckled sections to support each other, avoiding tipping to one side or another. Accordingly, in at least one embodiment, the first and second deployable control bands 430*a*, 430*b* (e.g., pairs of related control bands) would have a similar stiffness. In at least one embodiment, the sealing assembly 400 including the deployable control bands 430*a*, 430*b* would potentially have better swab-off resistance than conventional sealing assemblies without the deployable control bands 430*a*, 430*b*, thus allowing the sealing assembly 400 to be run-in-hole at a faster rate.

Figure 4A:
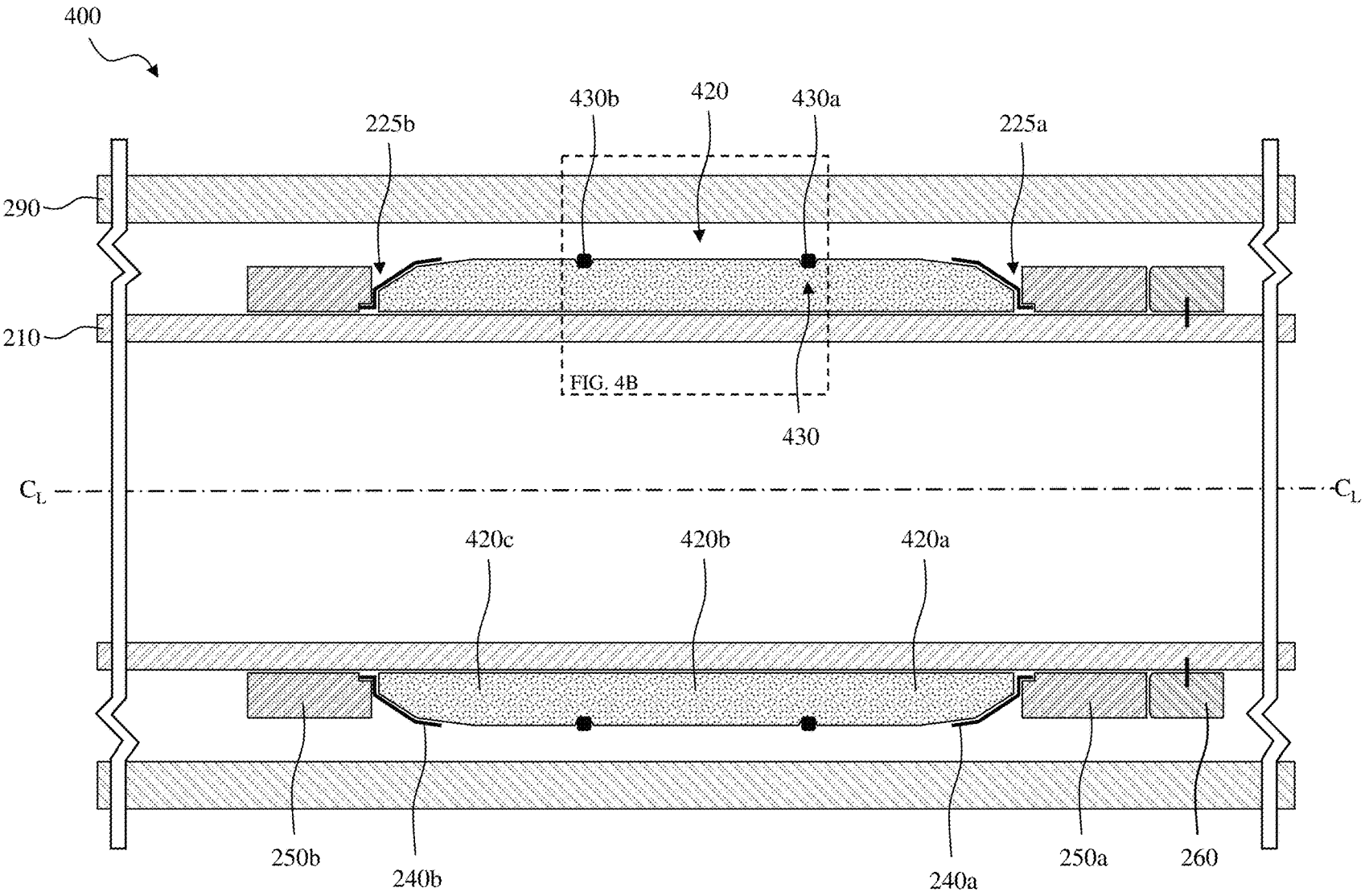
FIGS. 4A through 4F illustrate different cross-sectional views of various deployment states of a sealing assembly designed, manufactured and/or operated according to one or more alternative embodiments of the disclosure.
Figure 4B:
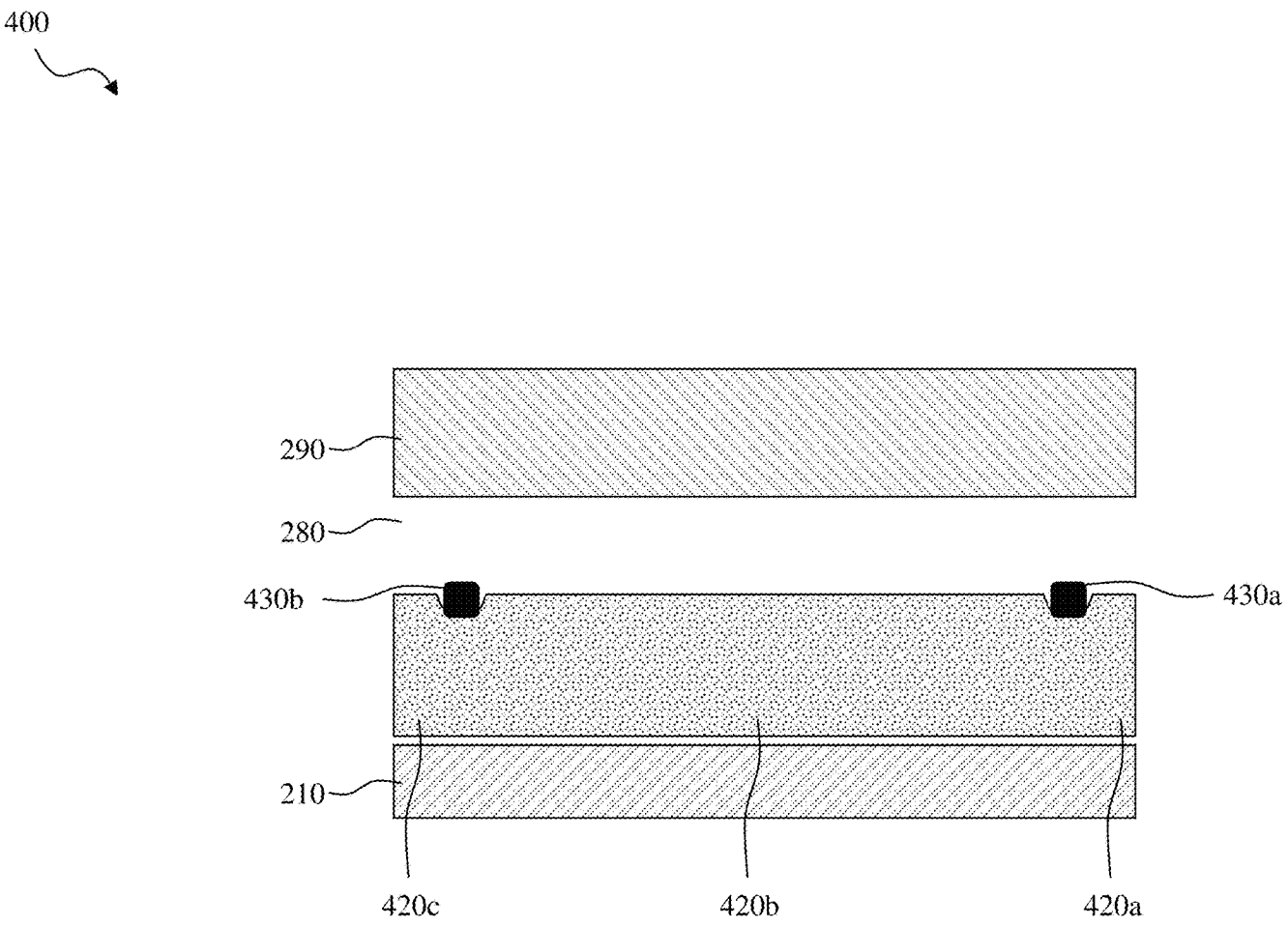

FIGS. 4A and 4B illustrate the sealing assembly 400 in a run-in-hole state, and thus its sealing element 420 is in a radially retracted state. For example, each of the spaced apart sections 420*a*, 420*b*, 420 of the sealing element 420 are in their radially retracted state. Furthermore, the first and second deployable control bands 430*a*, 430*b* are in the undeployed state. Similarly, the first and second backup shoes 240*a*, 240*b* are in their undeployed state.

Figure 4C:
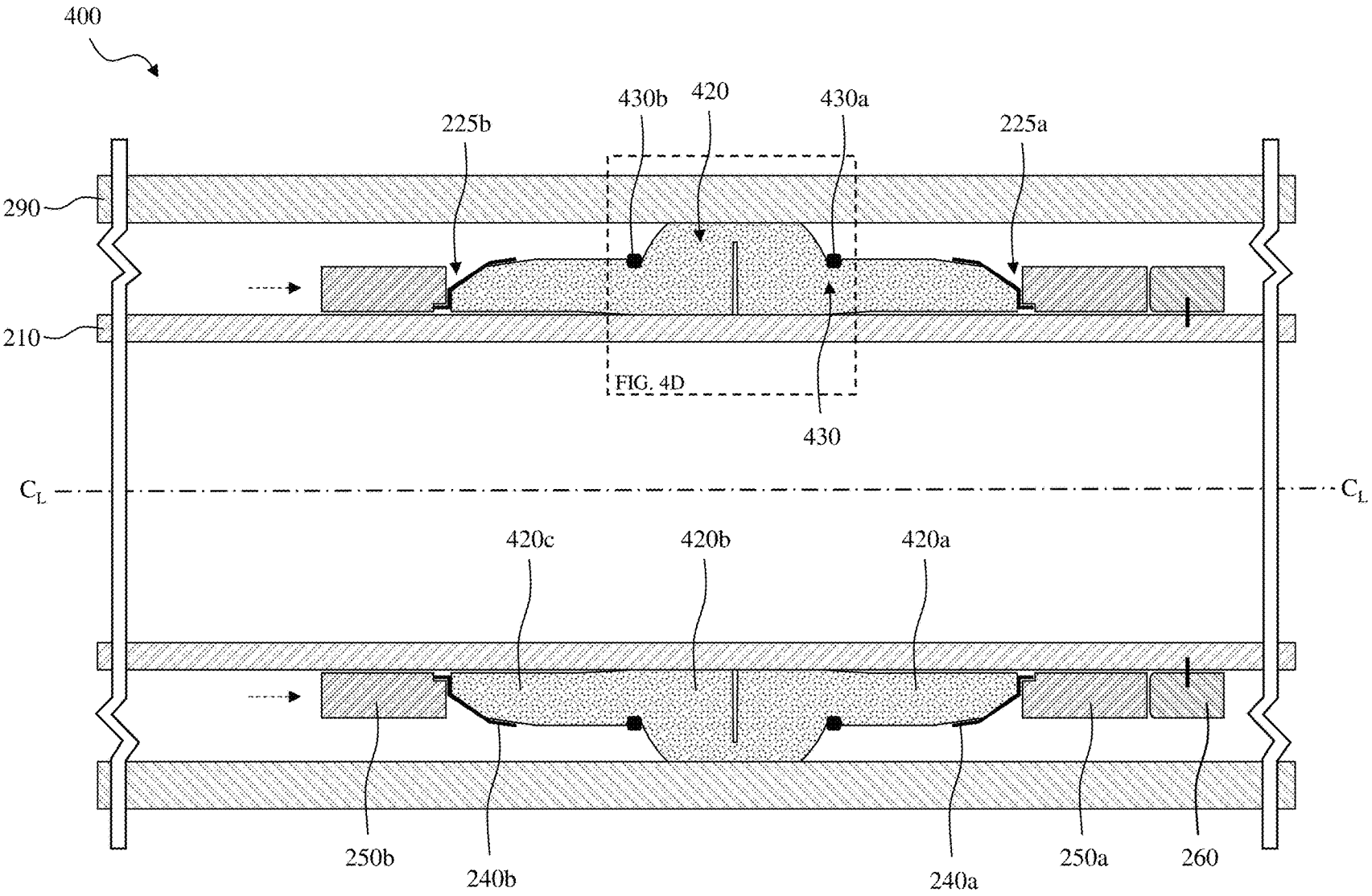
Figure 4D:
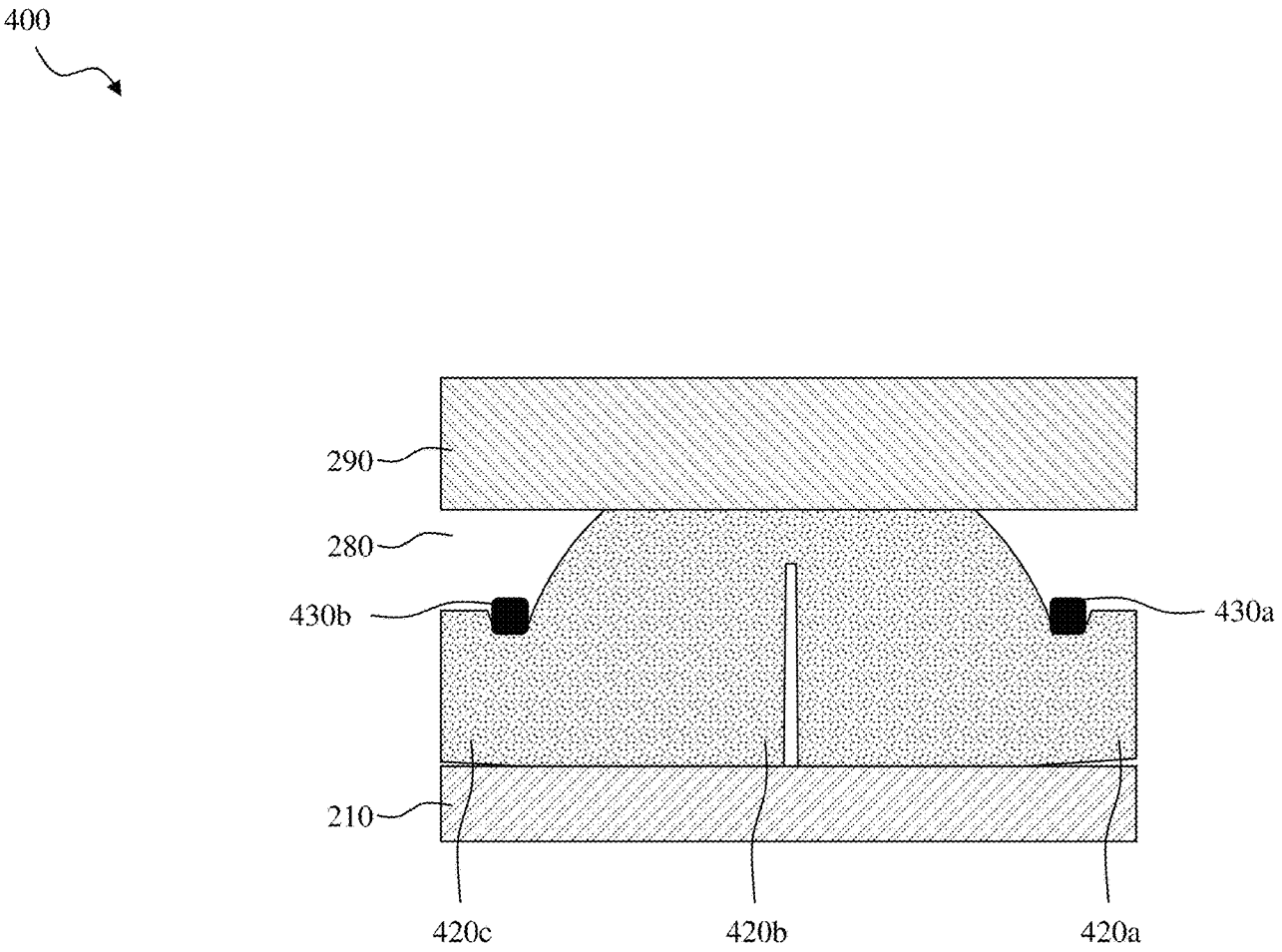

FIGS. 4C and 4D illustrate the sealing assembly 400 as the first and second collar sleeves 250*a*, 250*b* start to axially translate relative to one another. As shown in this embodiment, a combination of the axial translation of the first and second collar sleeves 250*a*, 250*b* and the first and second deployable control bands 430*a*, 430*b* causes the center spaced apart section 420*b* to compress and radially expand. In one or more embodiments, the center spaced apart section 420*b* buckles to radially expand, thus forming two buckled sections as shown.

Figure 4E:
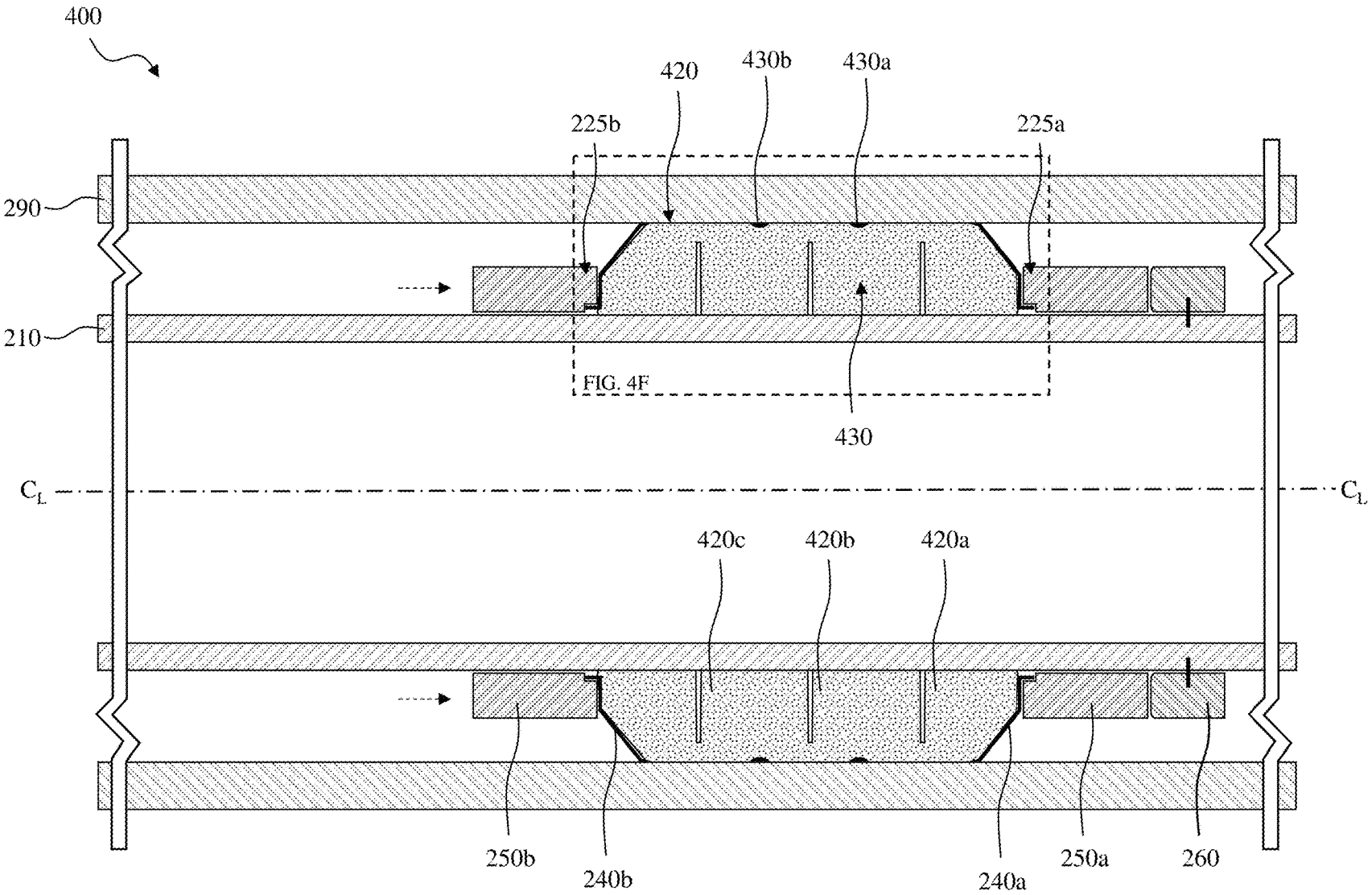
Figure 4F:
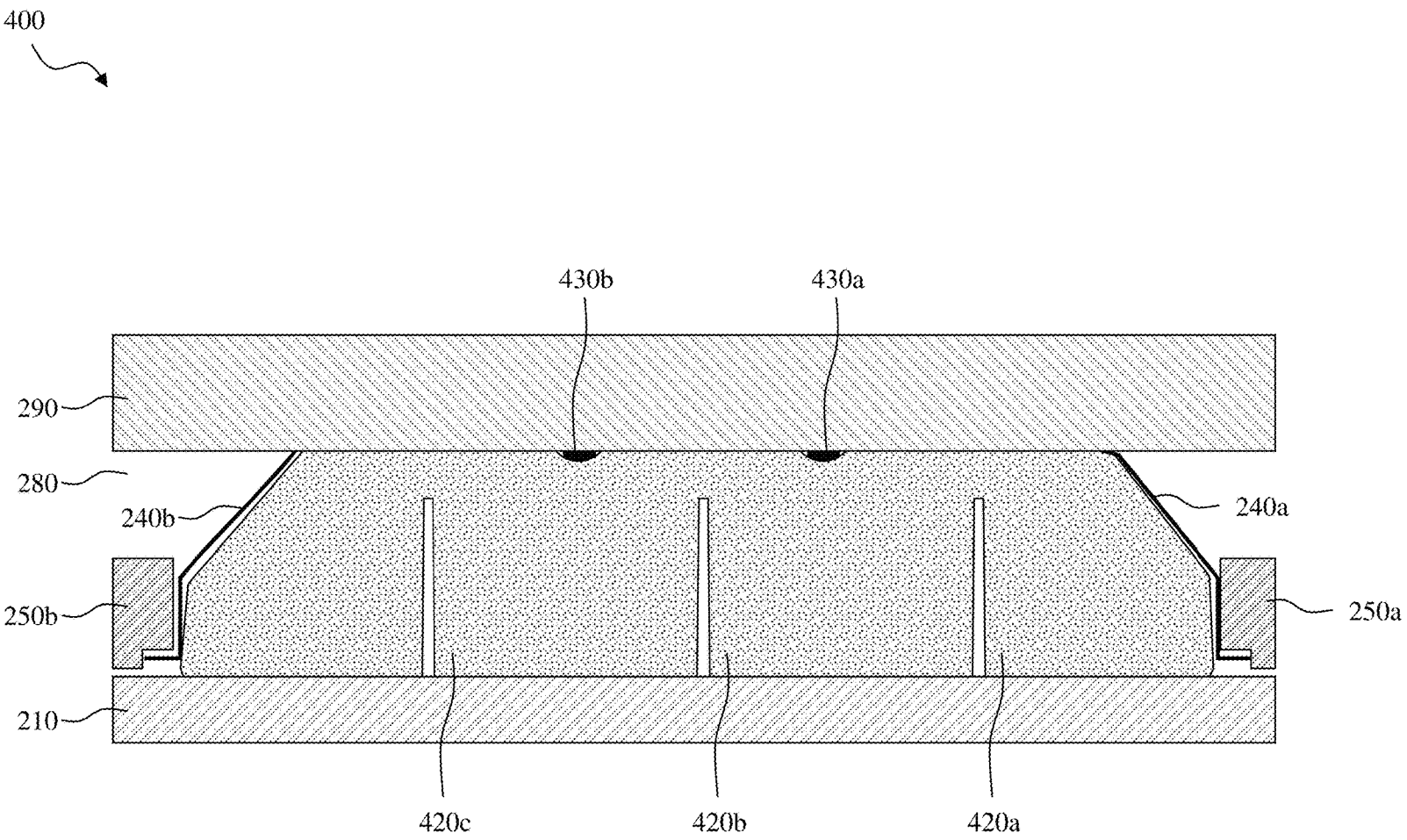
Figure 5A:
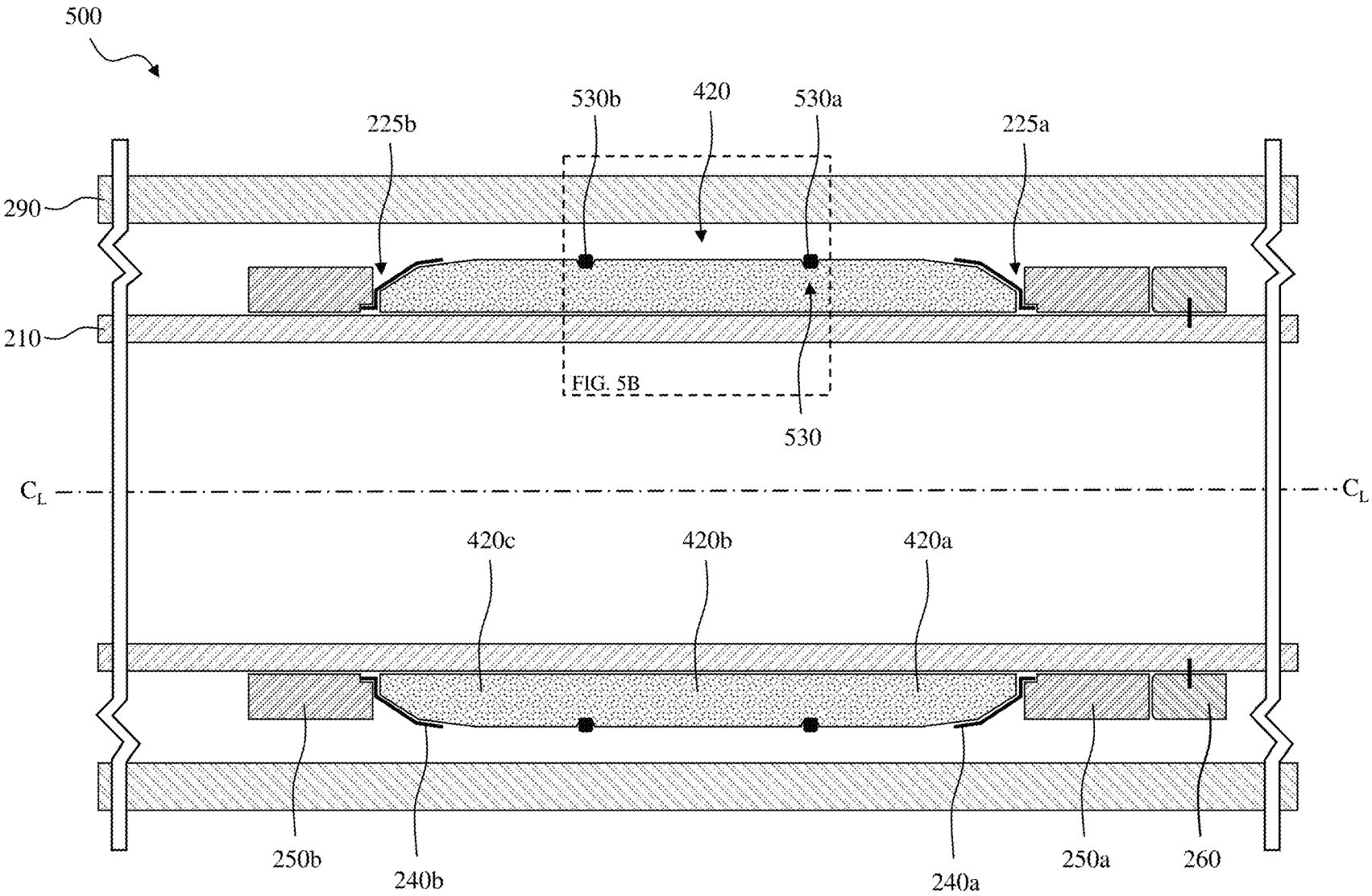
FIGS. 5A through 5F illustrate different cross-sectional views of various deployment states of a sealing assembly designed, manufactured and/or operated according to one or more alternative embodiments of the disclosure.
Figure 5B:
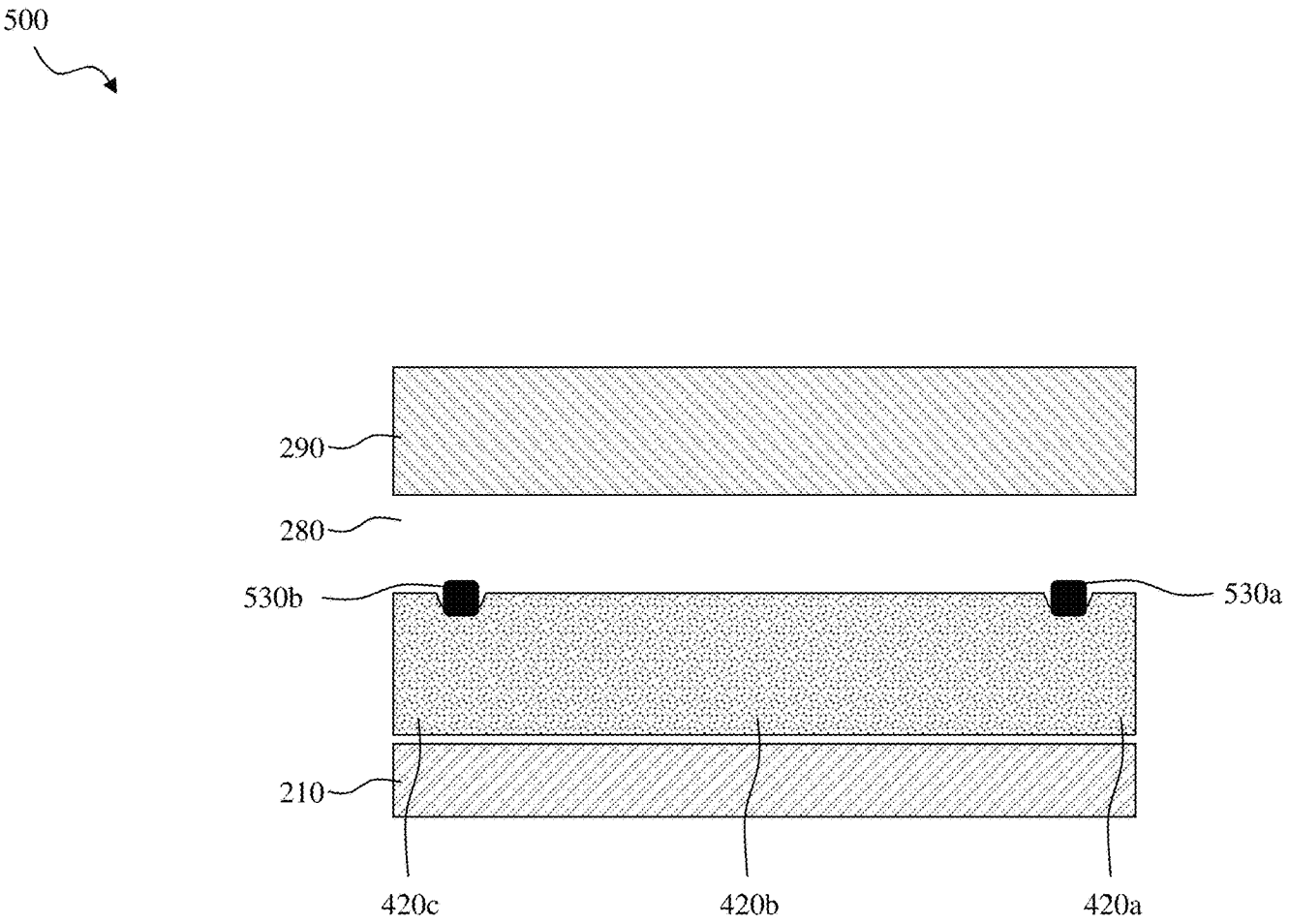
Figure 5C:
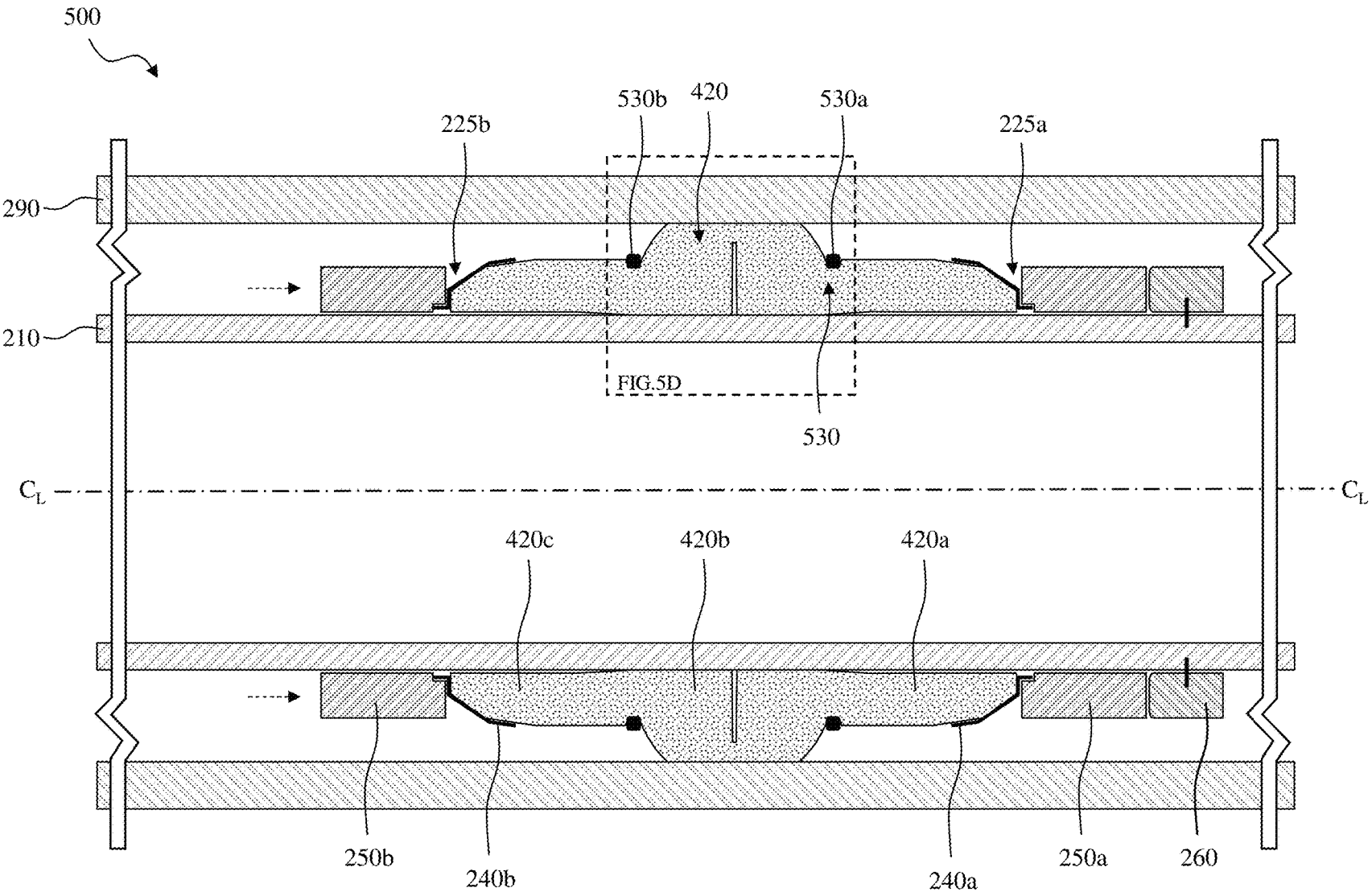
Figure 5D:
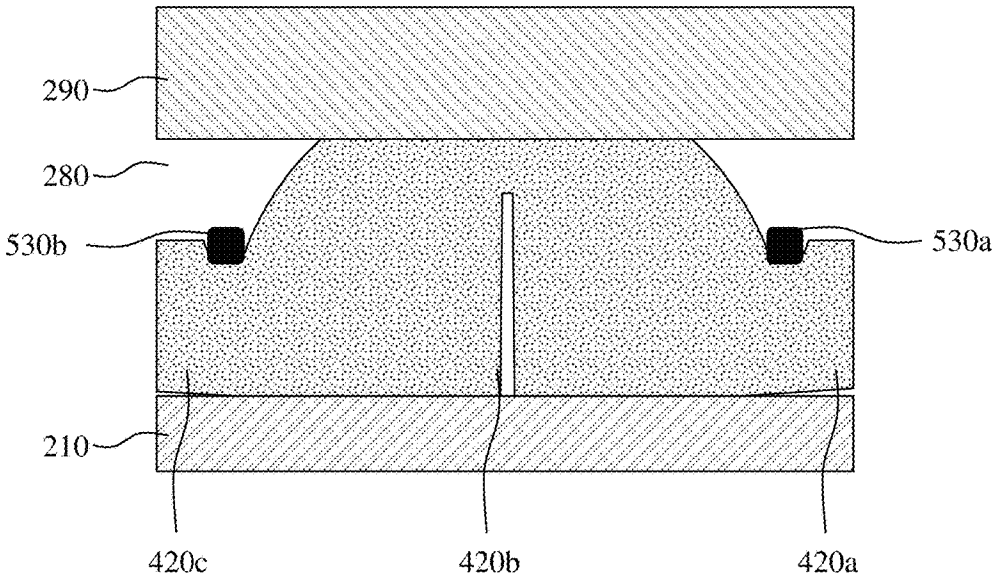
Figure 5E:
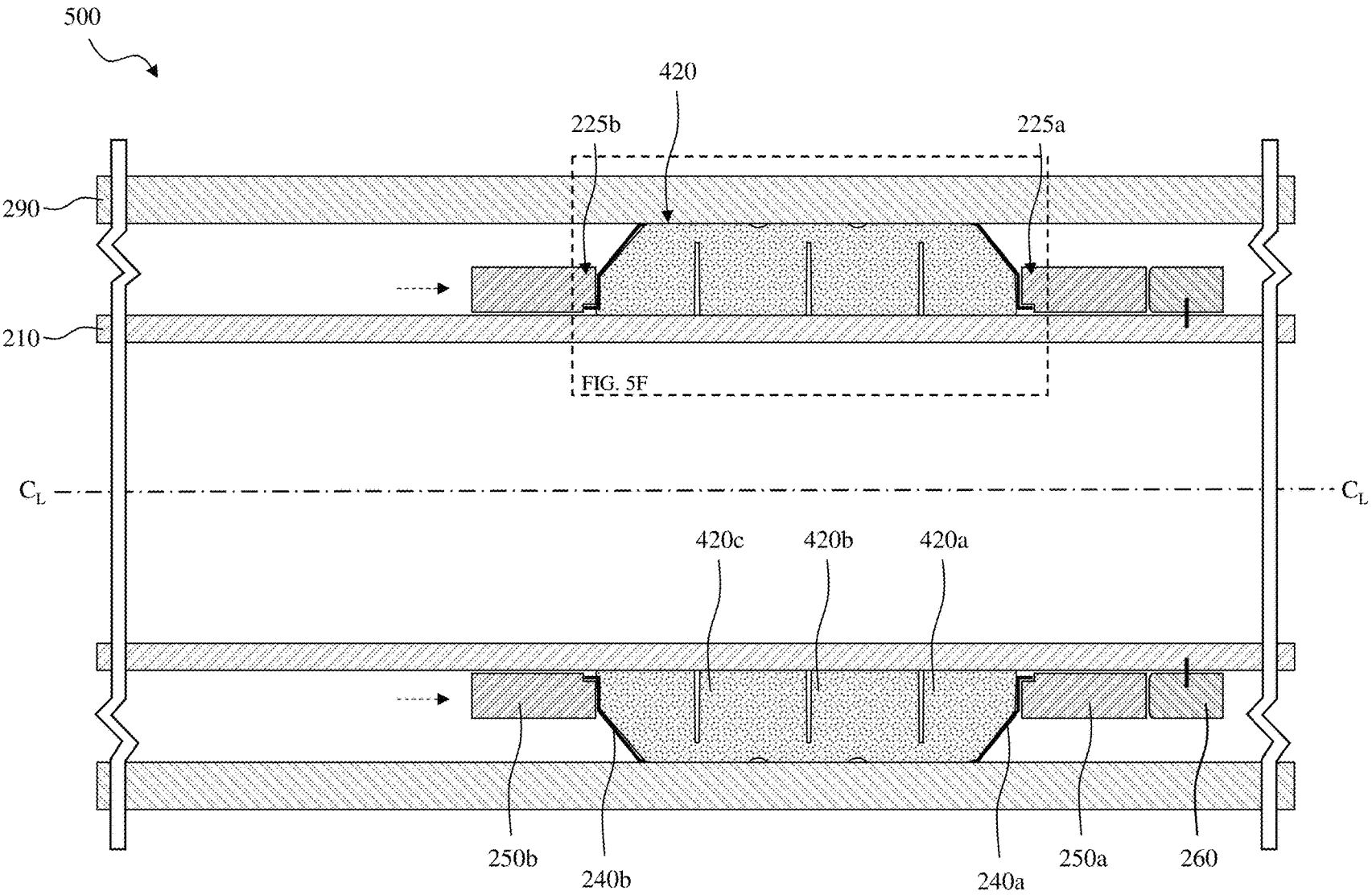
Figure 5F:
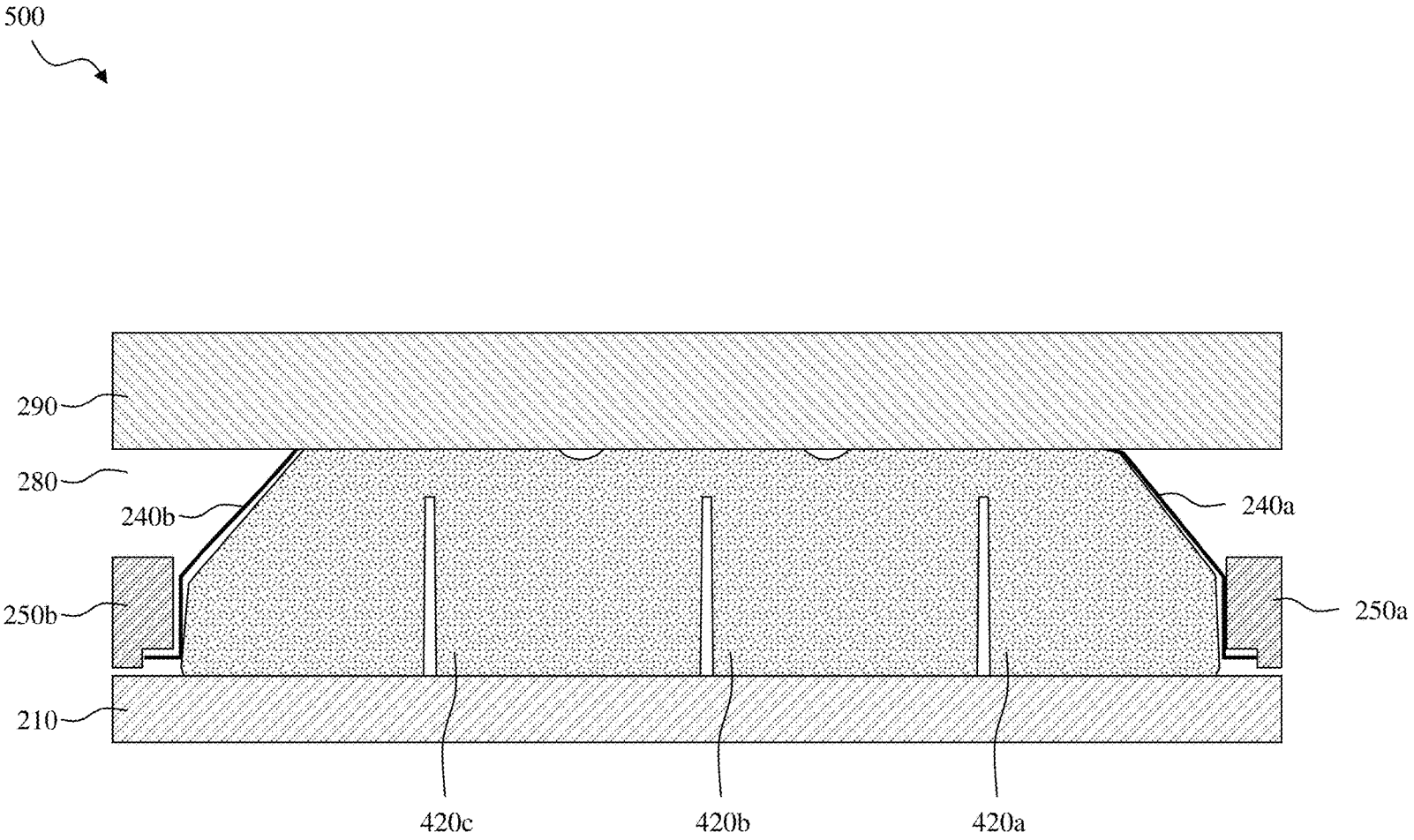
Figure 6A:
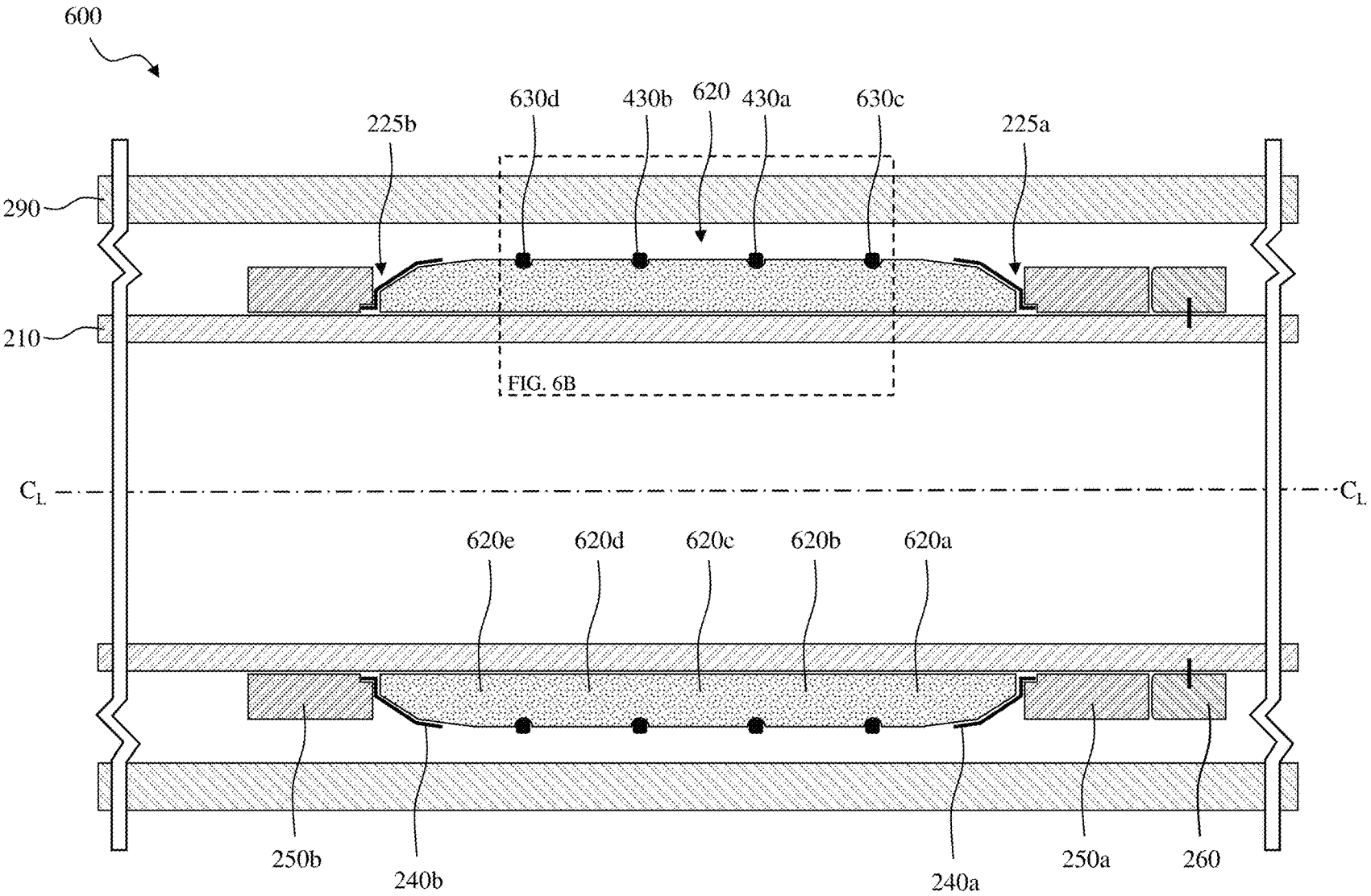
FIGS. 6A through 6H illustrate different cross-sectional views of various deployment states of a sealing assembly designed, manufactured and/or operated according to one or more alternative embodiments of the disclosure.
Figure 6B:
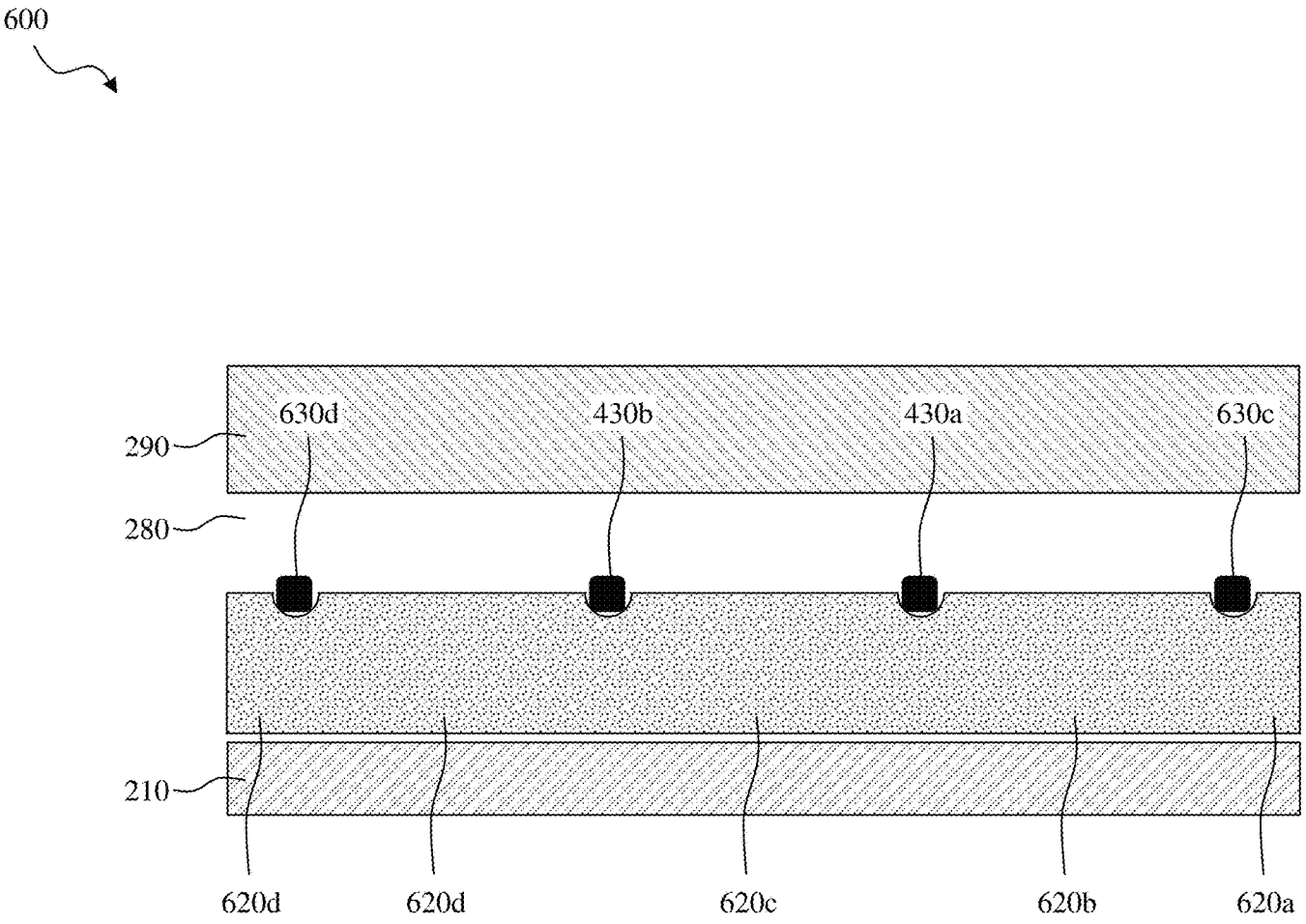
Figure 6C:
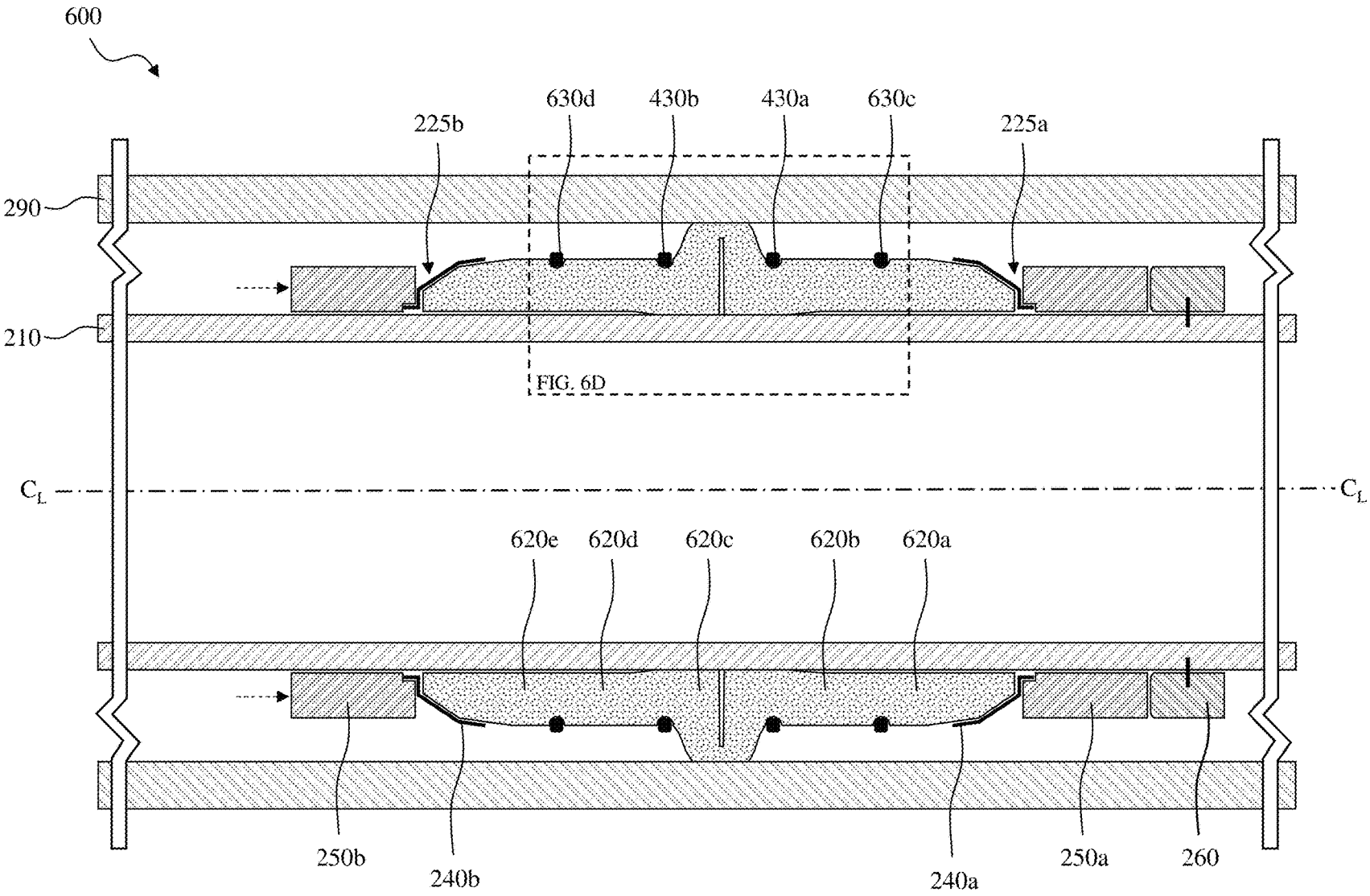
Figure 6D:
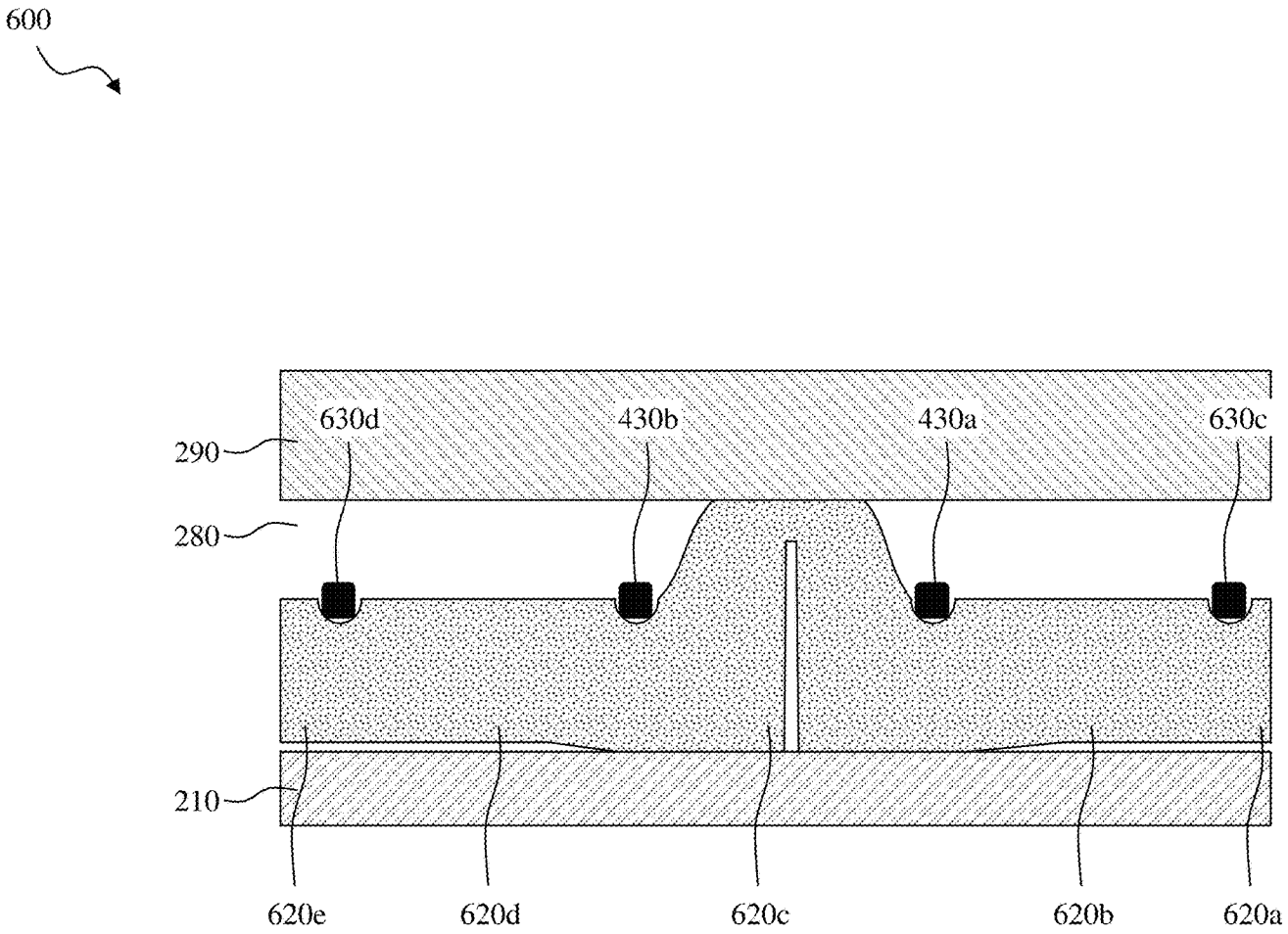
Figure 6E:
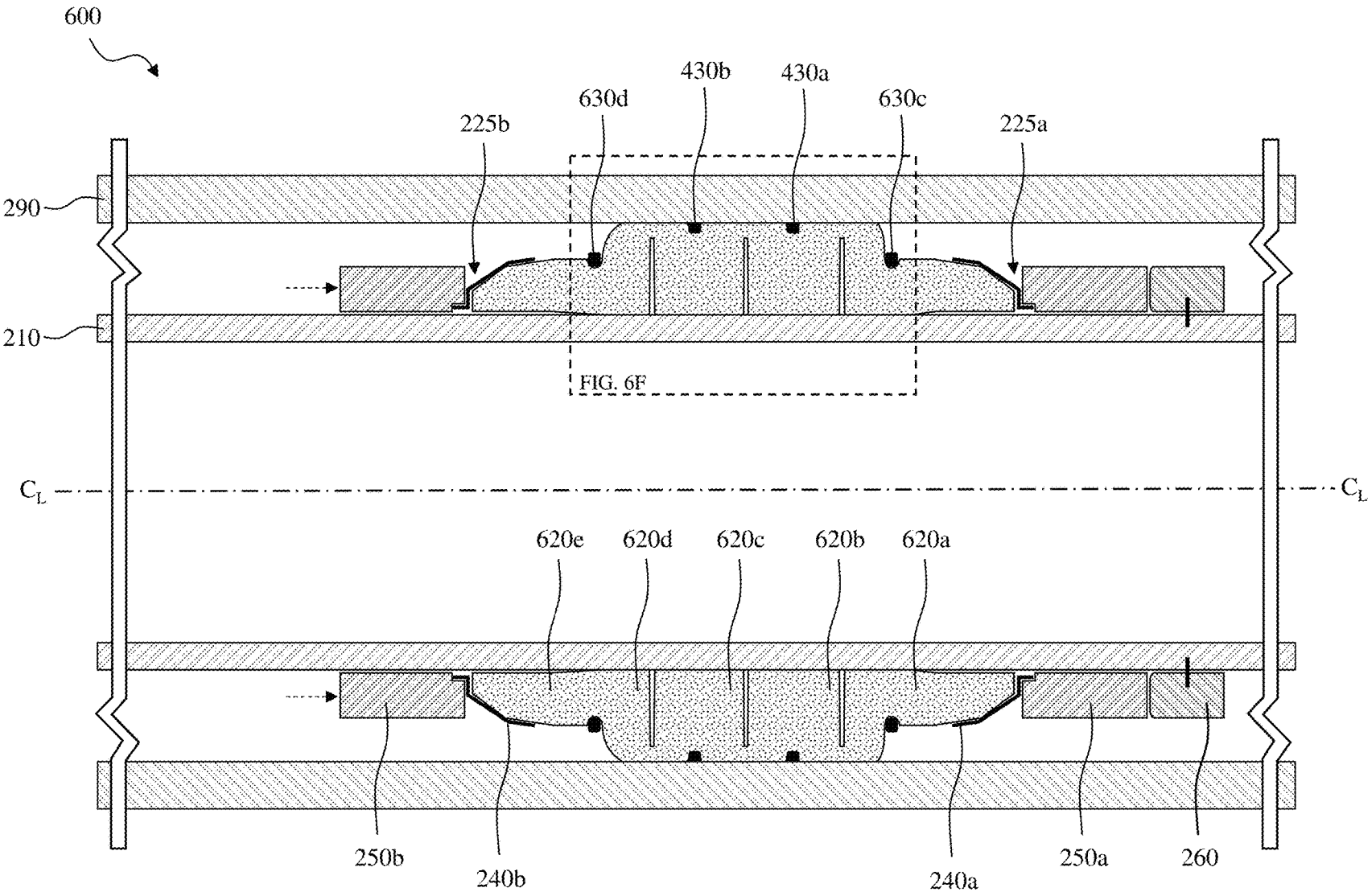
Figure 6F:
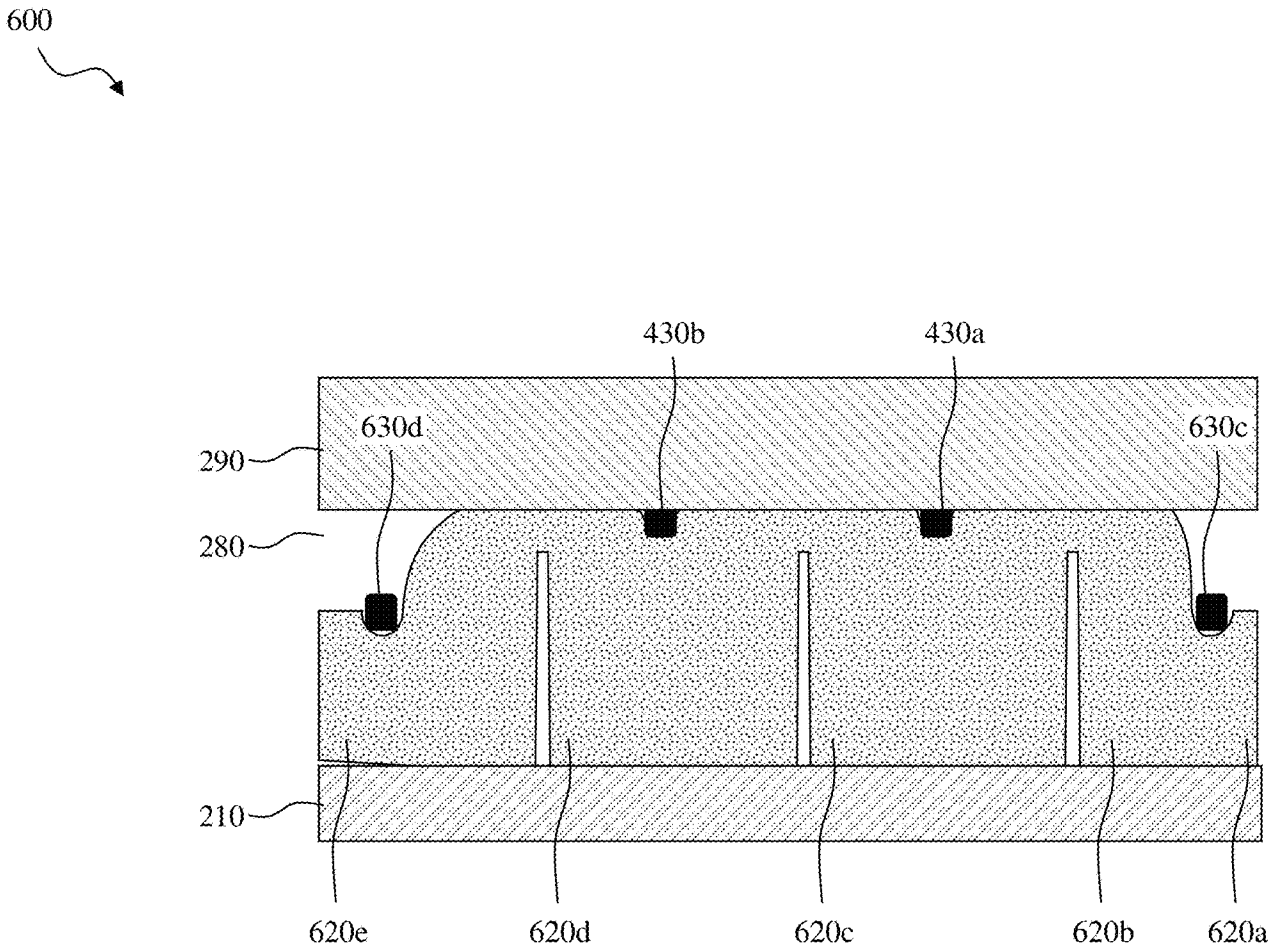
Figure 6G:
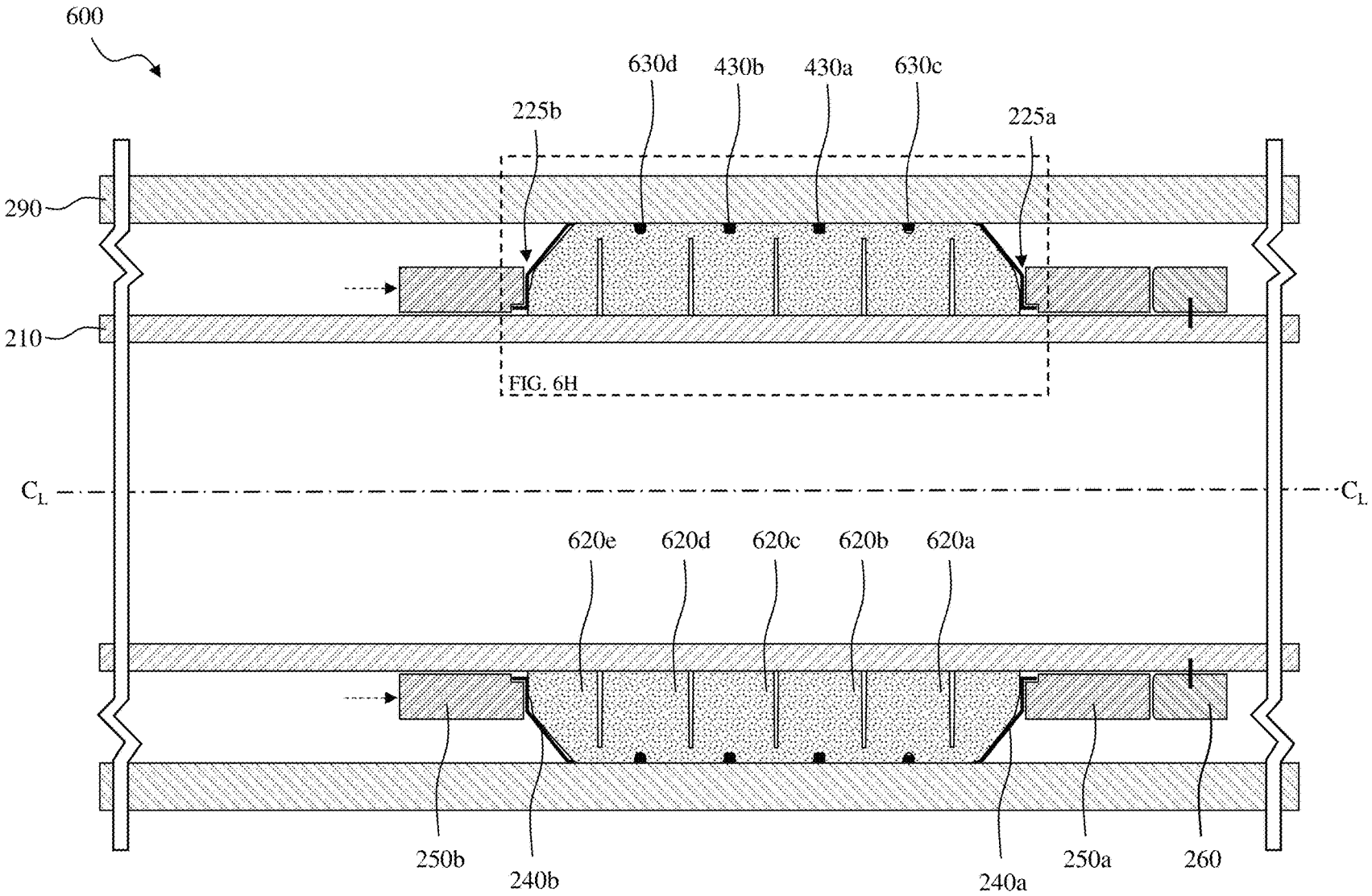
Figure 6H:
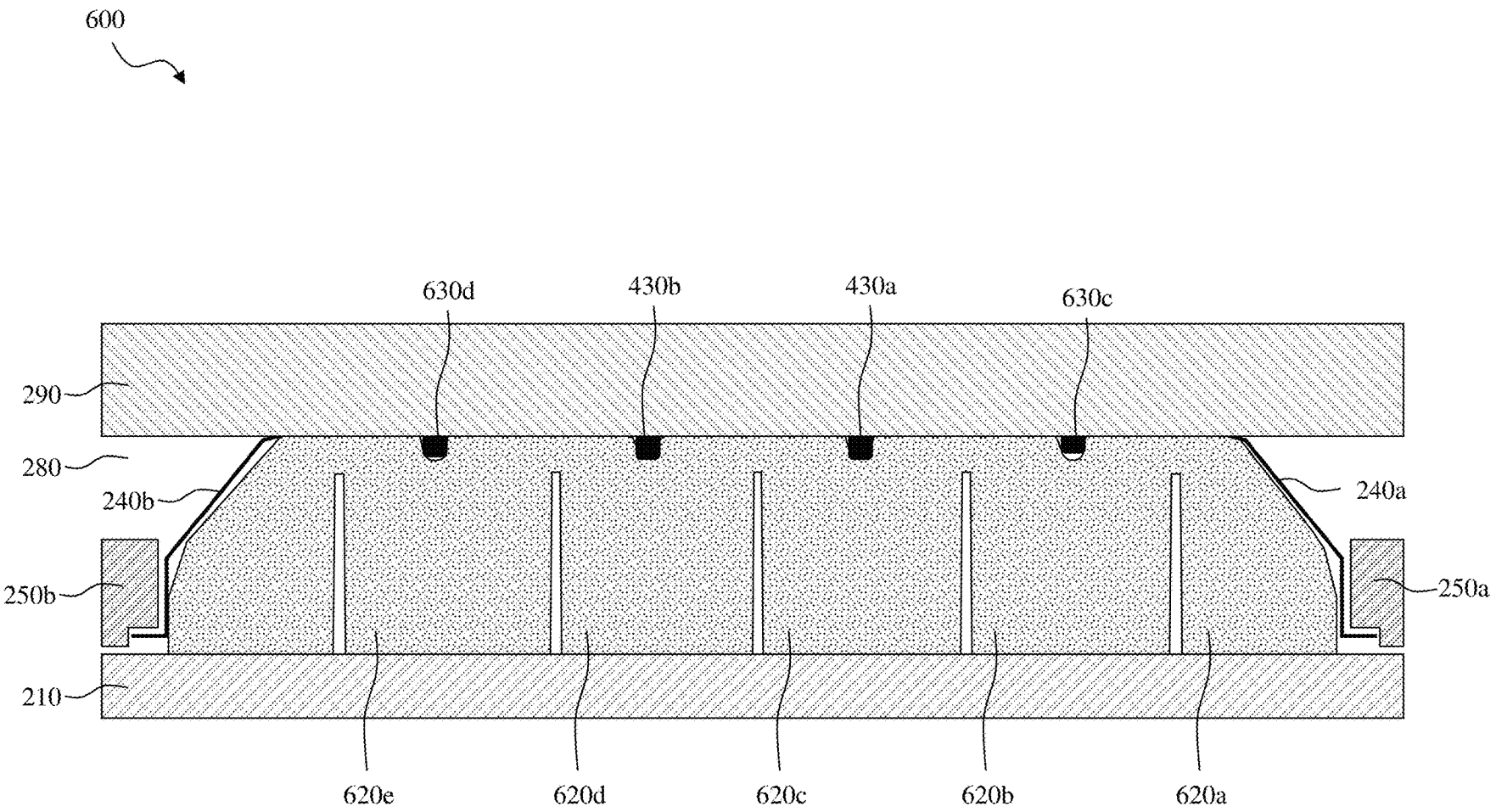
Figure 7A:
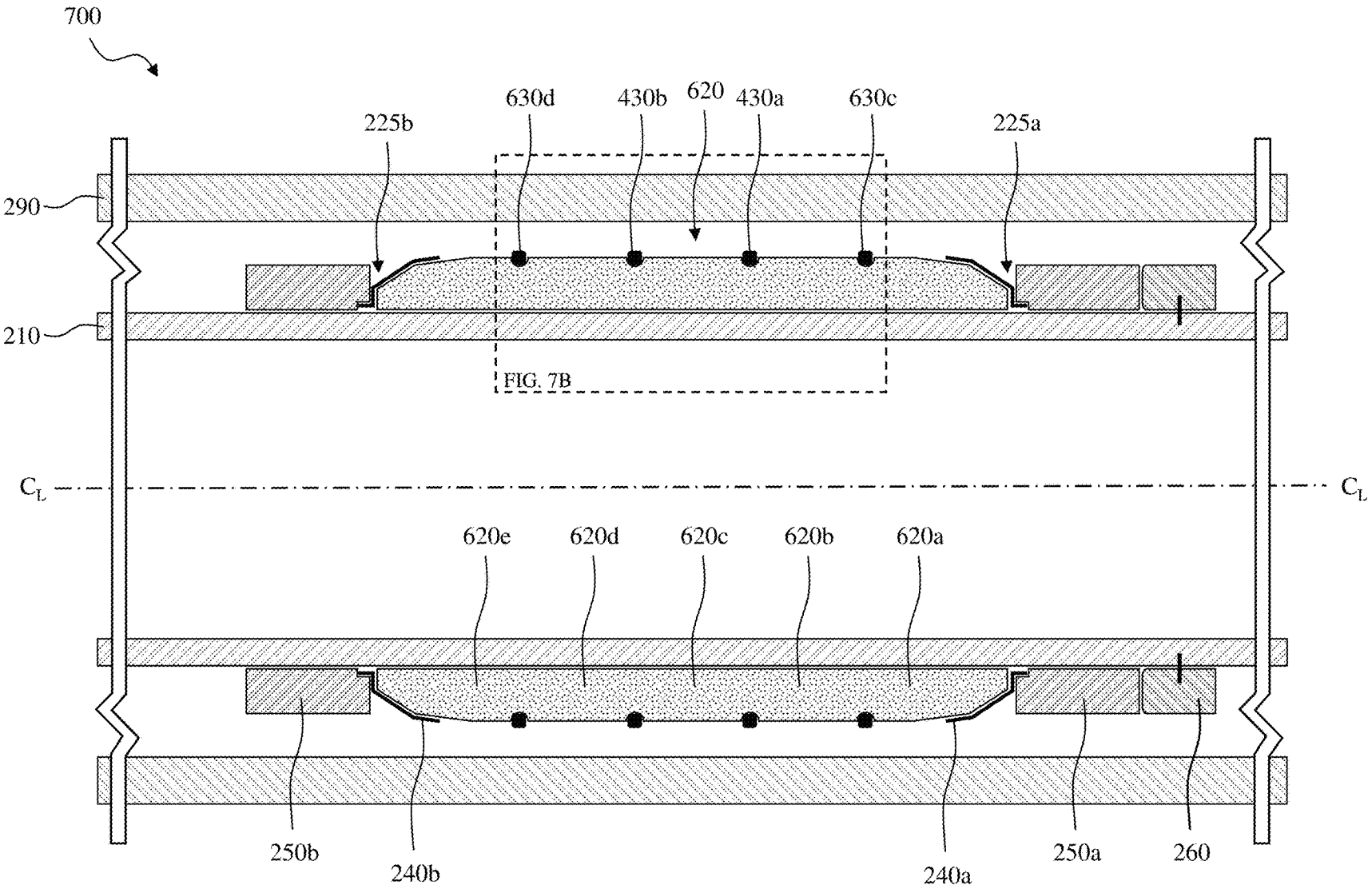
FIGS. 7A through 7H illustrate different cross-sectional views of various deployment states of a sealing assembly designed, manufactured and/or operated according to one or more alternative embodiments of the disclosure.
Figure 7B:
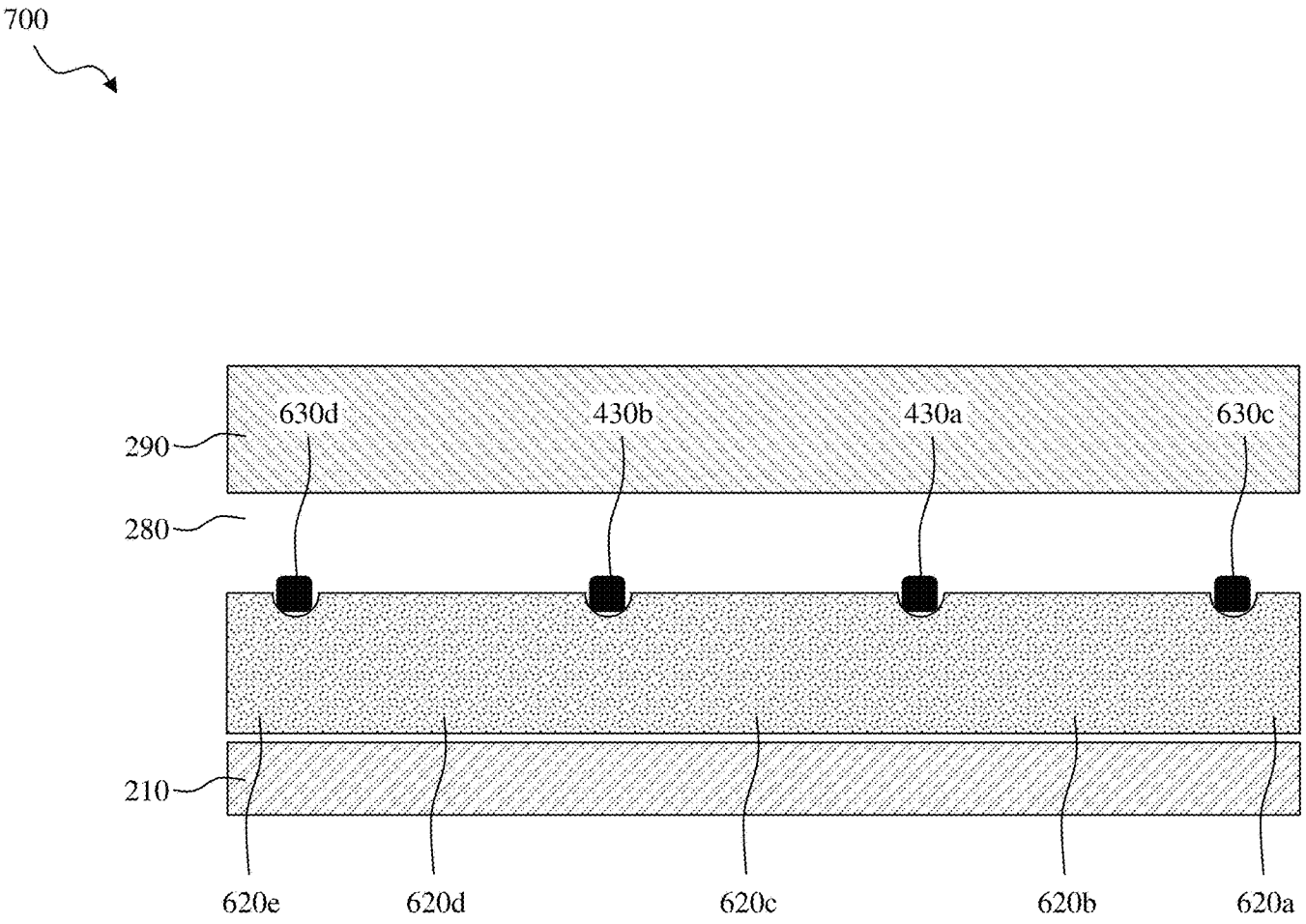
Figure 7C:
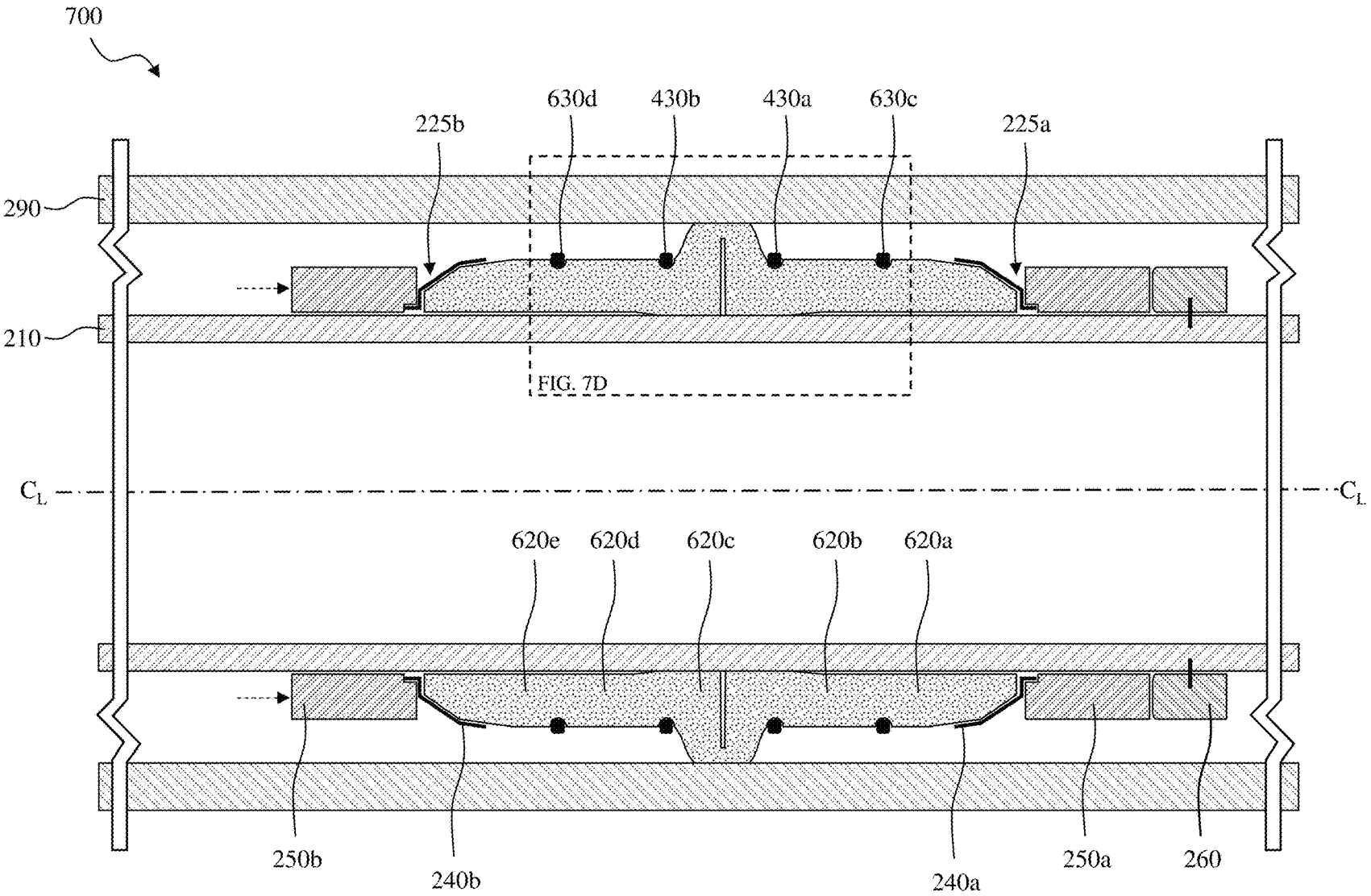
Figure 7D:
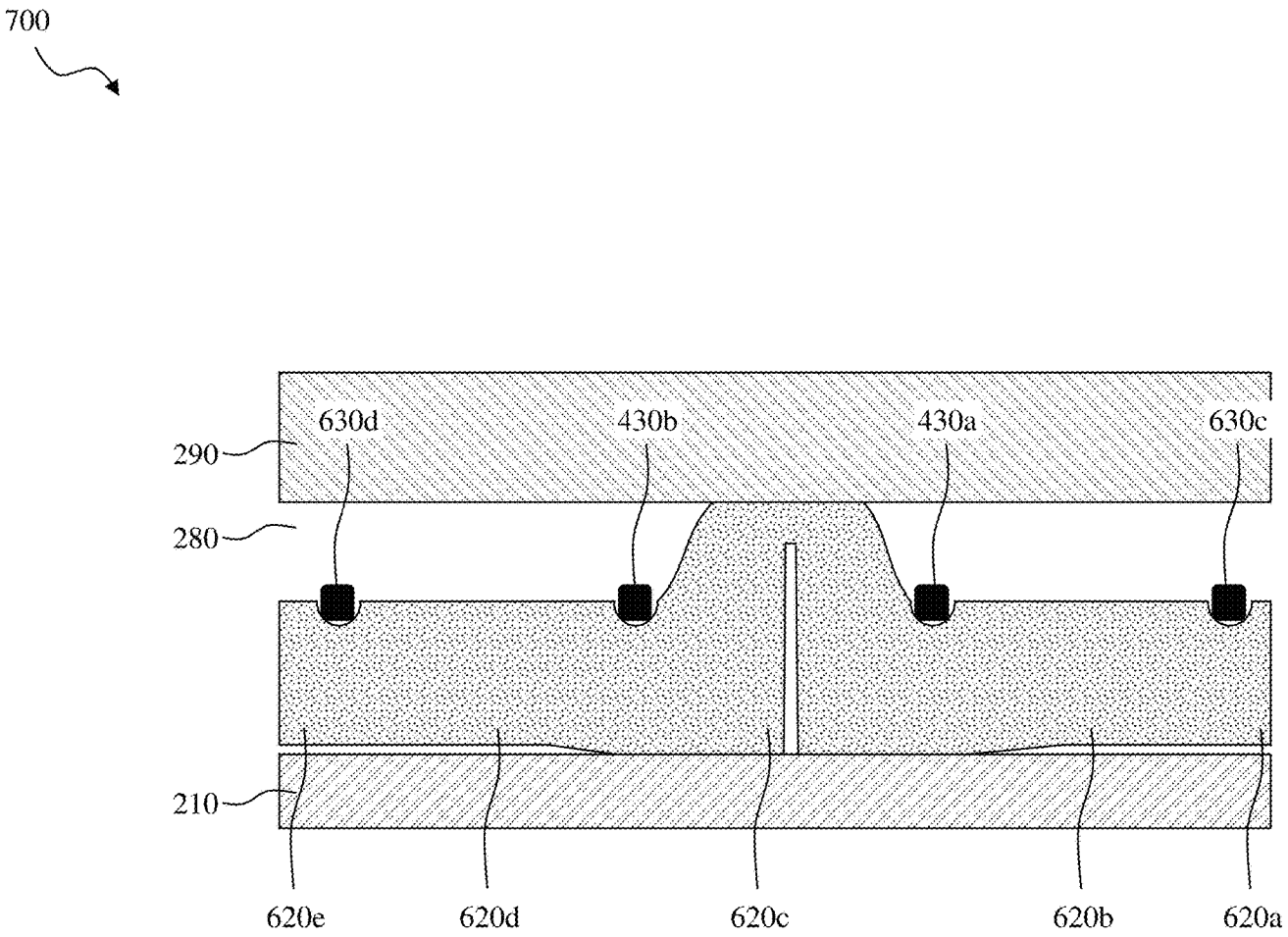
Figure 7E:
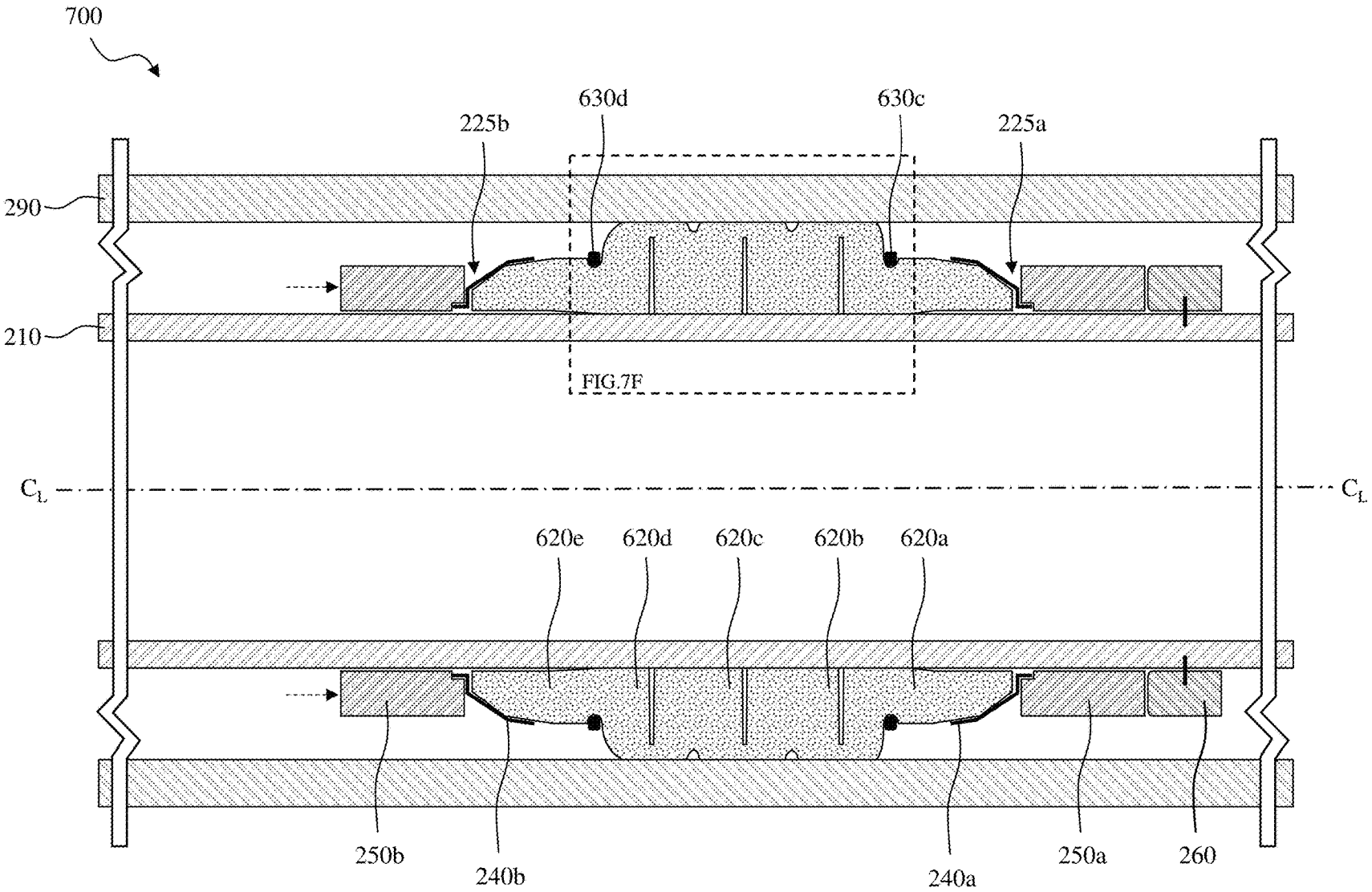
Figure 7F:
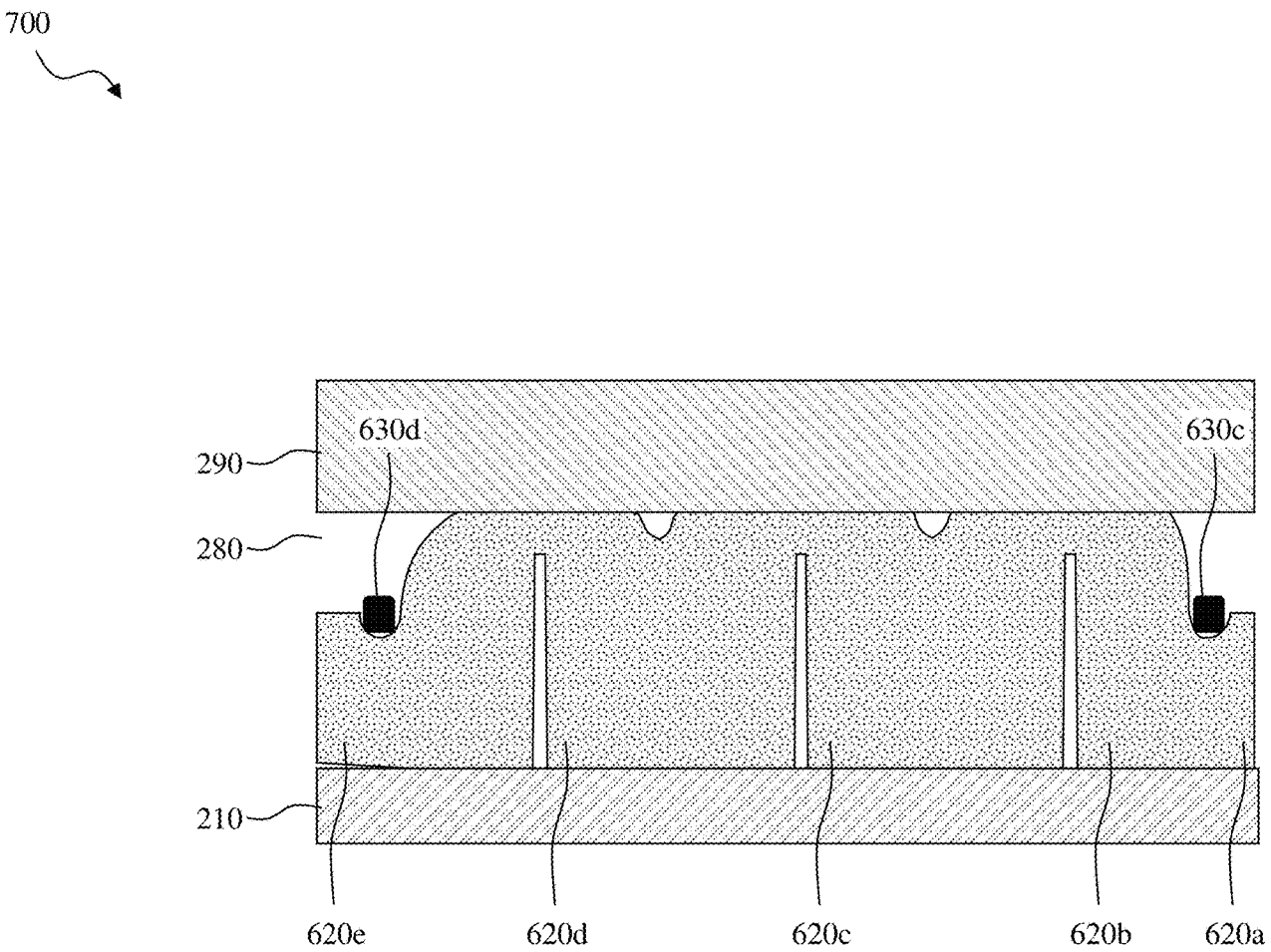
Figure 7G:
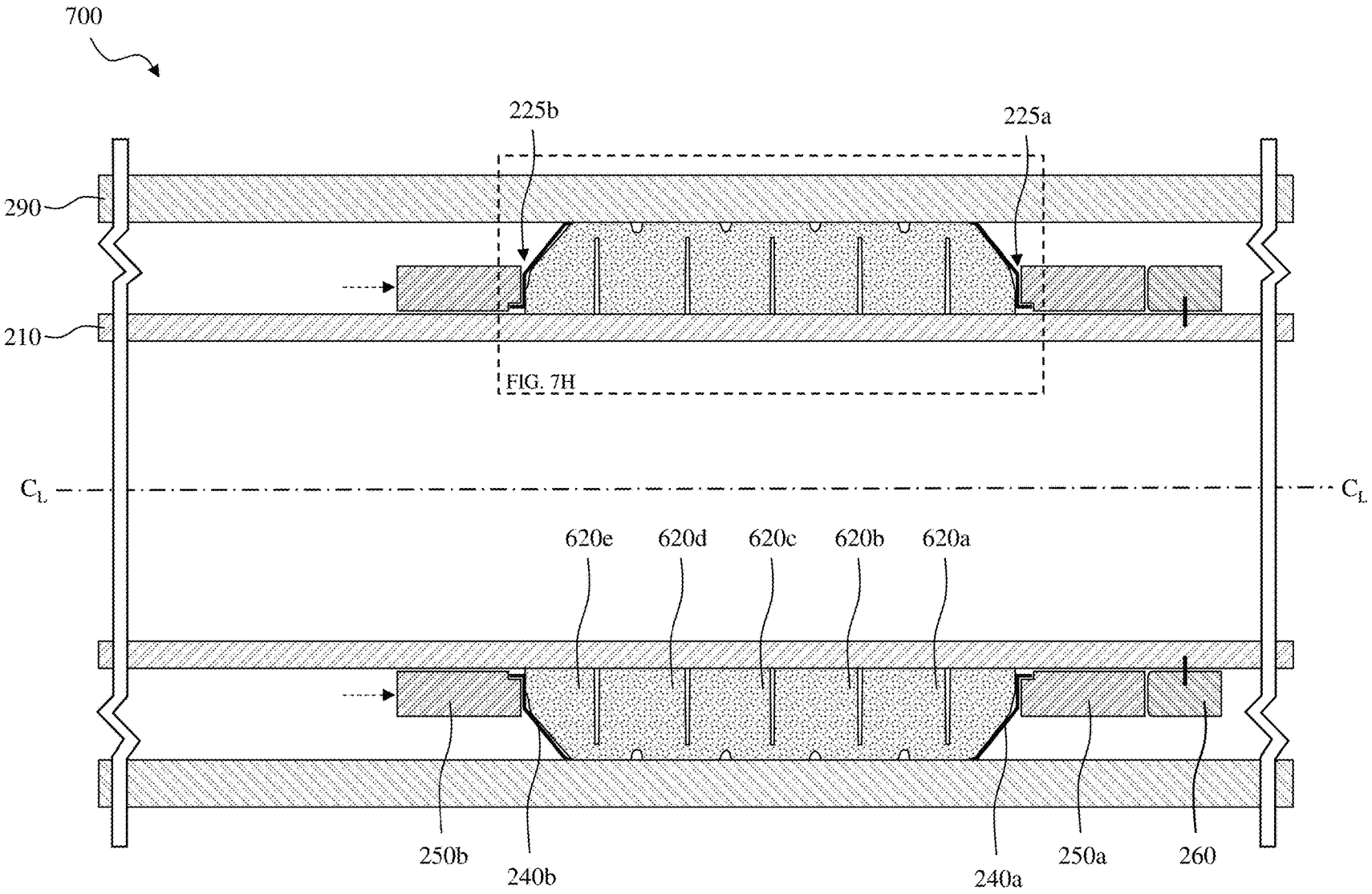
Figure 7H:
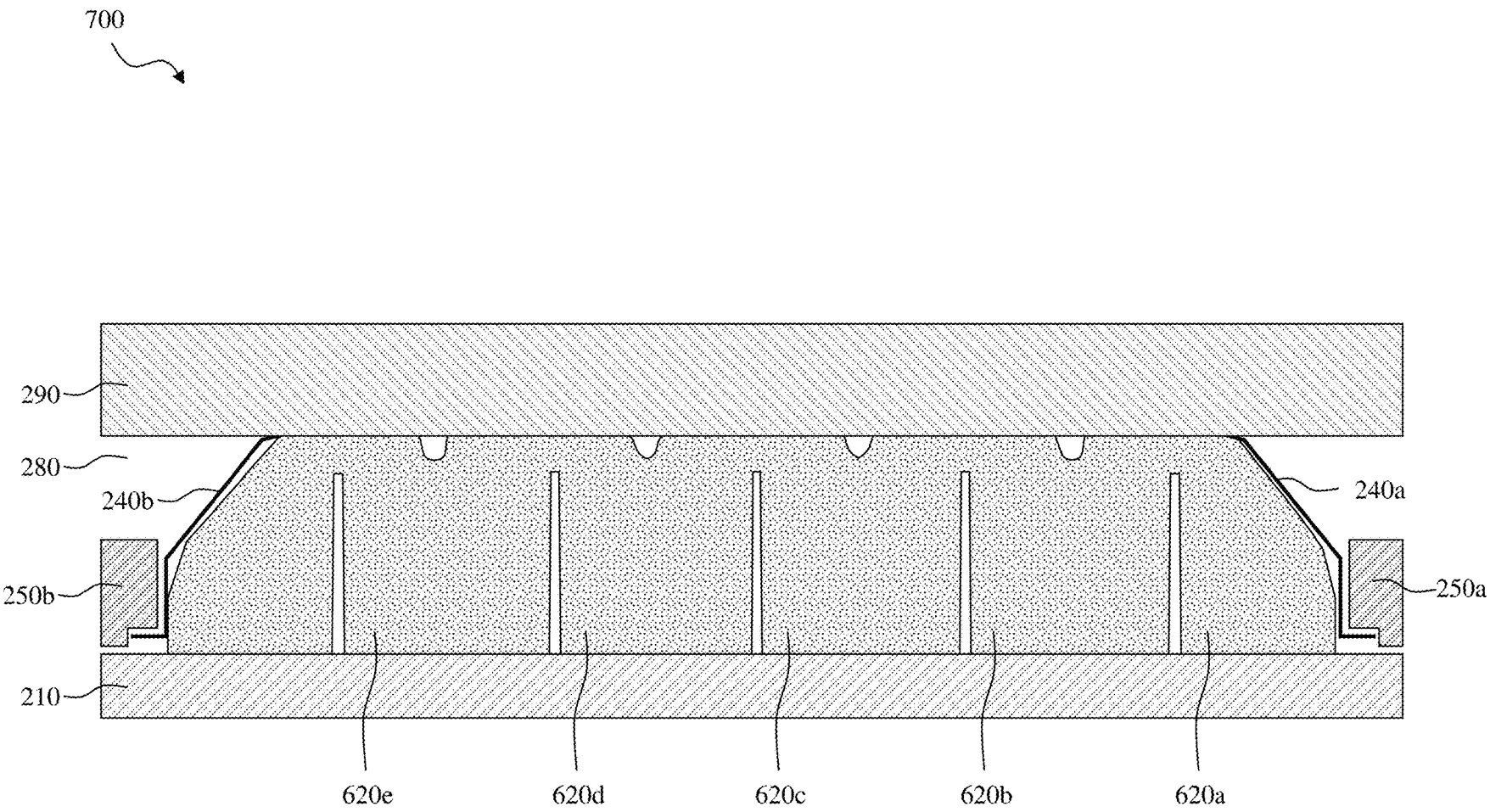
Figure 8A:
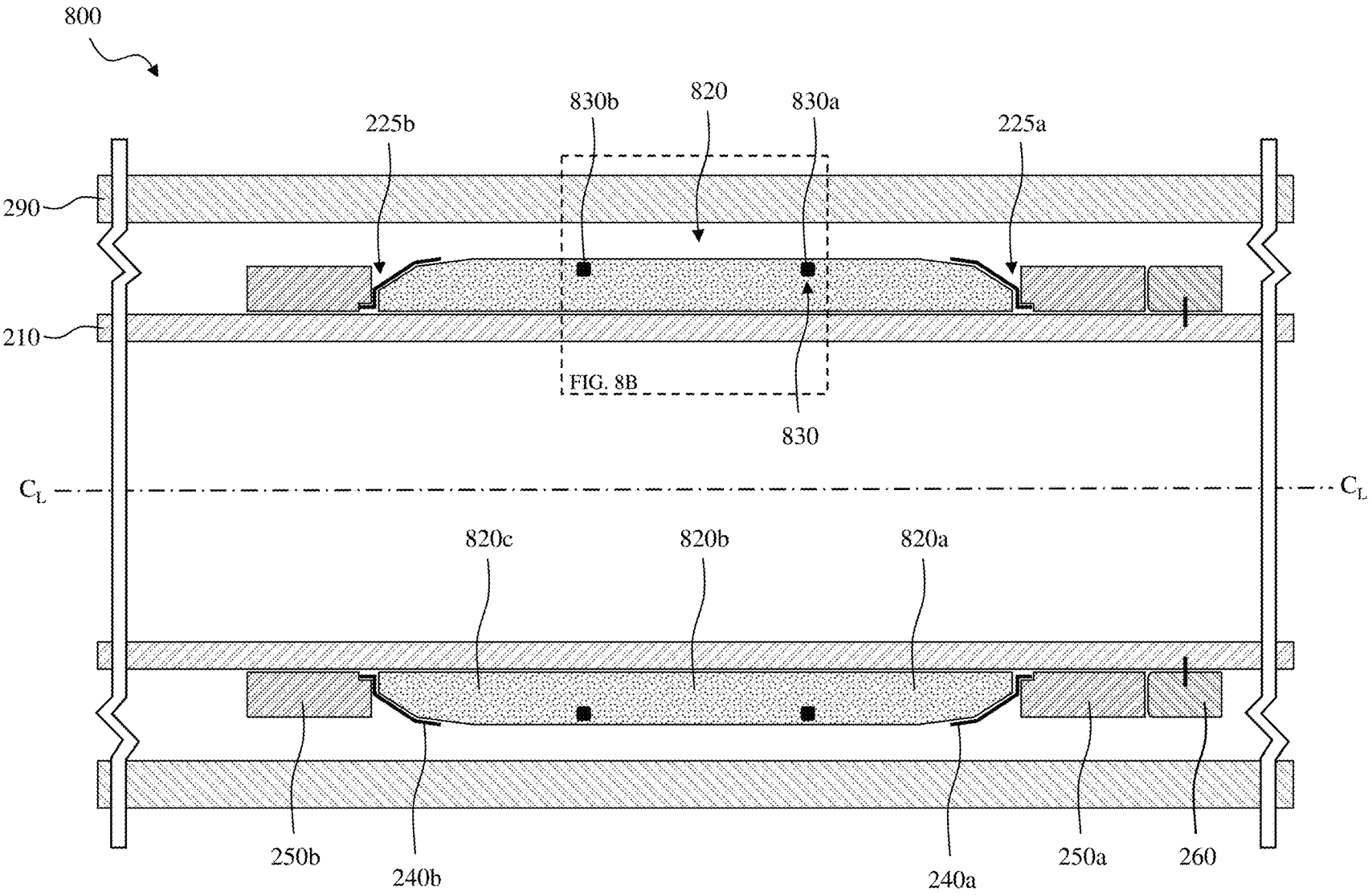
Figure 8B:
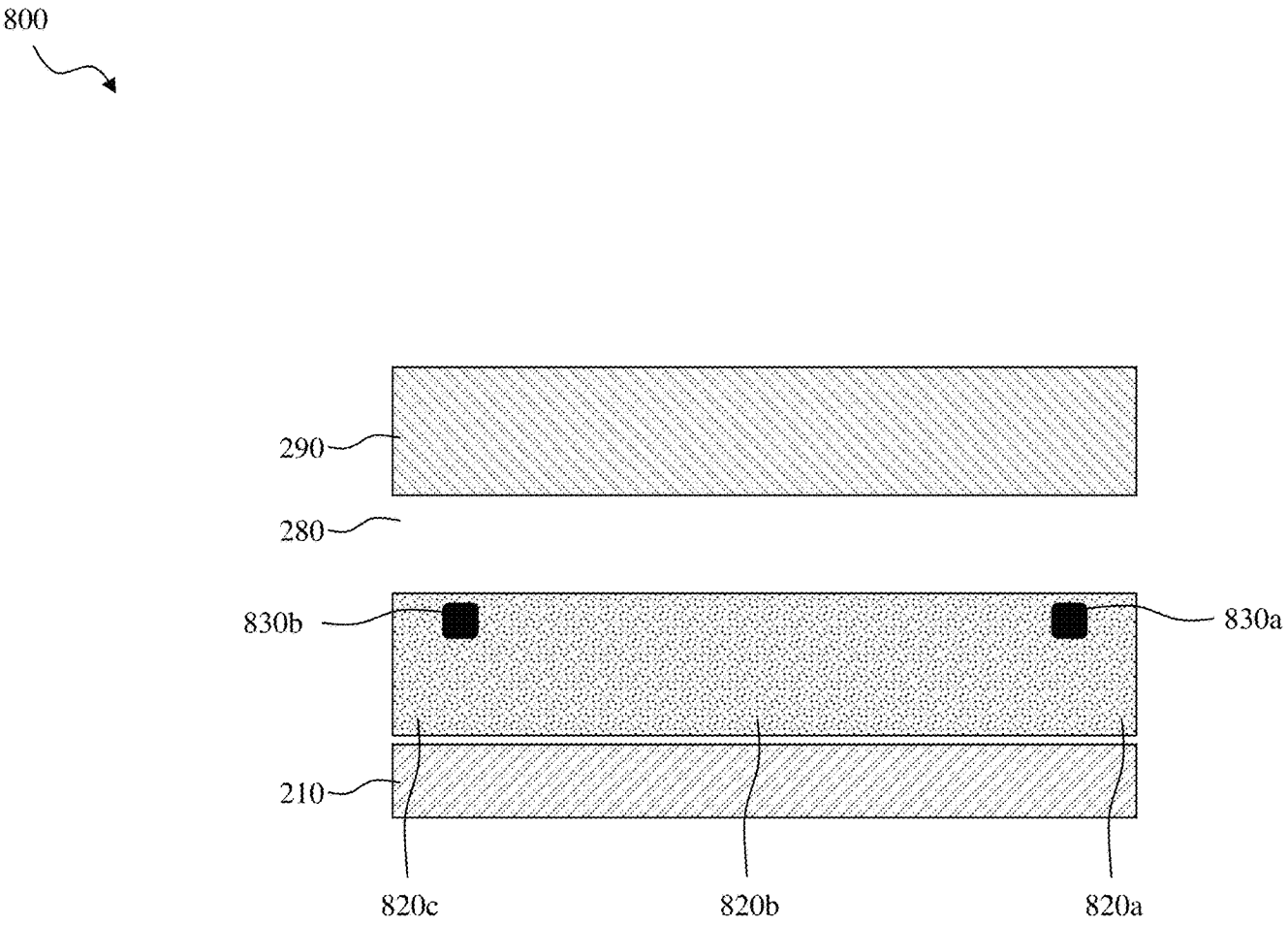
Figure 8C:
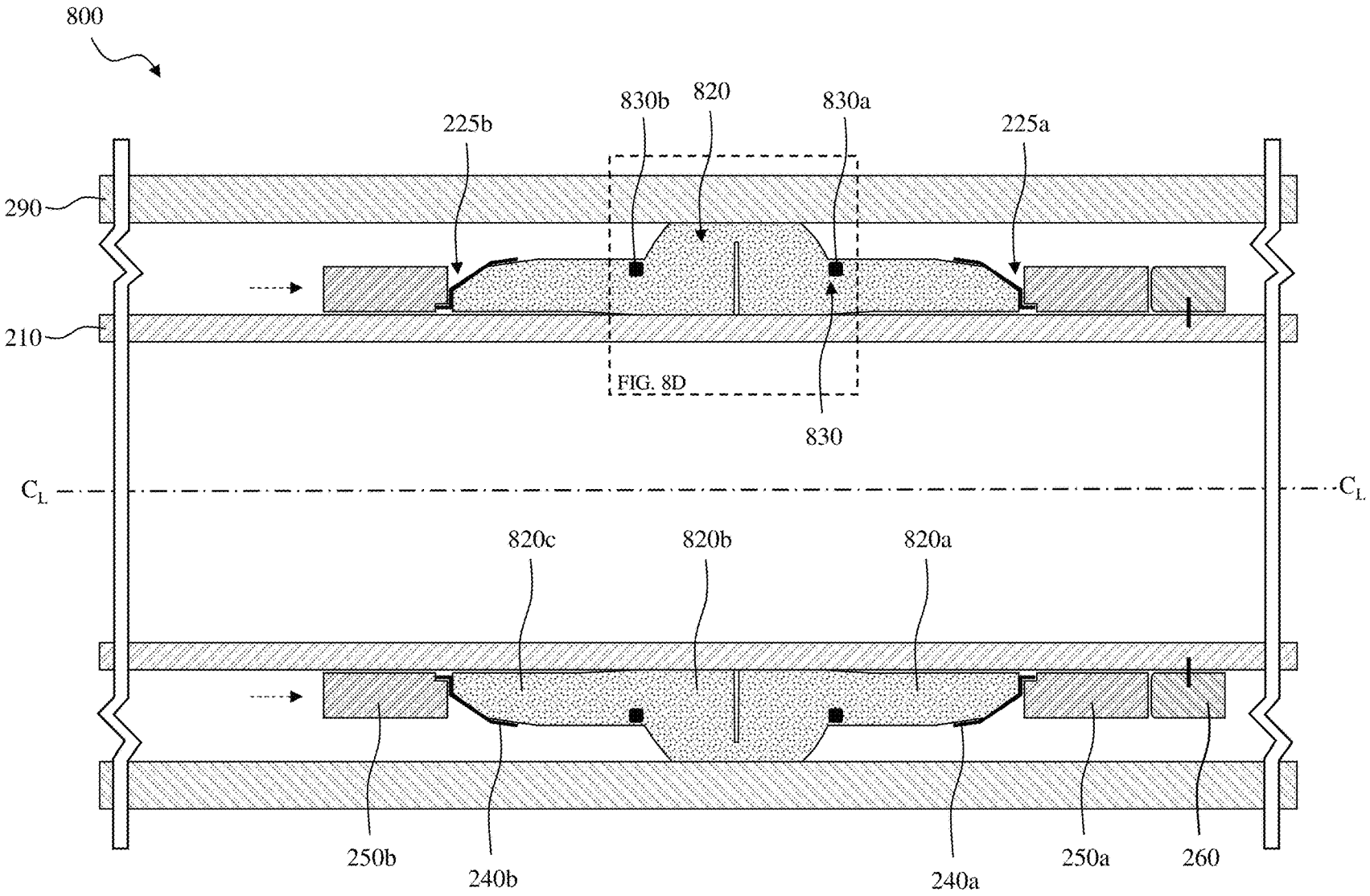
Figure 8D:
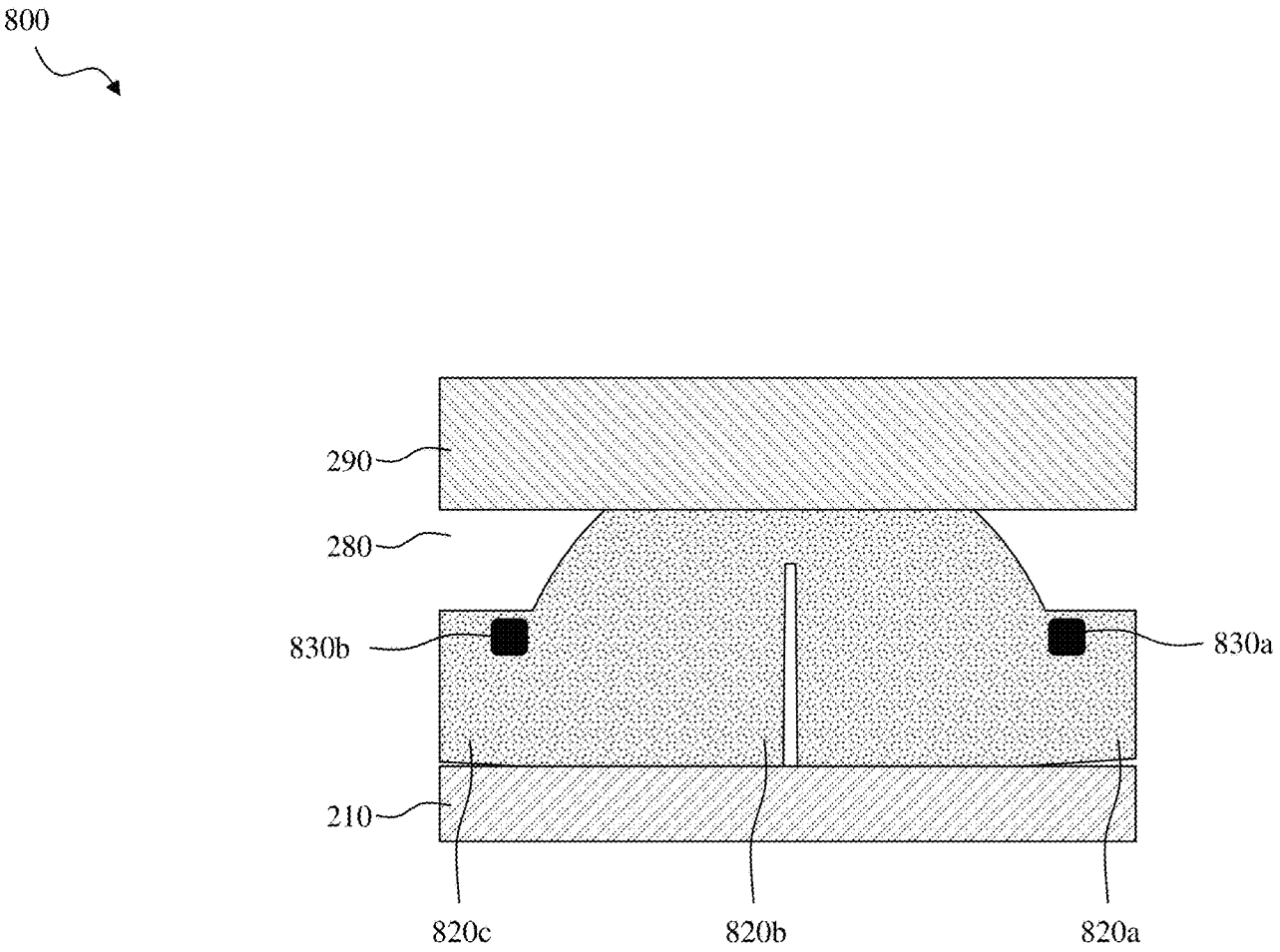
Figure 8E:
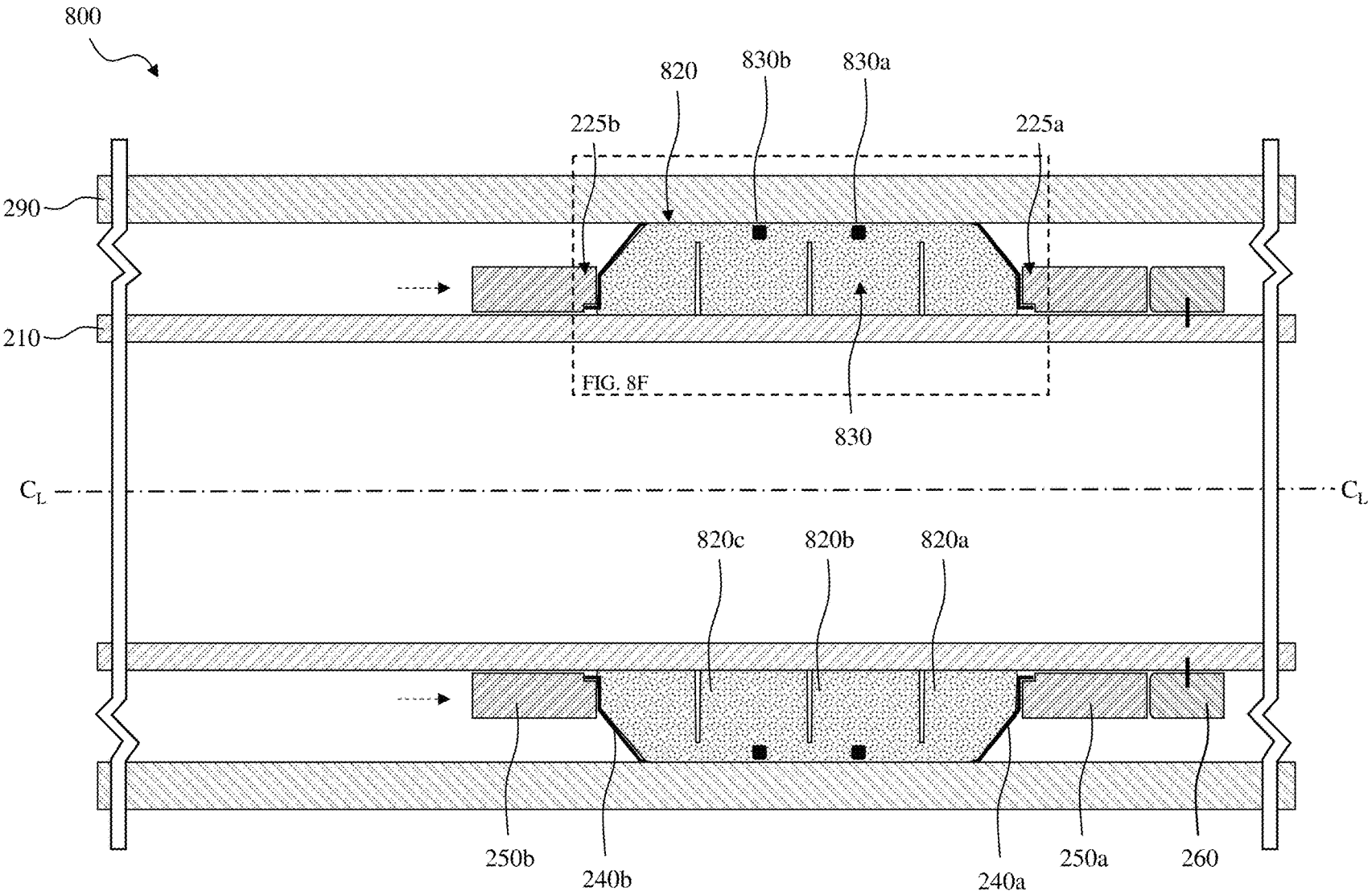
Figure 8F:
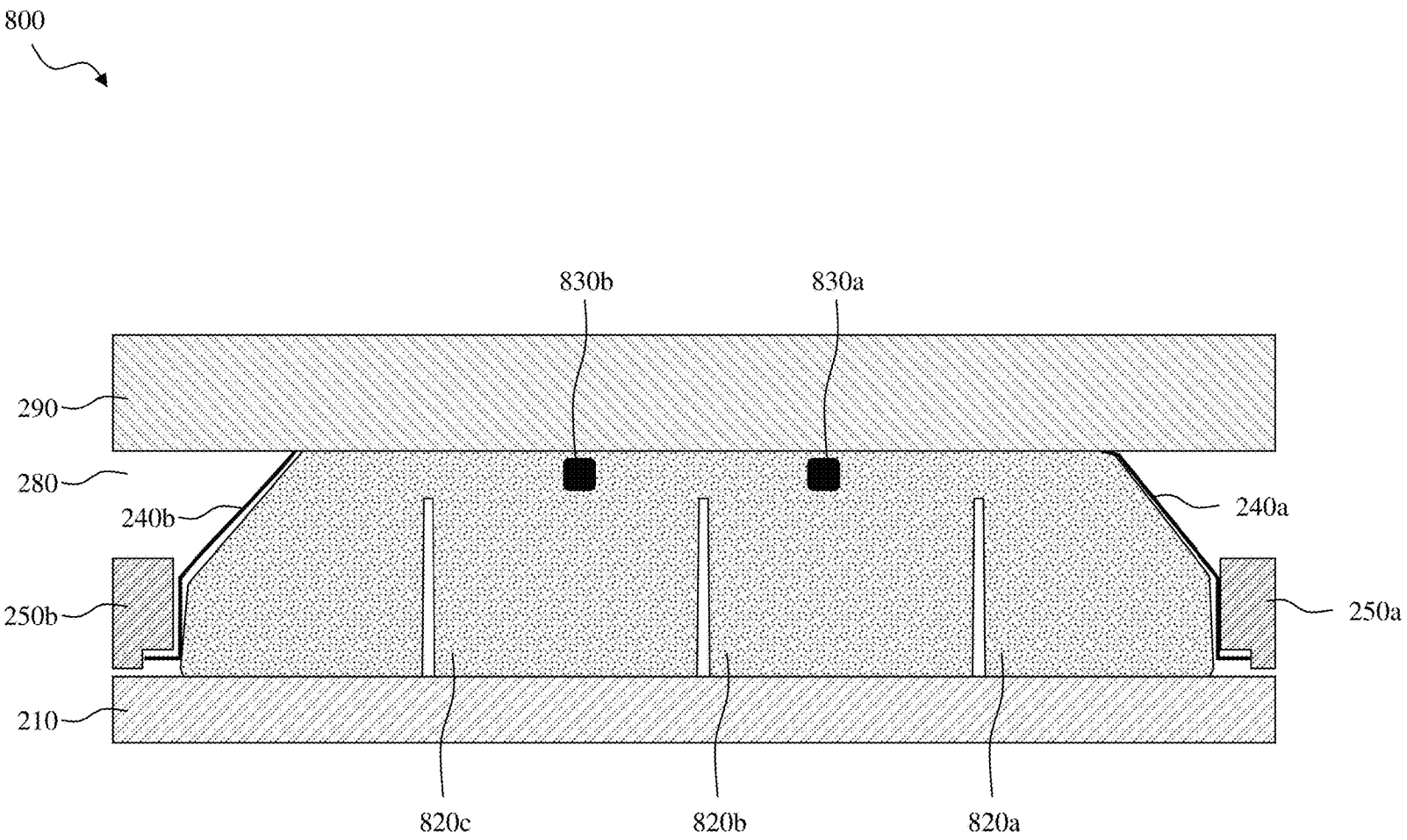

FIGS. 4E and 4F illustrate the sealing assembly 400 as the first and second collar sleeves 250*a*, 250*b* finish axially translating relative to one another. As shown in this embodiment, the final axial translation causes the first and third spaced apart sections 420*a*, 420*c* (e.g., the outer most spaced apart sections) to compress and radially expand. In one or more embodiments, the first and third spaced apart sections 420*a*, 420*c* buckle to radially expand, each again forming two buckled sections as shown. Moreover, in at least one embodiment, the first and second deployable control bands 430*a*, 430*b* deploy from their undeployed state to their deployed state, such as is shown. In the illustrated embodiment, the first and second deployable control bands 430*a*, 430*b* remain intact after the sealing element 420 moves to the radially expanded state.

As shown in FIGS. 4E and 4F, the first and second backup shoes 240*a*, 240*b* gradually deploy to control a deployment of the first and third spaced apart sections 420*a*, 420*b*. For example, the first and second backup shoes 240*a*, 240*b* also help in preventing the first and third spaced apart sections 420*a*, 420*c* from tipping over, and thus considerably enhance the post deployment (e.g., post buckling) stiffness of the first and third spaced apart sections 420*a*, 420*c* as well.

Turning now to FIGS. 5A through 5F, illustrated are different cross-sectional views of various deployment states of a sealing assembly 500 designed, manufactured and/or operated according to one or more alternative embodiments of the disclosure. The sealing assembly 500 of FIGS. 5A through 5F is similar in many respects to the sealing assembly 400 of FIGS. 4A through 4F. Accordingly, like reference numbers have been used to indicate similar, if not identical, features. The sealing assembly 500 differs, for the most part, from the sealing assembly 400 in that the deployable control bands 530*a*, 530*b* of the sealing assembly 500 are configured to break and release after the sealing element 420 moves to the radially expanded state.

Turning now to FIGS. 6A through 6H, illustrated are different cross-sectional views of various deployment states of a sealing assembly 600 designed, manufactured and/or operated according to one or more alternative embodiments of the disclosure. The sealing assembly 600 of FIGS. 6A through 6H is similar in many respects to the sealing assembly 400 of FIGS. 4A through 4F. Accordingly, like reference numbers have been used to indicate similar, if not identical, features. The sealing assembly 600 differs, for the most part, from the sealing assembly 400 in that the sealing assembly 600 additionally includes third and fourth deployable control bands 630*c*. 630*d* positioned about the outer surface, the third and fourth deployable control bands 630*c*, 630*d* positioned on opposing axial sides of the first and second deployable control bands 430*a*, 430*b*. Accordingly, in the illustrated embodiment the first, second, third, and fourth deployable control bands 430*a*, 430*b*, 630*c*, 630*d* separate the sealing element 620 into first, second, third, fourth and fifth spaced apart sections 620*a*, 620*b*, 620*c*, 620*d*, 620*c*.

In at least one embodiment, the first and second deployable control bands 430*a*, 430*b* have a first control band stiffness, and the third and fourth deployable control bands 630*c*, 630*d* have a second control band stiffness. In at least one other embodiment, the second control band stiffness is different than the first control band stiffness. For example, in at least one embodiment the second control band stiffness is greater than the first control band stiffness, for example in an effort to cause the third spaced apart section 620*c* (e.g., middle section) to buckle first, followed by the second and fourth spaced apart section 620*b*, 620*d* to buckle second, and the first and fifth spaced apart section 620*a*, 620*e* to buckle last. For example, the deployable control band's stiffness and strength are designed such that a desirable sequence of sealing element deployment is achieved.

The differing stiffnesses may be created using a number of different processes. For example, in at least one embodiment the first and second deployable control bands 430*a*, 430*b* comprise a material having the first control band stiffness and the third and fourth deployable control band 630*c*, 630*d* comprise a different material having the second different control band stiffness. In yet another embodiment, the materials may be the same, but the size and/or shape is changed to modulate the stiffness.

Turning now to FIGS. 7A through 7H, illustrated are different cross-sectional views of various deployment states of a sealing assembly 700 designed, manufactured and/or operated according to one or more alternative embodiments of the disclosure. The sealing assembly 700 of FIGS. 7A through 7H is similar in many respects to the scaling assembly 600 of FIGS. 6A through 6H. Accordingly, like reference numbers have been used to indicate similar, if not identical, features. The sealing assembly 700 differs, for the most part, from the sealing assembly 600 in that the deployable control bands 430*a*, 430*b*, 630*c*, 630*d* of the scaling assembly 700 are configured to break and release after the sealing element 420 moves to the radially expanded state.

Turning now to FIGS. 8A through 8F, illustrated are different cross-sectional views of various deployment states of a sealing assembly 800 designed, manufactured and/or operated according to one or more alternative embodiments of the disclosure. The scaling assembly 800 of FIGS. 8A through 8F is similar in many respects to the sealing assembly 400 of FIGS. 4A through 4F. Accordingly, like reference numbers have been used to indicate similar, if not identical, features. The scaling assembly 800 differs, for the most part, from the sealing assembly 400 in that the deployable control bands 830*a*, 830*b* of the sealing assembly 800 are embedded within the sealing element 820.

In an alternative embodiment, during run-in-hole operations, a packer's element package is exposed to the wellbore environment, specifically the velocity of fluid flowing past the element package. Depending on the velocity of the fluid around the packer, the fluid can cause the packer element to prematurely deploy or become damaged.

Given this recognition, the present disclosure has developed an improved sealing assembly that includes a cylindrical protective sleeve that has a controlled break point and actuating mechanism over the packer element. The cylindrical protective sleeve allows the packer element to be protected during the run-in-hole operation, but then break and shift out of the way once the sealing assembly reaches a desired depth. This break and shifting of the cylindrical protective sleeve allows the packer element to deploy into the wellbore, creating the desired isolation. In at least one embodiment, the cylindrical protective sleeve (e.g., or at least the remaining portions thereof) axially shifts to expose the packer element (e.g., as opposed to rotating). Such an axial shift allows the cylindrical protective sleeve to be used with hydraulic and/or hydrostatic set packer elements, as opposed to only mechanically set packer elements. Similarly, in at least one embodiment, the cylindrical protective sleeve does not require a dissolvable material or any other chemical reaction to separate, such processes having issues with time to dissolve, knowing whether it is completely dissolved, and the problems that may result if the packer element deploys while all or at least a portion of the undissolved protective sleeve remains.

The foregoing cylindrical protective sleeve allows for an operator to increase the flow rate in the wellbore prior to setting the packer element, for example to increase the injection rate. Increasing the injection rate reduces the cost per barrel, which is quite advantageous.

Turning now to FIGS. 9A through 9D, illustrated are different cross-sectional views of various deployment states of a sealing assembly 900 designed, manufactured and/or operated according to one or more alternative embodiments of the disclosure. The sealing assembly 900 of FIGS. 9A through 9D is similar in many respects to the sealing assembly 200 of FIGS. 2A through 2H. Accordingly, like reference numbers have been used to indicate similar, if not identical, features.

The sealing assembly 900 differs, for the most part, from the sealing assembly 200, in that the sealing assembly 900 includes a cylindrical protective sleeve 910 positioned about the sealing element 220. The sealing assembly 900, in the illustrated embodiment, includes the cylindrical protective sleeve 910 positioned radially about a center point of the sealing element 220. In accordance with one or more embodiments, the cylindrical protective sleeve 910 is configured to break to deploy from an undeployed state (e.g., that shown in FIG. 9A) to a deployed state (e.g., that shown in FIGS. 9B through 9D) as the sealing element 220 moves from the radially retracted state to the radially expanded state.

In at least one embodiment, the cylindrical protective sleeve 910 includes a body 915 having a weakened region 930, the weakened region 930 defining first and second cylindrical protective sleeve portions 920*a*, 920*b*. In one or more embodiments, the weakened region 930 is located substantially proximate a midpoint of the sealing element 220. The phrase "substantially proximate," as used herein with reference to the midpoint of the sealing element 220, means that the weakened region 930 is located within 20 percent of the midpoint of the sealing element 220. In yet another embodiment, the weakened region 930 is located ideally proximate a midpoint thereof, wherein the phrase "ideally proximate" means that the weakened region 930 is located within 5 percent of the midpoint of the sealing element 220. In yet another embodiment, the weakened region 930 is located at exactly the midpoint, which means that the weakened region 930 is located within 1 percent of the midpoint of the sealing element 220.

The weakened region 930 may take on many different sizes, shapes and/or styles and remain within the scope of the present disclosure. In the illustrated embodiment of FIGS. 9A through 9D, however, the weakened region 930 is a circumferential notch located around an inside radial surface of the cylindrical protective sleeve 910. The circumferential notch, in the illustrated embodiment, might not extend entirely through a thickness of the cylindrical protective sleeve 910. While the embodiment of FIGS. 9A through 9D illustrates that a weakened region 930 extends circumferentially around an entire inside radial surface of the cylindrical protective sleeve 910, other embodiments may exist wherein one or more circumferential notches extend around only a portion of the inside radial surface of the cylindrical protective sleeve 910. Furthermore, while the embodiment of FIGS. 9A through 9D illustrates that the weakened region 930 is located around an inside radial surface, in one or more other embodiments the weakened region 930 is one or more circumferential notches located around an outside radial surface of the cylindrical protective sleeve 910.

The cylindrical protective sleeve 910 may comprise many different materials and remain within the scope of the disclosure. In at least one embodiment, however, the cylindrical protective sleeve 910 comprises a deployable ductile metal, such as AISI 1018 steel or SAE 316L grade stainless steel. In yet another embodiment, the cylindrical protective sleeve 910 comprises a deployable plastic, polymer or composite. For example, in at least one embodiment, at least a portion of the cylindrical protective sleeve 910 comprises a material having a yield strength of 40 ksi or less, if not 30 ksi or less. In even yet another embodiment, the cylindrical protective sleeve 910 comprises a corrodible material.

The cylindrical protective sleeve 910, depending on the design of the sealing assembly 900, may cover varying amounts of the sealing element 220. For example, in at least one embodiment, the cylindrical protective sleeve 910 is located radially about at least 60 percent of the scaling element 220. In yet another embodiment, the cylindrical protective sleeve 910 is located radially about at least 80 percent of the sealing element 220, if not at least 90 percent, if not at least 95 percent. In yet another embodiment, the cylindrical protective sleeve 910 is located radially about an entirety of the sealing element 220, such as is shown in FIGS. 9A through 9D.

The sealing assembly 900, in the illustrated embodiment, may additionally include one or more actuating mechanisms 940. In at least one embodiment, the actuating mechanisms 940 are configured to withdraw the first and second cylindrical protective sleeve portions 920*a*, 920*b* from about the sealing element 220 after the weakened region 930 has failed, and thus allow the sealing element 220 to move from its undeployed state to its deployed state. In the illustrated embodiment of FIGS. 9A though 9D, the actuating mechanism 940 is a spring mechanism. Nevertheless, any other known or hereafter discovered actuating mechanism 940 that is configured to withdraw the first and second cylindrical protective sleeve portions 920*a*, 920*b* from about the sealing element 220 after the weakened region 930 has failed may be used and remain within the scope of this disclosure.

The sealing assembly 900 may additionally differ from the sealing assembly 200 in that it employs a standard spacer 950 (e.g., non-deployable spacer). In the illustrated embodiment, the sealing element 200 includes a first spacer 950*a* positioned between the first sealing element portion 220*a* and the second sealing element portion 220*b*, as well as a second spacer 950*b* positioned between the second sealing element portion 220*b* and the third sealing element portion 220*c*. In at least one embodiment, each adjacent pair of sealing element portions includes their own spacer. Thus, as shown here, the three sealing element portions 920*a*, 920*b*, 920*c* would include two spacers 950*a*, 950*b*. Accordingly, if the sealing element 200 were to include five sealing element portions, it would likely also include four spacers positioned there between. While the embodiment of FIGS. 9A through 9D employ standard spacers 950, other embodiments may exist wherein the deployable spacers of FIGS. 2A through 2H are alternatively used. In at least this one embodiment, the deployable spacers would be configured to deploy from an undeployed state (e.g., as shown in FIGS. 2A and 2B) to a deployed state (e.g., as shown in FIGS. 2C through 2F).

Figure 9A:
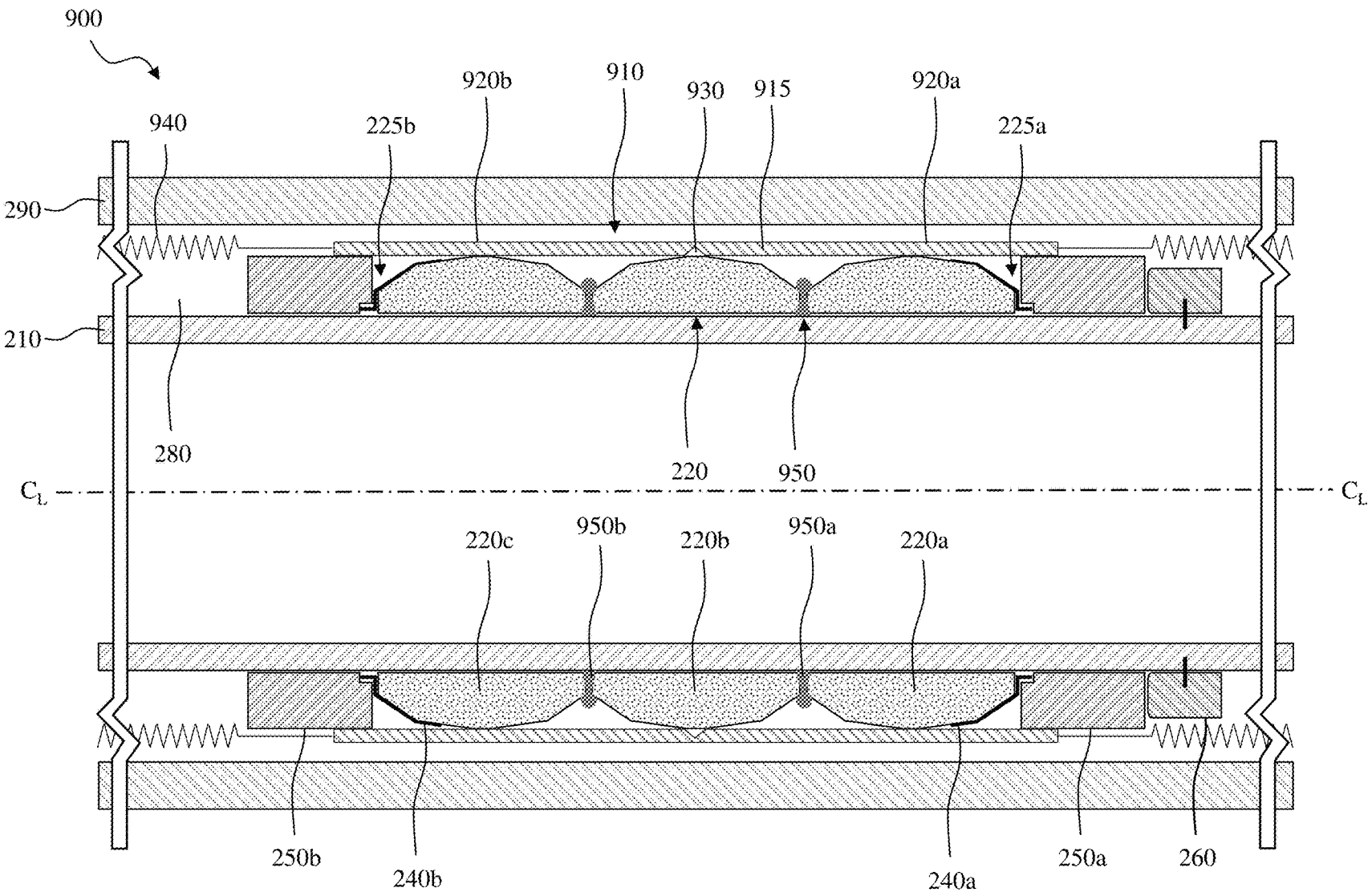
Figure 9B:
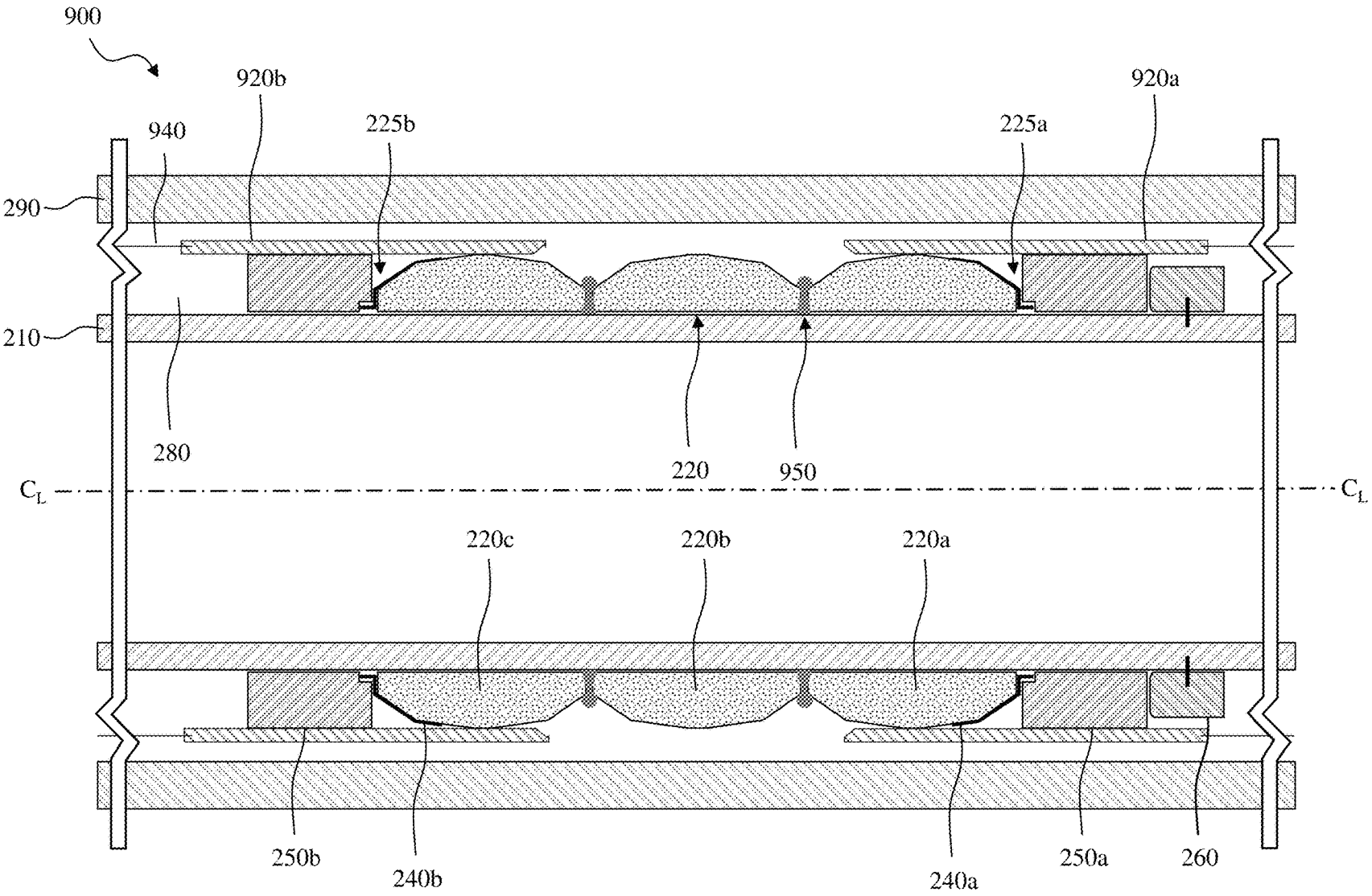
Figure 9C:
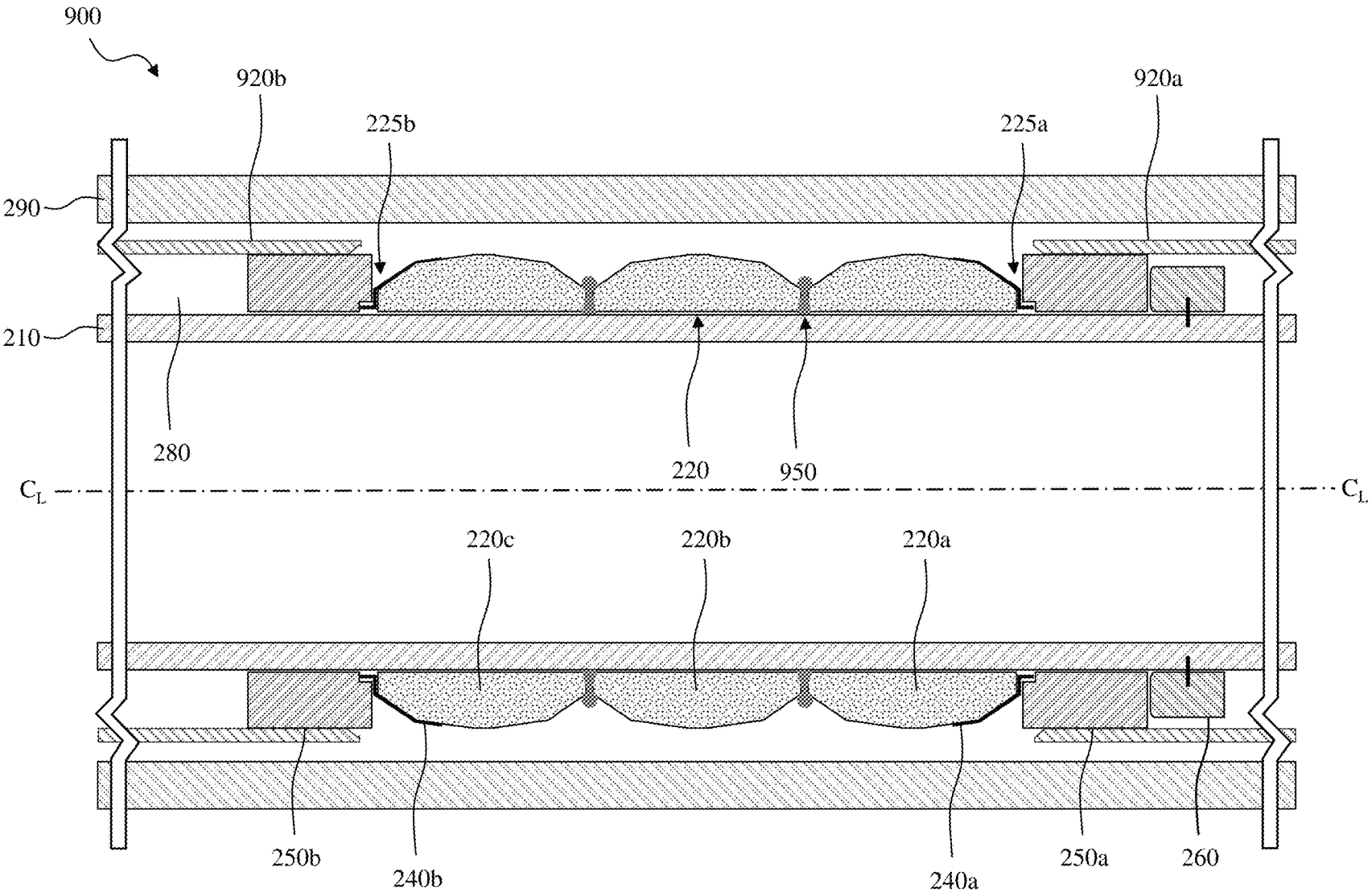
Figure 9D:
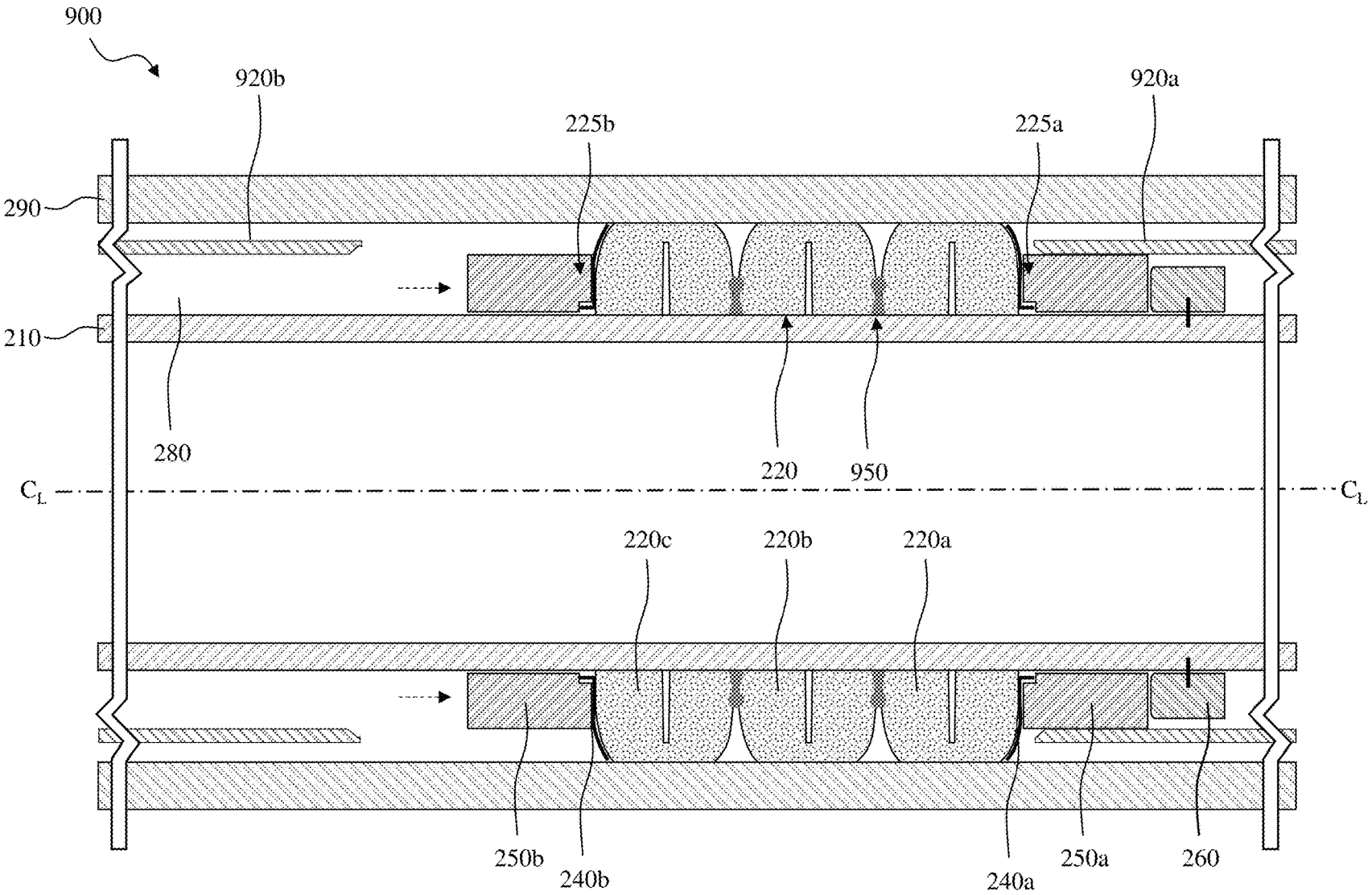

Given the forgoing, FIG. 9A illustrates the sealing assembly 900 with its cylindrical protective sleeve 910 in the run-in-hole state, and thus the weakened region 930 remains intact, and the first and second cylindrical protective sleeve portions 920*a*, 920*b* protecting the scaling element 220. FIG. 9B illustrates the sealing assembly 900 shortly after the weakened region 930 has failed, and thus the actuating mechanisms 940 begin to withdraw the first and second cylindrical protective sleeve portions 920*a*, 920*b* from about the sealing element 220. In at least one embodiment, the weakened region 930 fails when the actuating mechanism 940 axially pulls thereon. In yet another embodiment, the weakened region 930 fails when the first and second collar sleeves 250*a*, 250*b* start to axially translate relative to one another, and thus in one embodiment when the sealing element starts to move from its radially retracted state to its radially expanded state. In yet another embodiment, the weakened region 930 fails when the protective sleeve corrodes. FIG. 9C illustrates the sealing assembly 900 a bit longer after the weakened region 930 has failed, and thus the actuating mechanisms 940 have fully withdrawn the first and second cylindrical protective sleeve portions 920*a*, 920*b* from about the sealing element 220. FIG. 9D illustrates the sealing assembly 900 after the sealing element 220 has radially deployed into engagement with the bore 290.

Aspects disclosed herein include:

A. A scaling assembly, the sealing assembly including: 1) a mandrel; 2) a sealing element positioned about the mandrel, the sealing element including: a) a first sealing element portion and a second sealing element portion; and b) a deployable spacer positioned between the first sealing element portion and the second sealing element portion; 3) a first collar sleeve coupled proximate a first end of the sealing element; and 4) a second collar sleeve coupled proximate a second end of the sealing element, wherein the first and second collar sleeves are configured to axially translate relative to one another along the mandrel to move the sealing element between a radially retracted state a radially expanded state, and further wherein the deployable spacer is configured to deploy from an undeployed state to a deployed state as the sealing element moves from the radially retracted state to the radially expanded state.

B. A well system, the well system including: 1) a wellbore located in a subterranean formation; and 2) a sealing assembly positioned in the wellbore, the sealing assembly including: a) a mandrel; b) a sealing element positioned about the mandrel, the sealing element including: i) a first scaling element portion and a second sealing element portion; and ii) a deployable spacer positioned between the first sealing element portion and the second sealing element portion; c) a first collar sleeve coupled proximate a first end of the sealing element; and c) a second collar sleeve coupled proximate a second end of the sealing element, wherein the first and second collar sleeves are configured to axially translate relative to one another along the mandrel to move the sealing element between a radially retracted state a radially expanded state, and further wherein the deployable spacer is configured to deploy from an undeployed state to a deployed state as the sealing element moves from the radially retracted state to the radially expanded state.

C. A method, the method including: 1) positioning a sealing assembly within a wellbore located in a subterranean formation, the sealing assembly including: a) a mandrel; b) a scaling element positioned about the mandrel, the sealing element including: i) a first sealing element portion and a second sealing element portion; and ii) a deployable spacer positioned between the first sealing element portion and the second sealing element portion; c) a first collar sleeve coupled proximate a first end of the sealing element; and d) a second collar sleeve coupled proximate a second end of the sealing element, wherein the first and second collar sleeves are configured to axially translate relative to one another along the mandrel to move the sealing element between a radially retracted state a radially expanded state, and further wherein the deployable spacer is configured to deploy from an undeployed state to a deployed state as the sealing element moves from the radially retracted state to the radially expanded state; and 2) moving the sealing element from the radially retracted state to the radially expanded state, the moving causing the deployable spacer to deploy from the undeployed state to the deployed state.

D. A scaling assembly, the sealing assembly including: 1) a mandrel; 2) a sealing element positioned about the mandrel, the sealing element having a radial inner surface and a radial outer surface; 3) a deployable control band positioned radially outside the radial inner surface; 4) a first collar sleeve coupled proximate a first end of the sealing element; and 5) a second collar sleeve coupled proximate a second end of the sealing element, wherein the first and second collar sleeves are configured to axially translate relative to one another along the mandrel to move the sealing element between a radially retracted state a radially expanded state, and further wherein the deployable control band is configured to deploy from an undeployed state to a deployed state as the sealing element moves from the radially retracted state to the radially expanded state.

E. A well system, the well system including: 1) a wellbore located in a subterranean formation; and 2) a sealing assembly positioned in the wellbore, the sealing assembly including: a) a mandrel; b) a sealing element positioned about the mandrel, the sealing element having a radial inner surface and a radial outer surface; c) a deployable control band positioned radially outside the radial inner surface; d) a first collar sleeve coupled proximate a first end of the sealing element; and 3) a second collar sleeve coupled proximate a second end of the sealing element, wherein the first and second collar sleeves are configured to axially translate relative to one another along the mandrel to move the sealing element between a radially retracted state a radially expanded state, and further wherein the deployable control band is configured to deploy from an undeployed state to a deployed state as the sealing element moves from the radially retracted state to the radially expanded state.

F. A method, the method including: 1) positioning a sealing assembly within a wellbore located in a subterranean formation, the sealing assembly including: a) a mandrel; b) a scaling element positioned about the mandrel, the sealing element having a radial inner surface and a radial outer surface; c) a deployable control band positioned radially outside the radial inner surface; d) a first collar sleeve coupled proximate a first end of the sealing element; and 3) a second collar sleeve coupled proximate a second end of the sealing element, wherein the first and second collar sleeves are configured to axially translate relative to one another along the mandrel to move the scaling element between a radially retracted state a radially expanded state, and further wherein the deployable control band is configured to deploy from an undeployed state to a deployed state as the sealing element moves from the radially retracted state to the radially expanded state; and 2) moving the sealing element from the radially retracted state to the radially expanded state, the moving causing the deployable control band to deploy from the undeployed state to the deployed state.

G. A sealing assembly, the sealing assembly including: 1) a mandrel; 2) a sealing element positioned about the mandrel; 3) a cylindrical protective sleeve positioned about the sealing element, the cylindrical protective sleeve configured to break to deploy from an undeployed state to a deployed state based upon axial or radial stress imparted thereon.

H. A well system, the well system including: 1) a wellbore located in a subterranean formation; and 2) a sealing assembly positioned in the wellbore, the sealing assembly including: a) a mandrel; b) a sealing element positioned about the mandrel; c) a cylindrical protective sleeve positioned about the sealing element, the cylindrical protective sleeve configured to break to deploy from an undeployed state to a deployed state based upon axial or radial stress imparted thereon.

I. A method, the method including: 1) positioning a sealing assembly within a wellbore located in a subterranean formation, the sealing assembly including: a) a mandrel; b) a scaling element positioned about the mandrel; c) a cylindrical protective sleeve positioned about the scaling element, the cylindrical protective sleeve configured to break to deploy from an undeployed state to a deployed state based upon axial or radial stress imparted thereon; 2) breaking the cylindrical protective sleeve, thereby allowing the cylindrical protective sleeve to move from the undeployed state to the deployed state; and 3) based upon axial or radial stress imparted thereon.

Aspects A, B, C, D, E, F, G, H and I may have one or more of the following additional elements in combination: Element 1: wherein the deployable spacer includes two flanges, and further wherein a first of the two flanges is configured to control a deployment of the first sealing element portion and a second of the two flanges is configured to control a deployment of the second scaling element portion. Element 2: wherein the first of the two flanges and the second of the two flanges are configured to separately deploy. Element 3: wherein the deployable spacer includes a base member having the two flanges connected thereto, the base member positioned proximate the mandrel. Element 4: wherein the base member has a wide portion proximate the mandrel and a narrow portion distal the mandrel, the wide portion configured to resist lifting or overturning of the deployable spacer as the sealing element moves between the radially retracted state the radially expanded state. Element 5: wherein the base member includes a first base member portion coupled to the first of the two flanges and a separate second base member portion coupled to the second of the two flanges. Element 6: wherein the two flanges have one or more weakened spots, the weakened spots configured to allow the two flanges to deploy easier. Element 7: wherein the weakened spots are removed sections. Element 8: wherein at least a portion of the deployable spacer comprises a material having a yield strength of 40 ksi or less. Element 9: further including a first backup shoe positioned between the first collar sleeve and the first end of the scaling element, and a second backup shoe positioned between the second collar sleeve and the second end of the sealing element. Element 10: wherein the first backup shoe includes a first backup shoe portion and a separate second backup shoe portion, the first backup shoe portion located proximate the first collar sleeve, and the second backup shoe portion located between the first backup shoe portion and the first sealing element portion. Element 11: wherein the first backup shoe portion, the second backup shoe portion and the deployable spacer comprise a similar material. Element 12: wherein the first backup shoe portion, the second backup shoe portion and the deployable spacer each have a yield strength of 40 ksi or less. Element 13: wherein the deployable control band is a first deployable control band, and further including a second deployable control band positioned about the radially outer surface. Element 14: further including third and fourth deployable control bands positioned about the outer surface, the third and fourth deployable control bands positioned on opposing axial sides of the first and second deployable control bands. Element 15: wherein the first and second deployable control bands have a first control band stiffness, and further wherein the third and fourth deployable control bands have a second control band stiffness. Element 16: wherein the second control band stiffness is different than the first control band stiffness. Element 17: wherein the second control band stiffness is greater than the first control band stiffness. Element 18: wherein the first and second deployable control bands comprise a material having the first control band stiffness and the third and fourth deployable control bands comprise a different material having the second different control band stiffness. Element 19: wherein the first and second control bands having a similar stiffness, the similar stiffness configured to cause a portion of the sealing element therebetween to buckle at the same time. Element 20: wherein the first and second deployable control bands are configured to remain intact after the sealing element moves to the radially expanded state. Element 21: wherein the first and second deployable control bands are configured to break after the sealing element moves to the radially expanded state. Element 22: wherein the deployable control band is positioned radially outside the radial outer surface. Element 23: wherein the deployable control band is embedded within the sealing element. Element 24: wherein the cylindrical protective sleeve includes a body having a weakened region, the weakened region defining first and second cylindrical protective sleeve portions. Element 25: wherein the weakened region is located substantially proximate a midpoint of the sealing element. Element 26: wherein the weakened region is located ideally proximate a midpoint of the sealing element. Element 26: wherein the weakened region is a circumferential notch located around an inside radial surface of the cylindrical protective sleeve. Element 27: wherein the circumferential notch does not extend entirely through a thickness of the cylindrical protective sleeve. Element 28: wherein the circumferential notch does extend entirely through a thickness of the cylindrical protective sleeve. Element 29: wherein the weakened region is a circumferential notch located around an outside radial surface of the cylindrical protective sleeve. Element 30: wherein the weakened region includes a plurality of removed sections. Element 31: wherein at least a portion of the cylindrical protective sleeve comprises a corrodible material providing the weakened region. Element 32: further including one or more actuating mechanisms coupled to the cylindrical protective sleeve, the one or more actuating mechanisms configured to withdraw the first or second cylindrical protective sleeve portions from about the sealing element after the weakened region has failed. Element 33: wherein the one or more actuating mechanisms are configured to withdraw the first and second cylindrical protective sleeve portions from about the sealing element after the weakened region has failed. Element 34: wherein the one or more actuating mechanisms are one or more spring mechanisms. Element 35: wherein the cylindrical protective sleeve is located radially about at least 80 percent of the sealing element. Element 36: wherein the cylindrical protective sleeve is located radially about at least 95 percent of the sealing element. Element 38: wherein the cylindrical protective sleeve is located radially about an entirety of the sealing element. Element 39: further including: a first collar sleeve coupled proximate a first end of the sealing element; and a second collar sleeve coupled proximate a second end of the sealing element, wherein the first and second collar sleeves are configured to axially translate relative to one another along the mandrel to move the sealing element between a radially retracted state and a radially expanded state Element 40: wherein the cylindrical protective sleeve is configured to break to deploy from the undeployed state to the deployed state prior to the first and second collar sleeves axially translating relative to one another or as the first and second collar sleeves axially translate relative to one another. Element 41: wherein the cylindrical protective sleeve is configured to break to deploy from the undeployed state to the deployed state as the sealing element deploys from its radially retracted state to its radially expanded state in response to coming into contact with a downhole fluid. Element 42: wherein the cylindrical protective sleeve is configured to prevent wellbore fluid from contacting the sealing element prior to the cylindrical protective sleeve breaking. Element 43: where in the breaking occurs prior to the axially translating. Element 44: wherein the breaking occurs during the axially translating. Element 45: wherein the braking occurs as the sealing element moves from its radially retracted state to its radially expanded state.

Those skilled in the art to which this application relates will appreciate that other and further additions, deletions, substitutions and modifications may be made to the described embodiments.

What is claimed is:

1. A sealing assembly, comprising:

a mandrel;

a sealing element positioned about the mandrel; and a cylindrical protective sleeve positioned about the sealing element, the cylindrical protective sleeve configured to break to deploy from an undeployed state to a deployed state based upon axial or radial stress imparted thereon and allow the sealing element to be axially compressed into contact with a wellbore tubular, wherein the cylindrical protective sleeve includes a body having a weakened region, the weakened region defining first and second cylindrical protective sleeve portions, further including one or more actuating mechanisms coupled to the cylindrical protective sleeve, the one or more actuating mechanisms configured to withdraw the first or second cylindrical protective sleeve portions from about the sealing element after the weakened region has failed.

2. The sealing assembly as recited in claim 1, wherein the weakened region is located substantially proximate a midpoint of the sealing element.

3. The sealing assembly as recited in claim 1, wherein the weakened region is located ideally proximate a midpoint of the sealing element.

4. The sealing assembly as recited in claim 1, wherein the weakened region is a circumferential notch located around an inside radial surface of the cylindrical protective sleeve.

5. The sealing assembly as recited in claim 4, wherein the circumferential notch does not extend entirely through a thickness of the cylindrical protective sleeve.

6. The sealing assembly as recited in claim 4, wherein the circumferential notch does extend entirely through a thickness of the cylindrical protective sleeve.

7. The sealing assembly as recited in claim 1, wherein the weakened region is a circumferential notch located around an outside radial surface of the cylindrical protective sleeve.

8. The sealing assembly as recited in claim 4, wherein the weakened region includes a plurality of removed sections.

9. The sealing assembly as recited in claim 1, wherein at least a portion of the cylindrical protective sleeve comprises a corrodible material providing the weakened region.

10. The sealing assembly as recited in claim 1, wherein the one or more actuating mechanisms are configured to withdraw the first and second cylindrical protective sleeve portions from about the sealing element after the weakened region has failed.

11. The sealing assembly as recited in claim 1, wherein the one or more actuating mechanisms are one or more spring mechanisms.

12. The sealing assembly as recited in claim 1, wherein the cylindrical protective sleeve is located radially about at least 80 percent of the sealing element.

13. The sealing assembly as recited in claim 1, wherein the cylindrical protective sleeve is located radially about at least 95 percent of the sealing element.

14. The sealing assembly as recited in claim 1, wherein the cylindrical protective sleeve is located radially about an entirety of the sealing element.

15. The sealing assembly as recited in claim 1, further including:

a first collar sleeve coupled proximate a first end of the sealing element; and a second collar sleeve coupled proximate a second end of the sealing element, wherein the first and second collar sleeves are configured to axially translate relative to one another along the mandrel to move the sealing element between a radially retracted state and a radially expanded state.

16. The sealing assembly as recited in claim 15, wherein the cylindrical protective sleeve is configured to break to deploy from the undeployed state to the deployed state prior to the first and second collar sleeves axially translating relative to one another or as the first and second collar sleeves axially translate relative to one another.

17. The sealing assembly as recited in claim 1, wherein the cylindrical protective sleeve is configured to break to deploy from the undeployed state to the deployed state as the sealing element deploys from its radially retracted state to its radially expanded state in response to coming into contact with a downhole fluid.

18. The sealing assembly as recited in claim 1, wherein the cylindrical protective sleeve is configured to prevent wellbore fluid from contacting the sealing element prior to the cylindrical protective sleeve breaking.

19. A well system, comprising:

a wellbore located in a subterranean formation; and a sealing assembly positioned in the wellbore, the sealing assembly including:

a mandrel;

a sealing element positioned about the mandrel; and a cylindrical protective sleeve positioned about the sealing element, the cylindrical protective sleeve configured to break to deploy from an undeployed state to a deployed state based upon axial or radial stress imparted thereon and allow the sealing element to be axially compressed into contact with a wellbore tubular, wherein the cylindrical protective sleeve includes a body having a weakened region, the weakened region defining first and second cylindrical protective sleeve portions, further including one or more actuating mechanisms coupled to the cylindrical protective sleeve, the one or more actuating mechanisms configured to withdraw the first or second cylindrical protective sleeve portions from about the sealing element after the weakened region has failed.

20. The well system as recited in claim 19, wherein the weakened region is located substantially proximate a midpoint of the sealing element.

21. The well system as recited in claim 19, wherein the weakened region is located ideally proximate a midpoint of the sealing element.

22. The well system as recited in claim 19, wherein the weakened region is a circumferential notch located around an inside radial surface of the cylindrical protective sleeve.

23. The well system as recited in claim 22, wherein the circumferential notch does not extend entirely through a thickness of the cylindrical protective sleeve.

24. The well system as recited in claim 22, wherein the circumferential notch does extend entirely through a thickness of the cylindrical protective sleeve.

25. The well system as recited in claim 19, wherein the weakened region is a circumferential notch located around an outside radial surface of the cylindrical protective sleeve.

26. The well system as recited in claim 19, wherein the weakened region includes a plurality of removed sections.

27. The well system as recited in claim 19, wherein at least a portion of the cylindrical protective sleeve comprises a corrodible material providing the weakened region.

28. The well system as recited in claim 19, wherein the one or more actuating mechanisms are configured to withdraw the first and second cylindrical protective sleeve portions from about the sealing element after the weakened region has failed.

29. The well system as recited in claim 19, wherein the one or more actuating mechanisms are one or more spring mechanisms.

30. The well system as recited in claim 19, wherein the cylindrical protective sleeve is located radially about at least 80 percent of the sealing element.

31. The well system as recited in claim 19, wherein the cylindrical protective sleeve is located radially about at least 95 percent of the sealing element.

32. The well system as recited in claim 19, wherein the cylindrical protective sleeve is located radially about an entirety of the sealing element.

33. The well system as recited in claim 19, further including:

a first collar sleeve coupled proximate a first end of the sealing element; and a second collar sleeve coupled proximate a second end of the sealing element, wherein the first and second collar sleeves are configured to axially translate relative to one another along the mandrel to move the sealing element between a radially retracted state and a radially expanded state.

34. The well system as recited in claim 33, wherein the cylindrical protective sleeve is configured to break to deploy from the undeployed state to the deployed state prior to the first and second collar sleeves axially translating relative to one another or as the first and second collar sleeves axially translate relative to one another.

35. The well system as recited in claim 19, wherein the cylindrical protective sleeve is configured to break to deploy from the undeployed state to the deployed state as the sealing element deploys from its radially retracted state to its radially expanded state in response to coming into contact with a downhole fluid.

36. The well system as recited in claim 19, wherein the cylindrical protective sleeve is configured to prevent wellbore fluid from contacting the sealing element prior to the cylindrical protective sleeve breaking.

37. A method, comprising:

positioning a sealing assembly within a wellbore located in a subterranean formation, the sealing assembly including:

a mandrel;

a sealing element positioned about the mandrel, the sealing element formed of a non-fluid swellable material, the non-fluid swellable material not configured to swell into contact with a wellbore tubular; and a cylindrical protective sleeve positioned about the sealing element, the cylindrical protective sleeve configured to break to deploy from an undeployed state to a deployed state based upon axial or radial stress imparted thereon and allow the sealing element to be axially compressed into contact with the wellbore tubular, wherein the cylindrical protective sleeve includes a body having a weakened region, the weakened region defining first and second cylindrical protective sleeve portions, further including one or more actuating mechanisms coupled to the cylindrical protective sleeve, the one or more actuating mechanisms configured to withdraw the first or second cylindrical protective sleeve portions from about the sealing element after the weakened region has failed;

breaking the cylindrical protective sleeve, thereby allowing the cylindrical protective sleeve to move from the undeployed state to the deployed state; and setting the sealing element, the setting causing the sealing element to move from its radially retracted state to its radially expanded state.

38. The method as recited in claim 37, wherein the breaking occurs prior to the setting.

39. The method as recited in claim 37, wherein the breaking occurs during the setting.

40. The method as recited in claim 39, wherein the braking occurs as the sealing element moves from its radially retracted state to its radially expanded state.

* * * * *